US011987961B2

(12) United States Patent
Taylor

(10) Patent No.: US 11,987,961 B2
(45) Date of Patent: May 21, 2024

(54) VIRTUAL FIELD-BASED TRACK PROTECTION FOR A MINING MACHINE

(71) Applicant: Joy Global Surface Mining Inc, Milwaukee, WI (US)

(72) Inventor: Wesley P. Taylor, Glendale, WI (US)

(73) Assignee: JOY GLOBAL SURFACE MINING INC, Milwaukee, WI (US)

( * ) Notice: Subject to any disclaimer, the term of this patent is extended or adjusted under 35 U.S.C. 154(b) by 307 days.

(21) Appl. No.: 17/216,180

(22) Filed: Mar. 29, 2021

(65) Prior Publication Data

US 2022/0307235 A1 Sep. 29, 2022

(51) Int. Cl.

| | |
|---|---|
| ***E02F 9/26*** | (2006.01) |
| ***E02F 3/30*** | (2006.01) |
| ***E02F 3/52*** | (2006.01) |

(52) U.S. Cl.

CPC ..... *E02F 9/265* (2013.01); *E02F 3/308* (2013.01); *E02F 3/52* (2013.01)

(58) Field of Classification Search

None

See application file for complete search history.

(56) References Cited

U.S. PATENT DOCUMENTS

| | | | | |
|---|---|---|---|---|
| 5,525,028 | A | 6/1996 | Ogasawa et al. | |
| 6,032,093 | A * | 2/2000 | Denbraber | E02F 3/308 700/304 |
| 6,729,831 | B1 | 5/2004 | Kawamura et al. | |
| 7,034,669 | B2 | 4/2006 | Lamb | |
| 8,315,789 | B2 | 11/2012 | Dunbabin et al. | |
| 8,571,762 | B2 | 10/2013 | McAree et al. | |
| 8,843,279 | B2 | 9/2014 | Tafazoli Bilandi et al. | |
| 8,898,000 | B2 | 11/2014 | McAree et al. | |

(Continued)

FOREIGN PATENT DOCUMENTS

| | | |
|---|---|---|
| AU | 2012252544 B2 | 9/2015 |
| EP | 0221883 A1 | 5/1987 |

(Continued)

OTHER PUBLICATIONS

Frimpong, et al., "Multi-Body Kinematics of Shovel Crawler Performance in Rugged Terrains," International Journal of Mining Science, vol. 4, Iss. 1, 2018, (pp. 29-45).

(Continued)

*Primary Examiner* — Tyler J Lee
*Assistant Examiner* — Yufeng Zhang
(74) *Attorney, Agent, or Firm* — Husch Blackwell LLP

(57) ABSTRACT

Embodiments described herein provide systems and methods for preventing and mitigating collisions between components of an industrial machine. The industrial machine includes an electronic controller, having an electronic processor and a memory, that is configured to receive dipper position data indicative of a position of the dipper and determine a distance between the dipper and tracks of the industrial machine based on the dipper position data. The electronic controller is further configured to set a motion command limit for a dipper motion based on the distance, the dipper motion being selected from a group of a swing motion, a crowd motion, and a hoist motion and control the dipper motion according to a dipper motion command limited by the motion command limit.

32 Claims, 22 Drawing Sheets

(56) References Cited

U.S. PATENT DOCUMENTS

| | | | | |
|---|---|---|---|---|
| 9,030,332 | B2 | 5/2015 | Tafazoli Bilandi et al. | |
| 9,255,377 | B2 | 2/2016 | Colwell et al. | |
| 9,500,079 | B2 | 11/2016 | Makela | |
| 9,644,346 | B2 | 5/2017 | Seki et al. | |
| 9,803,337 | B2 | 10/2017 | Humphrey et al. | |
| 9,944,499 | B2 | 4/2018 | Schoonmaker et al. | |
| 10,060,097 | B2 | 8/2018 | Friend et al. | |
| 10,072,395 | B2 | 9/2018 | Tsukamoto | |
| 10,358,795 | B2 | 7/2019 | Hoshaku et al. | |
| 10,655,301 | B2 | 5/2020 | Linstroth et al. | |
| 2007/0120656 | A1* | 5/2007 | Nakanishi | H04N 7/18 348/148 |
| 2009/0030580 | A1 | 1/2009 | Doi | |
| 2010/0036645 | A1 | 2/2010 | Mcaree | |
| 2013/0013251 | A1 | 1/2013 | Schoonmaker et al. | |
| 2013/0261903 | A1* | 10/2013 | Hargrave, Jr. | E02F 9/262 701/50 |
| 2013/0299440 | A1 | 11/2013 | Hermann et al. | |
| 2014/0316665 | A1 | 10/2014 | Hargrave, Jr. et al. | |
| 2014/0338235 | A1* | 11/2014 | Ryan | E02F 3/435 701/50 |
| 2015/0292895 | A1 | 10/2015 | Lewis et al. | |
| 2017/0073925 | A1 | 3/2017 | Friend et al. | |
| 2017/0073935 | A1 | 3/2017 | Friend et al. | |
| 2018/0179892 | A1 | 6/2018 | Moberg et al. | |
| 2018/0266079 | A1 | 9/2018 | Morita et al. | |
| 2019/0093311 | A1 | 3/2019 | Naito | |
| 2019/0102712 | A1 | 4/2019 | Duca | |
| 2019/0264506 | A1 | 8/2019 | Hren | |
| 2020/0181883 | A1* | 6/2020 | Igarashi | G05B 19/416 |
| 2021/0002859 | A1 | 1/2021 | Wu | |

FOREIGN PATENT DOCUMENTS

| | | | |
|---|---|---|---|
| EP | 0412400 | A1 | 2/1991 |
| EP | 3385494 | A1 | 10/2018 |
| KR | 20200089997 | A1 | 7/2020 |

OTHER PUBLICATIONS

International Search Report and Written Opinion for Application No. PCT/US2022/022155 dated Aug. 26, 2022 (13 pages).

Shi, et al., "An operation optimization method of a fully mechanized coal mining face based on semi-physical virtual simulation," International Journal of Coal Science & Technology, vol. 7, No. 1, Mar. 2020 (pp. 147-163).

* cited by examiner

VIRTUAL FIELD-BASED TRACK PROTECTION FOR A MINING MACHINE

FIELD

Embodiments described herein relate to systems and methods for preventing or mitigating collisions between a dipper and tracks of a mining machine

SUMMARY

Rope shovels include a dipper that typically can be controlled by an operator to move along at least three motions: hoist (up/down), crowd (in/out), and swing (left/right). During the course of mining operations, an operator may inadvertently control the dipper in such a way that results in a collision with tracks of the rope shovel. Such collisions can damage the lower machinery, the dipper, or both.

Embodiments described herein provide systems and methods that mitigate or avoid such collisions by limiting dipper movement in terms of the swing motion, crowd motion, and/or hoist motion, depending on the current proximity of the dipper to the tracks. At least some of the embodiments provide collision prevention and mitigation by defining virtual three-dimensional fields around the dipper for each of the swing, crowd, and hoist dipper motions. When one or more of these virtual fields of the dipper overlaps a virtual tracks model for the rope shovel, the one or more dipper motions associated with the one or more overlapping virtual fields is limited. These dipper motions are increasingly limited the closer that the dipper is to the tracks, which may be perceived by the operator like the increasing repelling forces of the ends of two magnets having the same pole as they come closer together. By limiting one or more dipper motions, the systems and methods described herein result in mitigated collisions (e.g., collisions with reduced severity than would otherwise occur) and, in some instances, prevented collisions (i.e., collisions that are avoided that would otherwise occur).

In one embodiment, a method is provided for preventing and mitigating collisions between a dipper and tracks of a mining machine. The method includes receiving, by an electronic processor, dipper position data indicative of a position of the dipper and determining, by the electronic processor, a distance between the dipper and the tracks of the mining machine based on the dipper position data. The method further includes setting, by the electronic processor, a motion command limit for a dipper motion based on the distance, the dipper motion being selected from a group of a swing motion, a crowd motion, and a hoist motion and controlling, by the electronic processor, the dipper motion according to a dipper motion command limited by the motion command limit.

In another embodiment, a mining machine with a collision prevention and mitigation system is provided. The mining machine includes a frame, tracks supporting the frame and configured to be driven to move the frame over a ground surface, a dipper supported by the frame, a dipper drive coupled to the dipper and configured to move the dipper in a dipper motion selected from a group of a swing motion, a crowd motion, and a hoist motion, and a dipper position sensor configured to determine a position of the dipper. The mining machine further includes an electronic controller, which includes an electronic processor and a memory, that is coupled to the dipper drive and the dipper position sensor. The electronic controller is configured to receive dipper position data from the dipper position sensor indicative of a position of the dipper and determine a distance between the dipper and the tracks of the mining machine based on the dipper position data. The electronic controller is further configured to set a motion command limit for the dipper motion based on the distance, and control, via the dipper drive, the dipper motion according to a dipper motion command limited by the motion command limit.

In another embodiment, a collision prevention and mitigation control system is provided for a mining machine having a frame, tracks supporting the frame and configured to be driven to move the frame over a ground surface, a dipper supported by the frame, a dipper drive coupled to the dipper and configured to move the dipper in a dipper motion selected from a group of a swing motion, a crowd motion, and a hoist motion, and a dipper position sensor configured to determine a position of the dipper. The control system includes an electronic controller, which includes an electronic processor and a memory, that is coupled to the dipper drive and dipper position sensor. The electronic controller is configured to receive dipper position data from the dipper position sensor indicative of a position of the dipper and determine a distance between the dipper and the tracks of the mining machine based on the dipper position data. The electronic controller is further configured to set a motion command limit for the dipper motion based on the distance and control, via the dipper drive, the dipper motion according to a dipper motion command limited by the command limit.

Additional embodiments described herein provide systems and methods that mitigate or avoid such collisions between the dipper and an exclusionary zone by limiting dipper movement in terms of the swing motion, crowd motion, and/or hoist motion, depending on the current proximity of the dipper to the exclusionary zone. At least some of the embodiments provide collision prevention and mitigation by defining virtual three-dimensional fields around the dipper for each of the swing, crowd, and hoist dipper motions. When one or more of these virtual fields of the dipper overlaps a virtual exclusionary zone model for the rope shovel, the one or more dipper motions associated with the one or more overlapping virtual fields is limited. These dipper motions are increasingly limited the closer that the dipper is to the exclusionary zone, which may be perceived by the operator like the increasing repelling forces of the ends of two magnets having the same pole as they come closer together. By limiting one or more dipper motions, the systems and methods described herein result in mitigated collisions (e.g., collisions with reduced severity than would otherwise occur) and, in some instances, prevented collisions (i.e., collisions that are avoided that would otherwise occur).

Other embodiments described herein provide systems and methods for generating a three-dimensional virtual track model. This track model may be used, for example, in collision prevention and mitigation systems and methods, such as those described herein, and in other collision prevention and mitigation systems and other mining systems using virtual track models. In some embodiments, the systems and methods described herein provide a simplified modeling process that enables quick, accurate modeling of tracks of a mining machine that can account for custom tracks that vary in size depending on the particular mining machine. Other aspects of the embodiments will become apparent by consideration of the detailed description and accompanying drawings.

DETAILED DESCRIPTION

Figure 1:
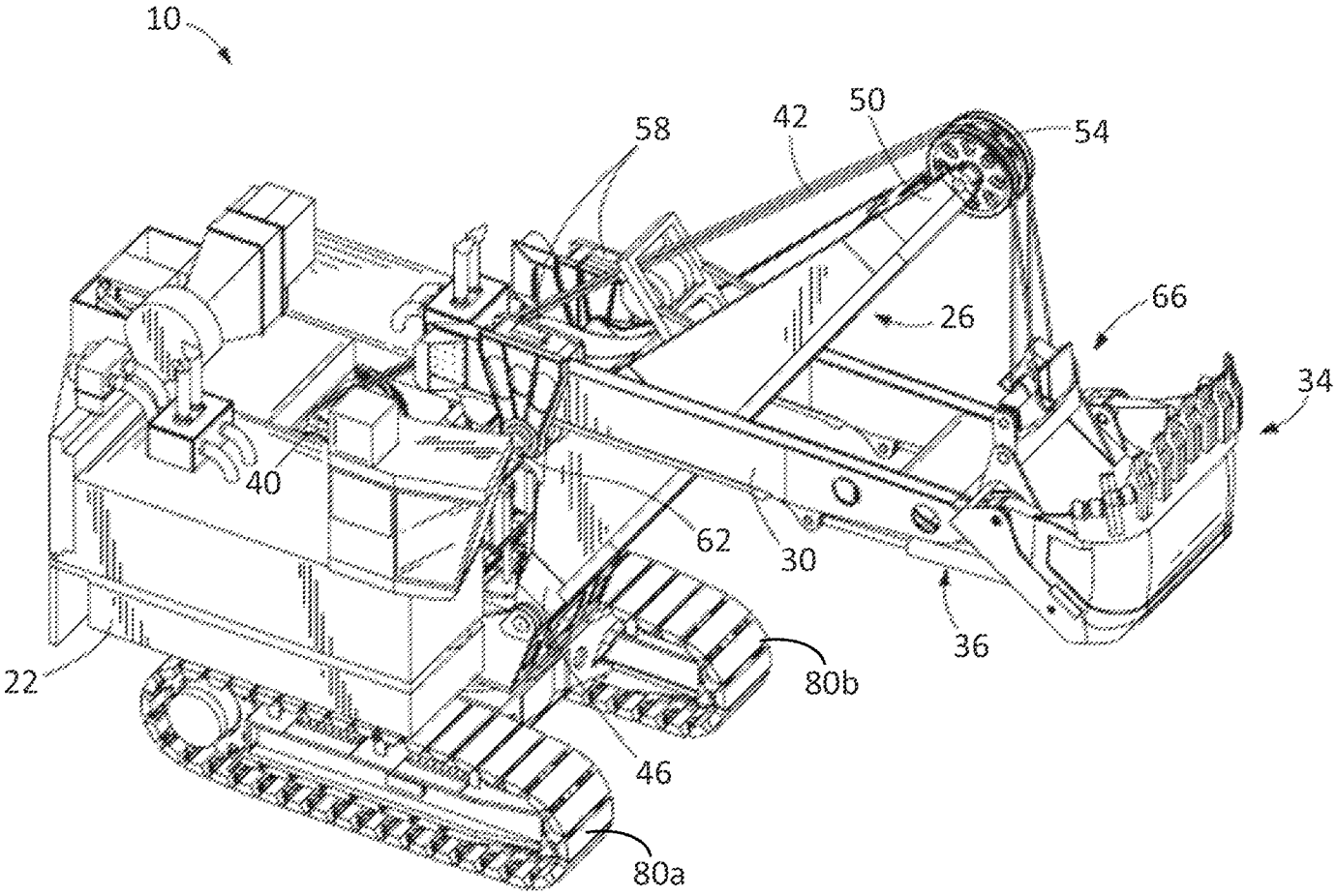
FIG. 1 is a perspective view of a mining machine, according to some embodiments.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more electronic processors, such as a microprocessor and/or application specific integrated circuits ("ASICs"). As such, it should be noted that a plurality of hardware and software based devices, as well as a plurality of different structural components, may be utilized to implement the embodiments. For example, "servers," "computing devices," "controllers," "processors," etc., described in the specification can include one or more electronic processors, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4." The relative terminology may refer to plus or minus a percentage (e.g., 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

Figure 2:
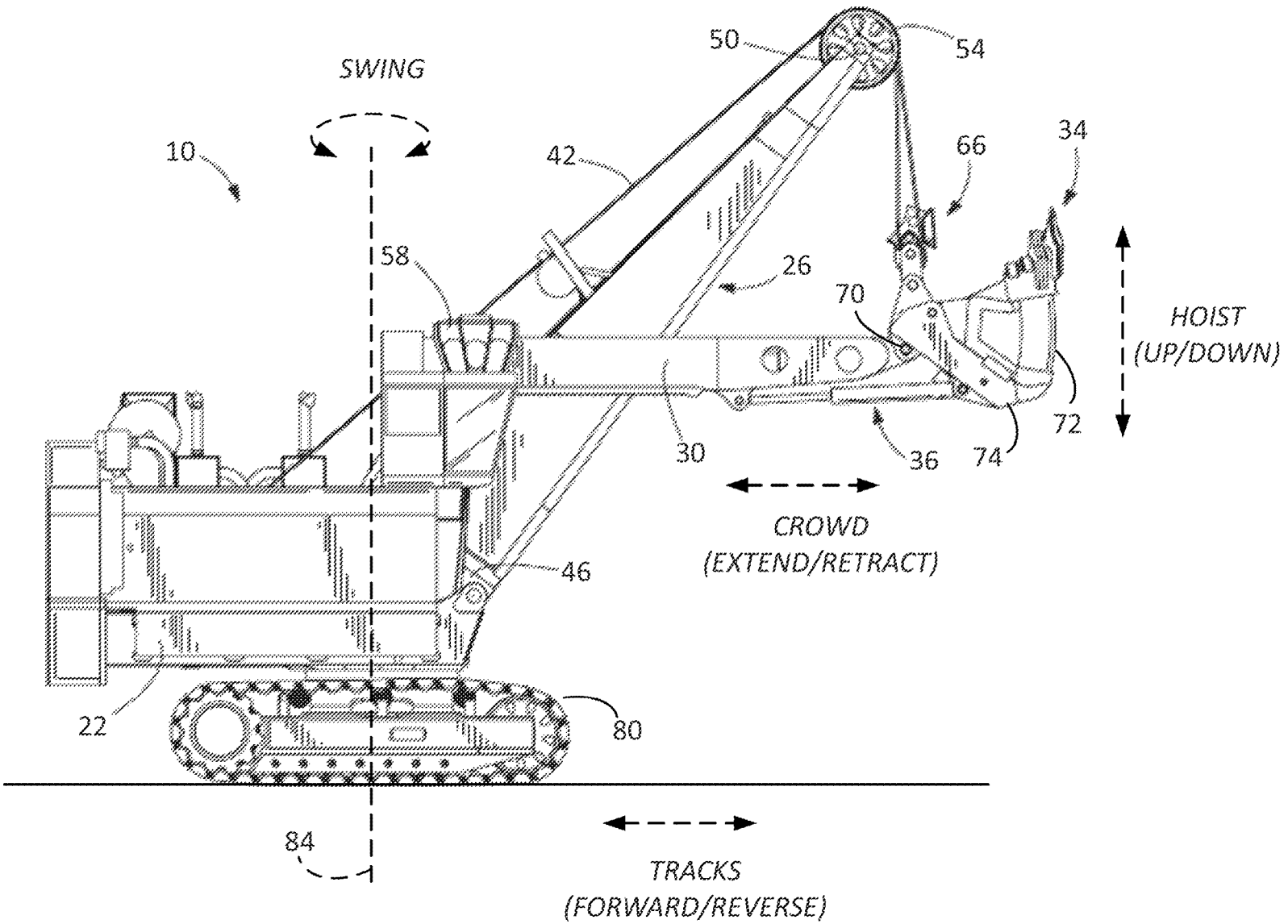
FIG. 2 is a profile view of the mining machine of FIG. 1.

As shown in FIGS. 1 and 2, a rope shovel 10 rests on a support surface, or floor, and includes a base or frame 22, a boom 26, a first member or handle 30, a dipper or bucket 34, and a pivot actuator 36. The base 22 includes a hoist drum 40 (FIG. 1) for reeling in and paying out a cable, or hoist rope 42. The boom 26 includes a first end 46 coupled to the base 22, a second end 50 opposite the first end 46, a boom sheave 54, a saddle block 58, and a shipper shaft 62 (FIG. 1). The boom sheave 54 is coupled to the second end 50 of the boom 26 and guides the rope 42 over the second end 50. The rope 42 is coupled to the dipper 34 by a bail 66. The dipper 34 is raised or lowered as the rope 42 is reeled in or paid out, respectively, by the hoist drum 40. The motion up and down by the dipper 34 due to the rotation of the hoist drum 40 is referred to as hoist motion, which may include hoisting up and hoisting down.

The saddle block 58 is rotatably coupled to the boom 26 by the shipper shaft 62, which is positioned between the first end 46 and the second end 50 of the boom 26 and extends through the boom 26. The handle 30 is moveably coupled to the boom 26 by the saddle block 58. The shipper shaft 62 includes a spline pinion for engaging a rack 90 of the handle 30. The first end 82 of the handle 30 is moveably received in the saddle block 58, and the handle 30 passes through the saddle block 58 such that the handle 30 is configured for rotational and translational movement relative to the boom 26 (FIG. 1). Stated another way, the handle 30 is linearly extendable and retractable relative to the saddle block 58 and is rotatable about the shipper shaft 62. The motion of the dipper 34 in and out due to extension and retraction of the handle 30 is referred to as crowd motion, which may include crowding in and crowding out.

The dipper 34 is pivotably coupled to the handle 30 at a wrist joint 70. The bail 66 is coupled to the rope 42 passing over the boom sheave 54 and is pivotably coupled to the dipper 34. The pivot actuator 36 controls the pitch of the dipper 34 by rotating the dipper 34 about the wrist joint 70. In the illustrated embodiment, the pivot actuator 36 includes a pair of hydraulic cylinders directly coupled between a lower portion of the handle 30 and a lower portion of the dipper 34. In other embodiments, a different type of actuator may be used.

In the illustrated embodiment, the dipper 34 is a clamshell-type dipper including a main body 72 and a rear wall 74. The main body 72 is pivotably coupled to the rear wall 74 about a dipper joint and can be controlled by a hydraulic cylinder to open apart to discharge contents within the dipper 34. In other embodiments, instead of a clamshell-type dipper, the dipper 34 is a bucket-type dipper with a pivoting dump door that latches and that is selectively opened to dump contents of the dipper 34.

The shovel 10 further includes tracks 80 configured to be driven to move the shovel 10 forward, in reverse, or to turn over a ground surface. The tracks 80 may include a first, or right, track 80*a* and a second, or left, track 80*b*. The term tracks 80 may be used herein to reference one of the tracks 80*a* or 80*b* generically, or both of the tracks 80*a* and 80*b* collectively. The base 22 is further operable to rotate relative to the tracks 80 about a swing axis 84.

The shovel 10 of FIGS. 1 and 2 is an example of a rope shovel that may implement one or more embodiments described herein. However, in some embodiments, rope shovels of a different construction are used. For example, some constructions of the shovel 10 do not include the operator cab 120 or one or more other components as described above. Other constructions of the shovel 10 may include additional components not shown in FIGS. 1 and 2.

Figure 3A:
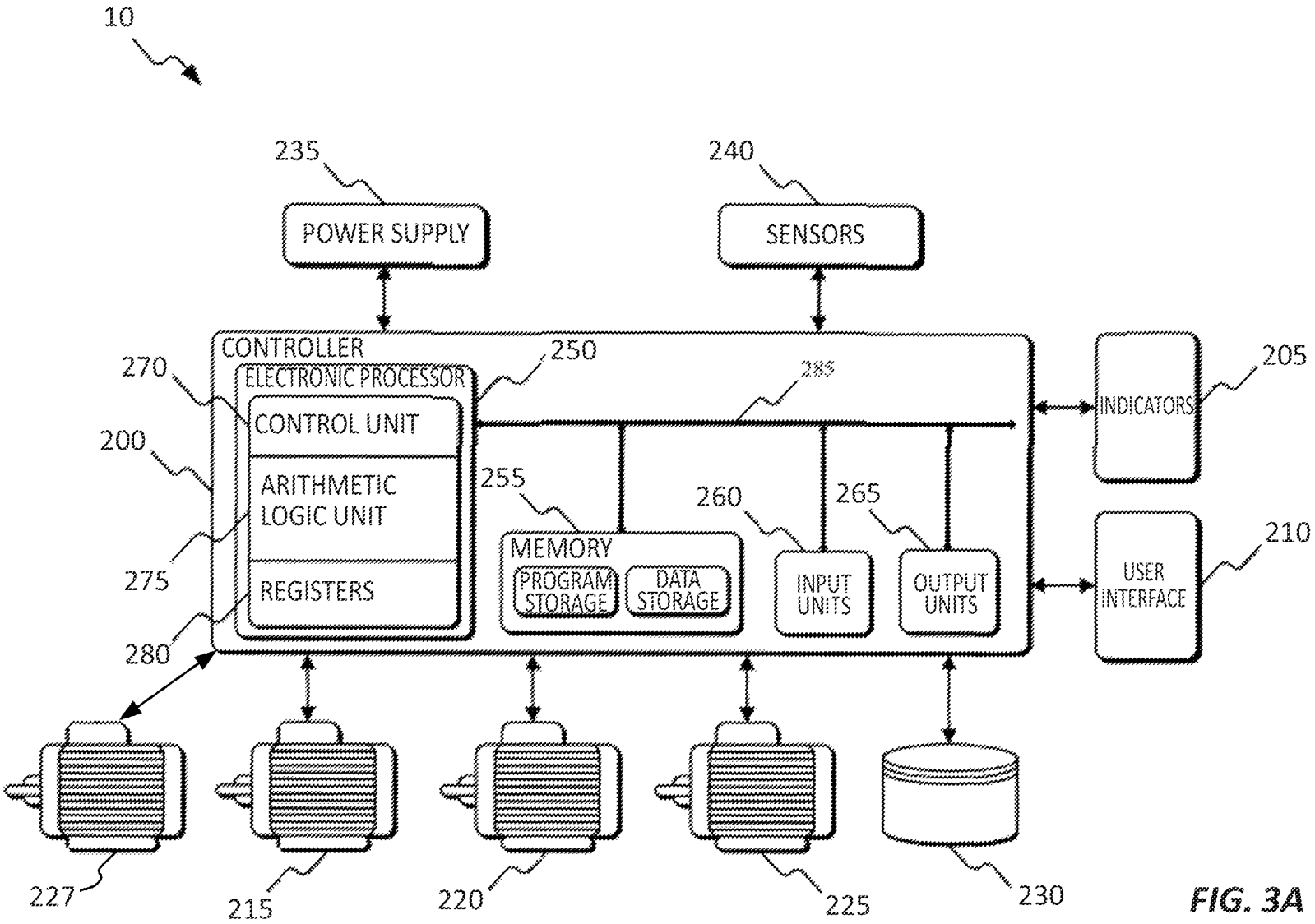
FIGS. 3A-3B are block diagrams for the mining machine of FIG. 1, according to some embodiments.

FIG. 3A illustrates a block diagram of the shovel 10. The shovel 10 includes a controller 200, which is an electronic controller that is electrically and/or communicatively connected to a variety of modules or components of the shovel 10. For example, the illustrated controller 200 is connected to one or more indicators 205, a user interface 210, a crowd drive 215, a hoist drive 220, a swing drive 225, a tracks drive 227, a database 230, a power supply 235, and one or more sensors 240.

The controller 200 includes combinations of hardware and software that are configured, operable, and/or programmed to, among other things, control the operation of the shovel 10, generate sets of control signals to activate the one or more indicators 205 (e.g., a liquid crystal display ["LCD"], one or more light sources [e.g., LEDs], etc.), monitor the operation of the shovel 10, and the like. The one or more sensors 240 include, among other things, a loadpin, a strain gauge, one or more inclinometers, gantry pins, one or more motor field modules (e.g., measuring motor parameters such as current, voltage, power, etc.), one or more rope tension sensors, one or more resolvers, RADAR, LIDAR, one or more cameras, one or more infrared sensors, and the like.

The controller 200 includes a plurality of electrical and electronic components that provide power, operational control, and protection to the components and modules within the controller 200 and/or shovel 10. For example, the controller 200 includes, among other things, an electronic processor 250 (e.g., a microprocessor, a microcontroller, or another suitable programmable device), a memory 255, input units 260, and output units 265. The electronic processor 250 includes, among other things, a control unit 270, an arithmetic logic unit ("ALU") 275, and a plurality of registers 280 (shown as a group of registers in FIG. 3A), and is implemented using a known computer architecture (e.g., a modified Harvard architecture, a von Neumann architecture, etc.). The electronic processor 250, the memory 255, the input units 260, and the output units 265, as well as the various modules connected to the controller 200 are connected by one or more control and/or data buses (e.g., common bus 285). The control and/or data buses are shown generally in FIG. 3A for illustrative purposes. The use of one or more control and/or data buses for the interconnection between and communication among the various modules and components would be known to a person skilled in the art in view of the embodiments described herein.

The memory 255 is a non-transitory computer readable medium that includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The electronic processor 250 is connected to the memory 255 and executes software instructions that are stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 and, in particular, the electronic processor 250, is configured to retrieve from memory and execute, among other things, instructions for implementing or otherwise related to the control processes and methods described herein. In other constructions, the controller 200 includes additional, fewer, or different components.

The power supply 235 supplies a nominal AC or DC voltage to the controller 200 and other components or modules of the shovel 10. The power supply 235 receives power from, for example, an engine-generator, and conditions that power (e.g., steps down, steps up, filters the power) and provides the conditioned power to the components of the shovel 10 and controller 200. For example, the power supply 235 may include a plurality of power supplies providing different power levels to different components of the shovel 10. For example, a first power supply of the power supply 235 may provide lower voltages to operate circuits and components within the controller 200 or shovel 10 and a second power supply to provide power to the drives 215, 220, 225, 227. In other constructions, the controller 200 or other components and modules within the shovel 10 are powered by line voltage provided by a power cable coupled to a power station off-board the shovel 10, one or more batteries or battery packs, or another grid-independent power source (e.g., a solar panel, etc.).

The user interface 210 is used to control or monitor the shovel 10. The user interface 210 includes a combination of digital and analog input or output devices used to achieve a desired level of control and monitoring for the shovel 10. For example, the user interface 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, or the like. The user interface 210 can also be configured to display conditions or data associated with the shovel 10 in real-time or substantially real-time. For example, the user interface 210 is configured to display measured electrical characteristics of the shovel 10, the status of the shovel 10, etc. In some implementations, the user interface 210 is controlled in conjunction with the one or more indicators 205 (e.g., LEDs, speakers, etc.) to provide visual or auditory indications (e.g., from a horn of the shovel 10) of the status or conditions of the shovel 10. In some implementations, at least a portion of the user interface 210 is off-board of the shovel 10 and includes control inputs enabling remote control of the shovel 10 by an operator not present in the operator cab.

The crowd drive 215, the hoist drive 220, the swing drive 225, and the tracks drive 227 may each include a respective motor and a drive controller configured to drive the motor based on commands from the controller 200. The commands may be generated in response to inputs received from an operator of the shovel 10 via the user interface 210.

Figure 3B:
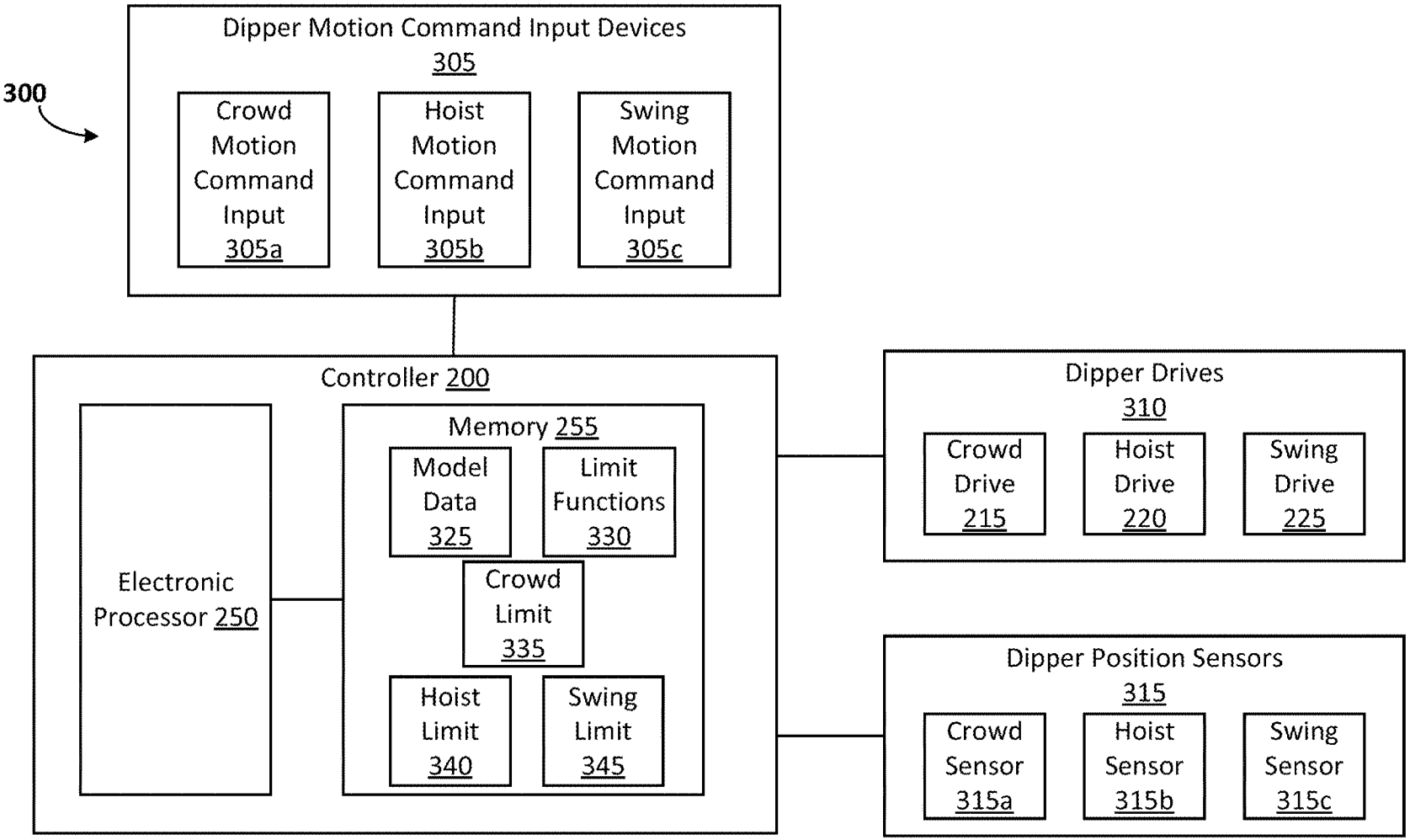

FIG. 3B provides a block diagram 300 for the shovel 10 illustrating portions of the shovel 10 in further detail. For example, FIG. 3A illustrates dipper motion command input devices 305, dipper drives 310, and dipper position sensors 315 coupled to the controller 200. The dipper motion command input devices 305 form a portion of the user interface 210 and include a crowd motion command input 305*a*, a hoist motion command input 305*b*, and a swing motion command input 305*c*. Each of the crowd motion command input 305*a*, hoist motion command input 305*b*, and swing motion command input 305*c* may be referred to generically as a dipper motion command input device 305 or collectively as the dipper motion command input devices 305. Each of the dipper motion command input devices 305 is a human-machine interface (HMI) device that allows an operator to input a motion command to ultimately maneuver a position of the dipper 34. For example, each of the dipper motion command input devices 305 may include a human-manipulatable control element, such as a joystick or lever, that generates an output signal provided to the controller 200 indicative of the requested movement of the control element. The electronic processor 250 of the controller 200 receives the output signals from the dipper motion command input devices 305 and translates the signals to corresponding motion commands for the dipper drives 310. The corresponding motion commands may be in the form of a speed command, torque command, or another form.

The dipper drives 310 include the crowd drive 215, the hoist drive 220, and the swing drive 225 that are also illustrated in FIG. 3A. Each of the crowd drive 215, the hoist drive 220, and the swing drive 225 may be referred to generically as a dipper drive 310 or collectively as the dipper drives 310. Each of the dipper drives 310 may include a drive controller and motor or other actuator to control a respective motion of the dipper. More specifically, and with reference to FIG. 2, the crowd drive 215 controls the dipper 34 to crowd in and out by extending and retracting the handle 30, the hoist drive 220 controls the dipper 34 to hoist up and down by winding the hoist rope 42 up and down, and the swing drive 225 controls the dipper to swing left and right by rotating the base 22 relative to the tracks 80 about the axis 84. As noted, the motion commands from the controller 200 may be in the form of a speed command or torque command. As an example, in response to a speed command to the crowd drive 215, which may include both a magnitude and direction component, the crowd drive 215 controls the dipper 34 to crowd at the requested speed in the requested direction by: (1) increasing the torque to a motor of the crowd drive 215 until the requested speed is reached, (2) decreasing the speed until the requested speed is reached by reducing the torque to the motor, controlling the motor to regeneratively brake, or driving the motor in reverse, and (3) maintaining the current torque to the motor when the speed is at the requested speed. As another example, in response to a torque command to the swing drive 225, which may include both a magnitude and direction component, the swing drive 225 controls a motor of the swing drive 225 with torque at the requested magnitude and direction. In some embodiments, the crowd drive 215 and hoist drive 220 receive speed commands from the controller 200, and the swing drive 225 receives torque commands.

In some embodiments, the dipper drives 310 implement closed loop feedback to control the respective motions of the dipper 34 according to the motion commands received from the controller 200. The feedback (e.g., sensed speed or torque) may be provided to the dipper drives 310 from the sensors 240, directly or via the controller 200.

The dipper position sensors 315 include a crowd sensor 315*a*, a hoist sensor 315*b*, and a swing sensor 315*c*. The dipper position sensors 315 form a portion of the sensors 240 (see FIG. 3A) and include a crowd sensor 315*a*, a hoist sensor 315*b*, and a swing sensor 315*c*. Each of the crowd sensor 315*a*, hoist sensor 315*b*, and swing sensor 315*c* may be referred to generically as a dipper position sensor 315 or collectively as the dipper position sensors 315. Each of the dipper position sensors 315 senses a position of the dipper in terms of a respective dipper motion. More specifically, and with reference to FIG. 2, the crowd sensor 315*a* senses a crowd position, which is the extent to which the dipper 34 is crowded (e.g., between a minimum and maximum extension amount), the hoist sensor 315*b* senses a hoist position, which is the extent to which the dipper 34 is hoisted (e.g., between a minimum and maximum hoist amount), and the swing sensor 315 senses a swing position, which is the rotational position of the dipper 34 about the axis 84 (e.g., between 0 and 360 degrees). In some embodiments, the dipper position sensors 315 also indicate a speed, acceleration, or both speed and acceleration of the dipper 34 for the respective crowd, hoist, and swing motions in addition to the position data. In some embodiments, each of the dipper position sensors 315 includes a resolver configured to indicate a rotational position of an associated dipper drive 310 (e.g., the crowd sensor 315*a* includes a resolver to indicate the rotational position of a crowd motor of the crowd drive 215). In some embodiments, the dipper position sensors 315 are non-contact sensors, such as Hall sensors or optical sensors, that sense the rotational position of an associated dipper drive 310. In some embodiments, the controller 200 is configured to infer speed of each of the dipper drives 310 by calculating an amount of rotation of each of the dipper drives 310 over a period of time, using a timer circuit and the changing position data provided by the dipper position sensors 315.

As also illustrated in FIG. 3B, the memory 255 further includes model data 325, limit functions 330, a crowd limit 335, a hoist limit 340, and a swing limit 345. As explained in further detail below, the model data 325 may include a virtual model of the dipper 34, a virtual model of the tracks 80, a coordinate system for the shovel 10, and position information for the shovel 10 within the coordinate system. Additionally, the limit functions 330 may define one or more virtual fields for the dipper 34. As also explained in further detail below, the crowd limit 335, hoist limit 340, and swing limit 345 may limit a motion command provided by the controller 200 to the dipper drives 310 (e.g., to a level lower than requested by an operator).

In addition to virtual models of the dipper 34 and tracks 80, the model data 325 may also include dimensional data associated with the dipper 34, tracks 80, and any other components of the rope shovel 10. For example, the model data 325 may include dimensional data associated with the base 22. Likewise the model data 325 may include dimensional data associated with a support structure of the dipper 34, or dipper support 350 (see FIG. 4), which is a combination of the rope shovel components that support movement and positioning of the dipper 34 (e.g., the boom 26, handle 30, etc.). The dimensional data for the various components of the rope shovel 10 may be, for example, a series of dimensions (e.g., lengths, widths, heights), points, and/or other definitions of the boundaries of the rope shovel components. For example, dimensional data associated with the dipper 34 may include information such as lengths of dipper edges, lengths of dipper cross-sections, distances between respective sides of and the center of dipper 34, and the like. As another example, dimensional data associated with the dipper support 350 may include information such as a length of the boom 26, a length of the handle 30, a length of the rope 42, size of the boom sheave 54, and the like. As another example, dimensional data associate with the tracks 80 may include track width, track height, track curvature, and the like.

The controller 200 may also be referred to as a control system, such as a collision prevention and mitigation control system (e.g., when implementing the method 500) or a virtual track modeling system (e.g., when implementing the method 800 described below with respect to FIG. 8). In some embodiments, the above-described controller 200, which includes, among other things, the electronic processor 250 and memory 255, is implemented as one or more components of an aftermarket control system. In such embodiments, the aftermarket control system is configured to be installed in an existing mining machine, such as the rope shovel 10, to provide additional control to the mining machine to which it is installed. When the aftermarket control system is installed in the rope shovel 10, the controller 200 is coupled to and configured to control operation of the indicators 205, the user-interface 210, the tracks drive 227, the database 230, the power supply 235, the one or more sensor(s) 240, the dipper motion command input devices 305, dipper drives 310, and dipper position sensors 315. That is, when the aftermarket control system is installed in the rope shovel 10, the controller 200 included in the aftermarket control system is operable to control operation of any of the above-described components of the rope shovel 10. In some embodiments, one or more of above-described components of the rope shovel 10 are included in the aftermarket control system. For example, the database 230, the tracks drive 227, the one or more sensors 240, and/or the dipper drive 310 may be included as components of the aftermarket control system.

Figure 4:
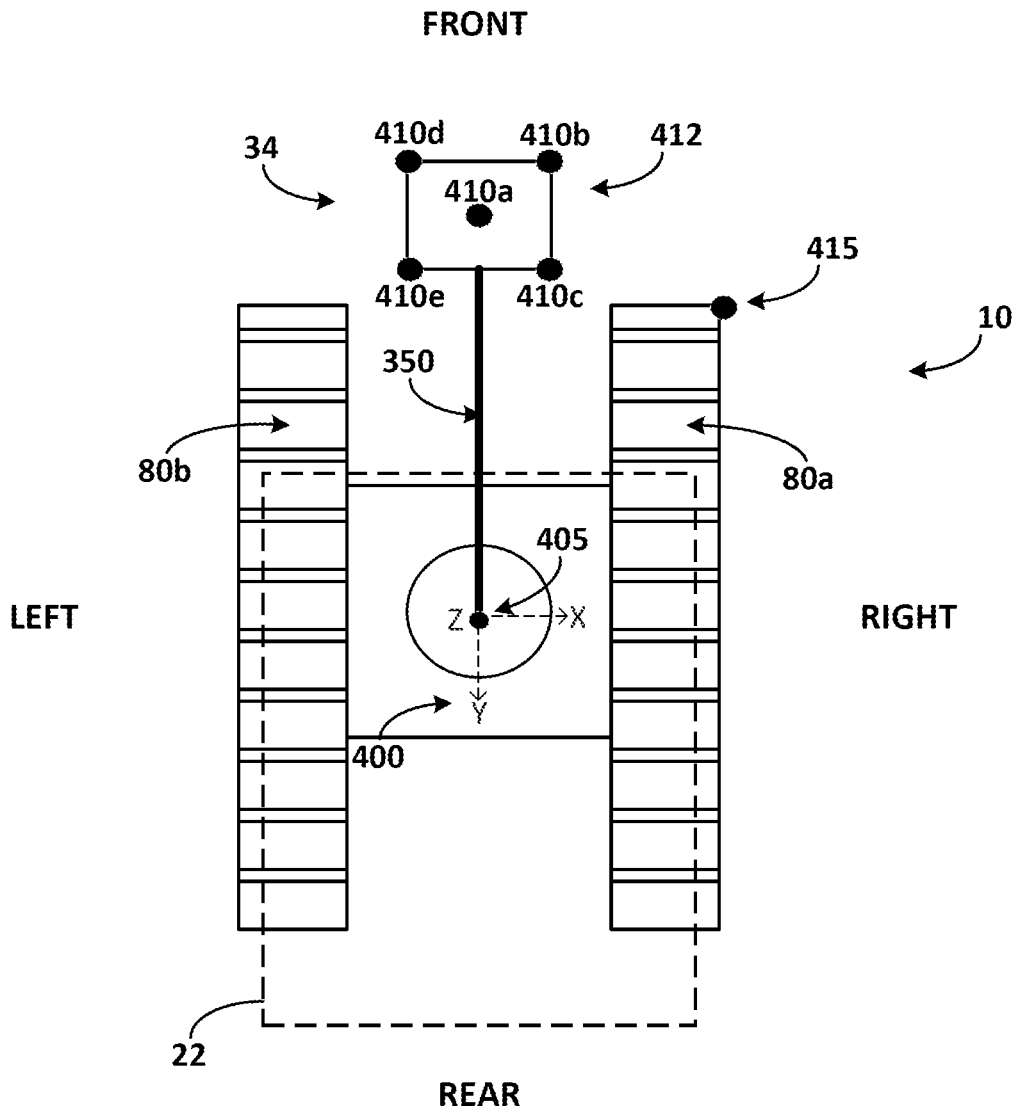
FIG. 4 is a top-down schematic view for the mining machine of FIG. 1.

FIG. 4 illustrates a top-down schematic view of the rope shovel 10. As shown in FIG. 4, a local coordinate system 400 for the rope shovel 10 may be defined with respect to a point on or near the rope shovel 10. That is, a point on or near the rope shovel 10 may be used as a reference point, or origin, of the rope shovel's local coordinate system 400. In the illustrated embodiment, an origin 405 of the rope shovel's local coordinate system 400 is defined as a center point of the of the rope shovel tracks 80, hereinafter referred to as "track center 405." In other embodiments, other points on or near the rope shovel 10 may be defined as the origin of the local coordinate system 400. In addition, the local coordinate system 400 of the rope shovel 10 is illustrated and described herein as a cartesian coordinate system including an x-axis, a y-axis, and a z-axis. Therefore, a position, or point, within the local coordinate system 400 includes an x-component, a y-component, and a z-component. With respect to FIG. 4, the x-component of a point in the local coordinate system 400 indicates how far "right" or "left" the point is relative to the track center 405. Similarly, the y-component of a point represents how far "frontward" or "rearward" the point is relative to the track center 405. Likewise, the z-component of a point represents how far "above (out of page)" or "below (into page)" the point is relative to the track center 405. Although illustrated and described as a cartesian coordinate system, the local coordinate system 400 may additionally or alternatively be defined as a cylindrical coordinate system, spherical coordinate system, or any other coordinate system that is desired.

The electronic processor 250 may be configured to determine the position, or (x, y, z) coordinates, of a point on the rope shovel 10 relative to the track center 405, based on a combination of one or more sensor readings and/or the dimensional data stored in memory 255. The sensor readings used to determine the coordinates of a point on the rope shovel 10 may include, but are not limited to, readings generated by the dipper position sensors 315. The dimensional data used to determine the coordinates of a point on the rope shovel 10 may include, but is not limited to, dimensional data associated with the base 22, dipper 34, tracks 80, and dipper support 350.

As an example, positions of one or more of the reference points associated with the dipper 34, or dipper reference points 410, shown in FIG. 4 may be determined relative to the track center 405. The dipper reference points 410 include, but are not limited to, a dipper center 410*a*, a front right dipper vertex 410*b*, a rear right dipper vertex 410*c*, a front left dipper vertex 410*d*, and a rear left dipper vertex 410*e*. Although FIG. 4 is a two-dimensional schematic drawing, it can be assumed that the dipper reference points 410*a*-410*e* are located on a bottom surface of the dipper 34. That is, the dipper center 410*a* is the center of a bottom surface of the dipper. Similarly, the dipper vertices 410*b*-410*e* are vertices that join the bottom surface of the dipper to the side surfaces of the dipper 34. The dipper reference points 410*a*-410*e* collectively form a virtual dipper model 412, which is a virtual model of the dipper 34 (stored as part of the model data 325 of FIG. 3B). Although the virtual dipper model 412 is two-dimensional in the illustration of FIG. 4, in some embodiments, the virtual dipper model 412 is three-dimensional and defined by additional reference points. For example, in some embodiments, the virtual dipper model 412 is defined in a computer aided design (CAD) program with sufficient resolution to appear, when plotted, as the dipper 34 in FIG. 1. In some embodiments, a lower resolution model is used as the virtual dipper model 412.

The electronic processor 250 may be configured to determine respective sets of (x, y, z) coordinates for each dipper reference point making up the virtual dipper model 412 (e.g., the reference points 410*a*-410*e*) based on a combination of the dimensional data stored in memory 255 and swing, crowd, and hoist measurements taken by the dipper position sensors 315. When the dipper 34 is moved to a new position, the electronic processor 250 is operable to determine a new respective set of (x, y, z) coordinates for each one of the dipper reference points 410*a*-410*e* based on a combination of the dimensional data and updated values of the swing, crowd, and hoist measurements taken by the dipper position sensors 315. Therefore, the electronic processor 250 may be configured to determine the position of a dipper reference point 410 relative to the track center 405 regardless of the extent to which the dipper 34 is hoisted, crowded, or rotated.

Although described with respect to the dipper reference points 410*a*-410*e*, the electronic processor 250 may also be configured to determine a set of (x, y, z) coordinates, or a position relative to the track center 405, for any point on or near a component of the rope shovel 10. For example, the electronic processor 250 may be configured to determine the (x, y, z) coordinates of a point on a surface of the boom 26 or a point on the surface of the handle 30. In addition, as will be described in more detail below, the electronic processor 250 may be configured to derive, or determine, (x, y, z) coordinates of a point on a surface of the tracks 80 based on the (x, y, z) coordinates of a dipper reference point 410. With respect to FIG. 4, (x, y, z) coordinates of a point 415 located on the top surface of the front right vertex of track 80*a* may be determined by moving the dipper 34 such that a dipper reference point 410 is aligned with and/or contacts the point 415 on track 80*a*. For example, if it is assumed that the dipper center 410*a* is aligned with and/or contacting the point 415, the electronic processor 250 may be configured to determine the (x, y, z) coordinates of the point 415 are equivalent to the (x, y, z) coordinates of the dipper center 410*a* while the dipper center 410*a* is aligned with and/or contacts the point 415.

In some embodiments, the data defining the coordinate system 400 and position information for the shovel 10 on that coordinate system 400, including the current positions for the various reference points making of the virtual model of the dipper 34 and the virtual model of the tracks 80, including the swing position, crowd position, and hoist position of the dipper 34, and including the position information for the dipper support 350, may be stored as part of the model data 325.

Figure 5:
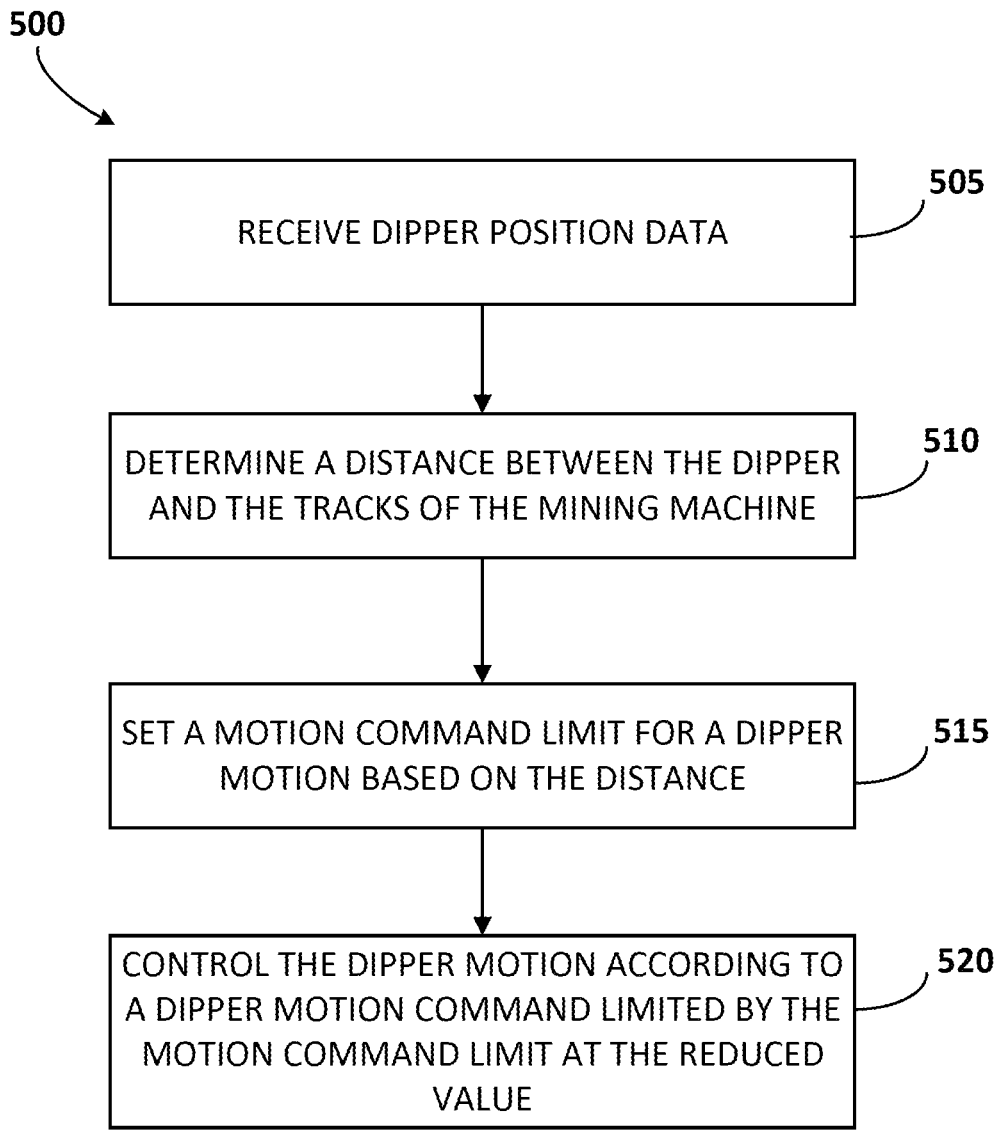
FIG. 5 illustrates a flow chart for preventing or mitigating collisions between a dipper and tracks of a mining machine, according to some embodiments.

Preventing and Mitigating Collisions Between a Dipper and Tracks of a Mining Machine FIG. 5 illustrates a method 500 for preventing and mitigating collisions between a dipper and tracks of a mining machine includes blocks 505, 515, and 520. The method 500 is described with respect to the rope shovel 10, dipper 34, tracks 80, and the electronic processor 250; however, in some embodiments, the method 500 is implemented with respect to other rope shovels or mining machines having tracks and dippers with crowd, hoist, and swing motions. Additionally, although actions within the method 500 are described as being carried out by the electronic processor 250, the actions may also be described, for example, as being carried out by the electronic controller 200 having the electronic processor 250. Furthermore, in some embodiments, the controller 200 and electronic processor 250 implementing the method 500 are included in the rope shovel 10 as original equipment (e.g., installed at the time of manufacture of the rope shovel 10) and, in some embodiments, one or more of the controller 200, the electronic processor 250, and the software included thereon are included in an aftermarket control system installed in the rope shovel 10 to implement the method 500.

In block 505, the electronic processor 250 receives dipper position data indicative of a position of the dipper 34. The dipper position data is provided to the electronic processor 250 by one or more of the dipper position sensors 315. For example, the dipper position data may include an output from one or more of the crowd sensor 315*a*, the hoist sensor 315*b*, and the swing sensor 315*c*. The output of the crowd sensor 315*a* indicates the crowd position of the dipper 34, the hoist sensor 315*b* indicates the hoist position of the dipper 34, and the swing sensor 315 indicates the swing position of the dipper 34.

Returning to FIG. 5, in block 515, the electronic processor 250 sets a motion command limit for a dipper motion based on a distance between the dipper 34 and the tracks 80 of the mining machine 10 inferred from the dipper position data, where the dipper motion is selected from a group of a swing motion, a crowd motion, and a hoist motion. In some embodiments, to set the motion command limit based on the distance inferred from the dipper position data, the electronic processor 250 may determine a limit value using one or more of the limit functions 330 stored in the memory 255 (see FIG. 3B). For example, in some embodiments, the limit functions 330 include distance-based functions that define the motion command limit based on the distance between the dipper 34 and the tracks 80 such that they use the distance between the dipper 34 and the tracks 80 as an input and provide a limit value as an output. As another example, in some embodiments, the limit functions 330 include position-based functions that define the motion command limit based on the dipper position data, where such a position-based function is defined based on relationships between (i) potential dipper positions and (ii) associated distances between the potential dipper positions and the tracks 80 of the mining machine 10. In other words, the distance between each potential position of the dipper 34 and the tracks 80 may be determined in advance (e.g., in a setup stage); then, at a later stage during operation, when the dipper 34 is determined to be at a particular position, the distance between the dipper 34 and the tracks 80 is presumed based on the prior determined relationship. The position-based function may be generated based on these underlying relationships between the position of the dipper 34 and the associated distance between the dipper 34 and the tracks 80 that results. Accordingly, the position-based functions use the current position of the dipper 34 indicated by the dipper position data as an input (and as a proxy for the distance between the dipper 34 and the tracks 80) and provide a limit value as an output. Then, with continued reference to FIG. 3B, after determining the limit value, the electronic processor 250 may store the limit value in the memory 255 as the motion command limit (e.g., as one or more of the crowd limit 335, hoist limit 340, and swing limit 345).

As noted, the distance between the dipper 34 and the tracks 80 may be used directly as an input into the limit function(s) or may be used indirectly in advance to generate the limit function(s) such that the current position of the dipper 34 may be used as an input into the limit function(s). In some embodiments, the electronic processor 250 determines a distance between the dipper 34 and the tracks 80 of the mining machine based on the dipper position data. In some embodiments, the distance may be a shortest distance between the dipper 34 and the tracks 80 (e.g., the distance between the two nearest points of the dipper 34 and the tracks 80). The distance may be a length measurement across three dimensions of space (e.g., x, y, and z dimensions) and, accordingly, may be referred to as a three-dimensional distance.

Figure 6:
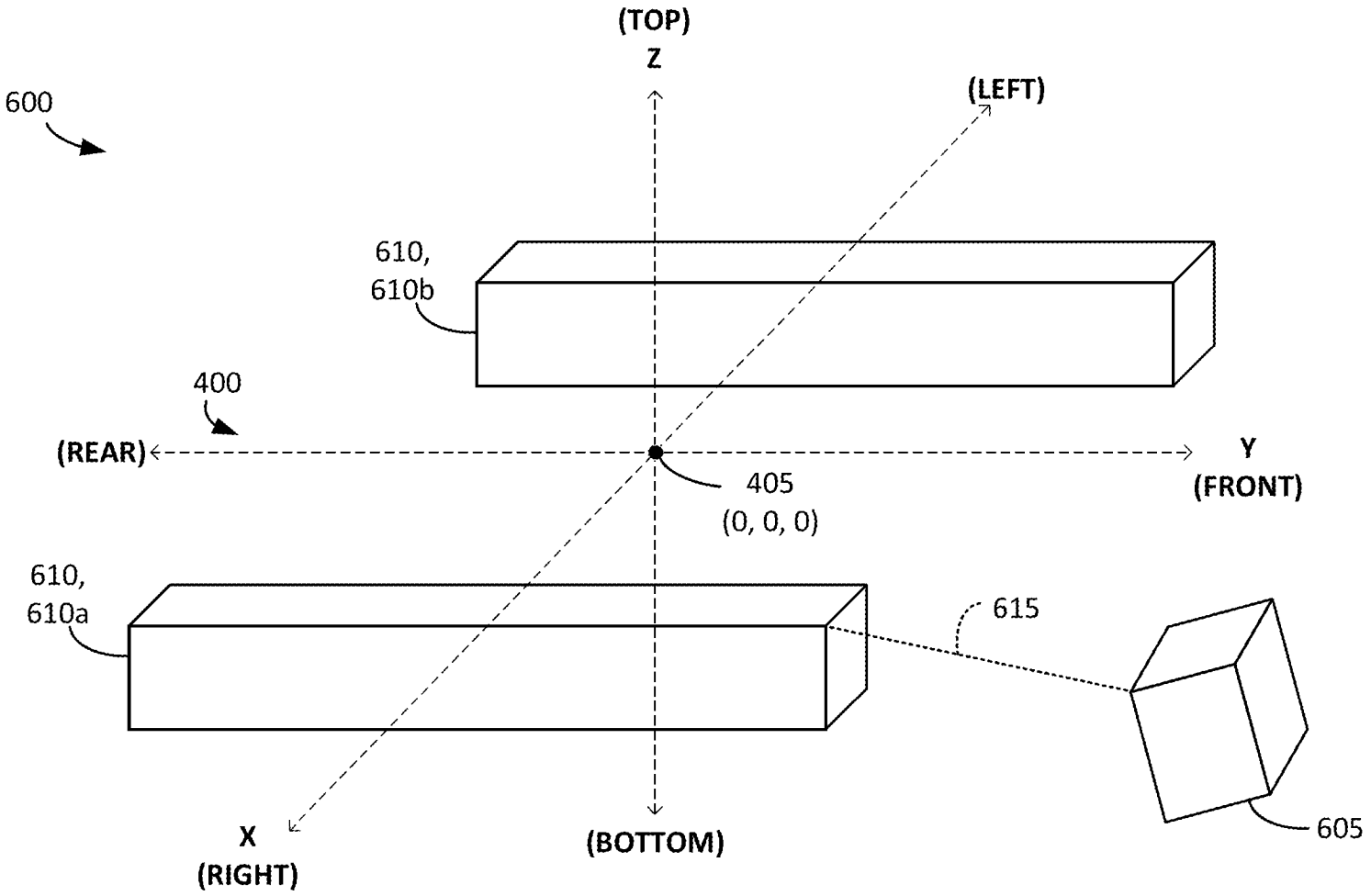
FIG. 6 illustrates a virtual model for the mining machine of FIG. 1, according to some embodiments.

FIG. 6 depicts a virtual model 600 of the rope shovel 10, on the same local coordinate system 400 illustrated in FIG. 4, to illustrate an example technique for determining the distance between the dipper 34 and the tracks 80. In this example, to determine the distance, the electronic processor 250 determines a position of the dipper 34, determines a position of the tracks 80, and then determines a shortest distance between the dipper 34 and the tracks 80 based on the determined positions of each. In some embodiments, to determine the position of the dipper 34, the electronic processor 250 determines a position of a three-dimensional virtual dipper model (a virtual model of the dipper 34) in a three-dimensional coordinate system for the rope shovel 10 based on the dipper position data. More particularly, the electronic processor 250 may translate the dipper position data (received in the preceding block 505) to calculate the position of the dipper 34 on the local coordinate system 400 for the rope shovel 10. For example, the dipper position data may indicate the extent that the dipper 34 is hoisted, crowded, and rotated about the swing axis 84, and the electronic processor 250 may extrapolate the position of the dipper 34 in the local coordinate system 400 using this information in combination with model data 325 (e.g., dimensional data associated with the dipper support 350). Thus, as shown in FIG. 6, the electronic processor 250 is configured to map, onto the local coordinate system 400, a virtual model 605 of the dipper 34 at the extrapolated dipper position.

Like the virtual dipper model 412 of FIG. 4, the virtual model 605 of the dipper 34 may be, for example, a series of dimensions, points, or other definition of the outer boundaries of the dipper 34. The virtual model 605 of the dipper 34 may be obtained from a computer-aided drawing (CAD) file for the dipper 34. In some embodiments, the model data 325, including the virtual model 605 of the dipper 34 and dimensional data of the dipper support 350, may be received and stored in the memory 255 in a setup stage. Although separately labeled in FIGS. 4 and 6, respectively, the virtual dipper model 412 and the virtual model 605 may be the same virtual model.

Additionally, in some embodiments, to determine the position of the tracks 80, the electronic processor 250 determines a position of a three-dimensional virtual tracks model (a virtual model of the tracks 80) in the three-dimensional coordinate system (e.g., the local coordinate system 400). As shown in FIG. 6, the electronic processor 250 is configured to map, onto the local coordinate system 400, a virtual model of the tracks 80 including a virtual tracks model 610*a* for tracks 80*a* and virtual tracks model 610*b* for track 80*b*. The virtual tracks models 610*a* and 610*b* may be collectively referred to as the virtual tracks model 610, although the virtual tracks model 610 may also generically refer to just one of the virtual tracks models 610*a* or 610*b*. The virtual tracks model 610 and its position on the local coordinate system 400 may be received and stored in the memory 255 as part of the model data 325 in a setup stage. In some embodiments, the virtual tracks model 610 is, for example, a series of dimensions, points, or other definition of the outer boundaries of the tracks 80 (e.g., of one or both of the tracks 80*a* and 80*b*), defined with respect to an origin point of the three-dimensional coordinate system (e.g., origin 405 of the local coordinate system 400). The virtual model of the tracks 80 (e.g., virtual tracks model 61), and the position of the tracks 80 in the three-dimensional coordinate system, may be obtained from a computer-aided drawing (CAD) file for the tracks 80 or during a calibration process, such as described in further detail below (see, e.g., FIG. 8). Accordingly, to determine the position of a three-dimensional virtual tracks model (e.g., the virtual tracks model 610) in the three-dimensional coordinate system (e.g., the local coordinate system 400), the electronic processor 250 may access such information in the model data 325 of the memory 255.

With the positions of the dipper 34 and tracks 80 determined, the electronic processor 250 may then determine the distance between the dipper 34 and the tracks 80. For example, in some embodiments, the electronic processor 250 may determine a shortest distance 615 between the virtual dipper model 605 and the virtual tracks model 610 on the three-dimensional coordinate system 400, where the shortest distance represents the distance between the dipper 34 and the tracks 80 used in the method 500. For example, as described above, the electronic processor 250 is configured to determine the position of three-dimensional models 605 and 610 of the dipper 34 and the tracks 80, respectively, on the coordinate system 400. The electronic processor 250 may then execute a nearest neighbor algorithm, or similar known algorithm, to determine the shortest distance 615 between the three-dimensional models 605 and 610 in the coordinate system 400. As the distance is determined for two, three-dimensional models 605 and 610 in a three-dimensional coordinate system 400, the distance is a length measurement across three dimensions (e.g., x, y, and z dimensions). This distance measurement across three dimensions (also referred to as a three-dimensional distance) contrasts with, for example, a length measurement in a two-dimensional coordinate system (e.g., that considers just crowd and hoist motions) or between two points in a one-dimensional coordinate system (e.g., that considers just crowd motion or just hoist motion).

In some embodiments, other techniques are implemented by the electronic processor 250 to determine the distance between the dipper 34 and the tracks 80.

In some embodiments, the limit functions 330 include a slow region function and a stop region function for each of the crowd, hoist, and swing motions. In such embodiments, the electronic processor 250 may select the stop region function for a dipper motion in response to determining that the distance 615 is below a stop region threshold for that dipper motion, and may select the slow region function for a dipper function in response to determining that the distance 615 is above the stop region threshold, but below the slow region threshold for that dipper motion. In response to determining that the distance 615 is above the slow region threshold, the electronic processor 250 may return the default limit value for the motion command limit. In some embodiments, the slow region thresholds, stop region thresholds, and default limit values for each of the hoist, crowd, and swing motions are stored in the memory 255 (e.g., as part of the limit function 330).

Figure 7A:
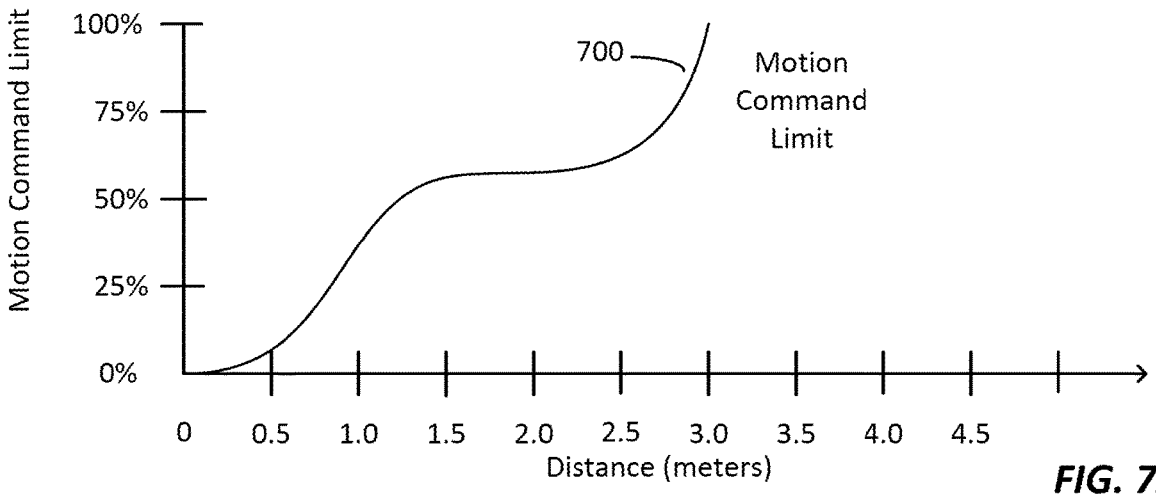
FIGS. 7A-7C illustrate example limit functions for a dipper motion, according to some embodiments.
Figure 7B:
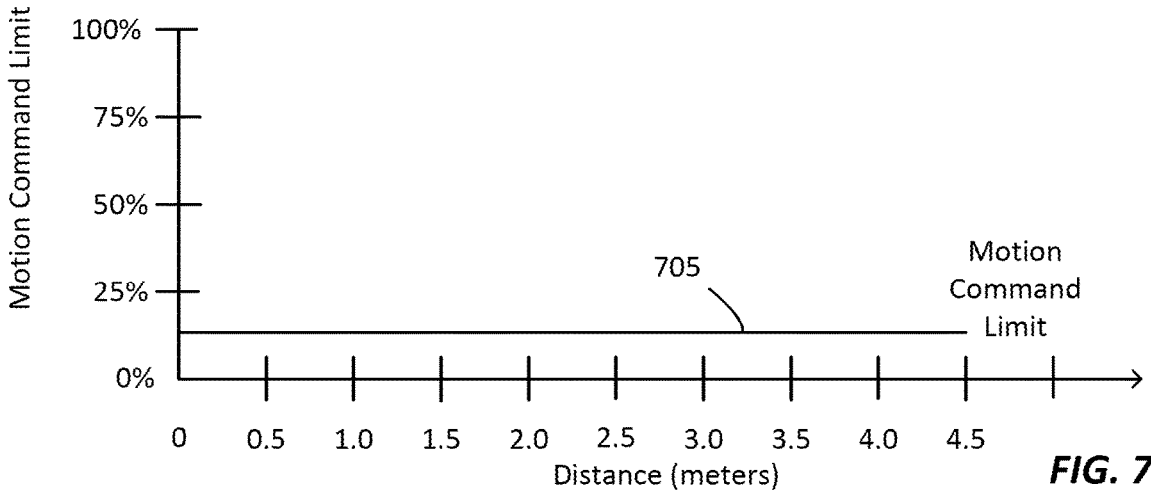
Figure 7C:
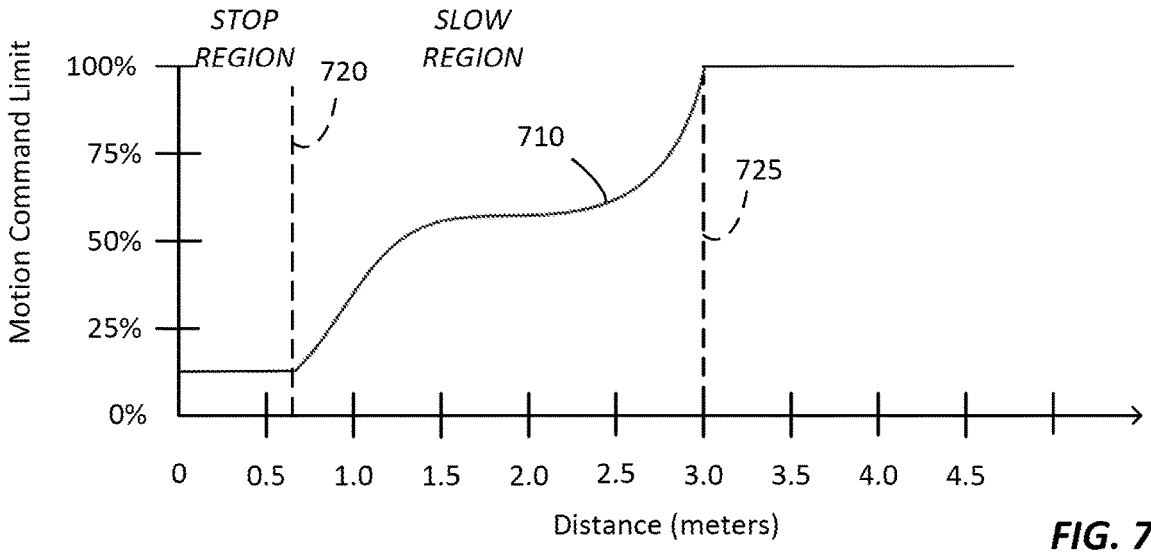

FIGS. 7A-C illustrate an example of limit functions 330 for a dipper motion. More particularly, FIG. 7A illustrates a slow region plot 700 of an example of a slow region function for the dipper motion, FIG. 7B illustrates a stop region plot 705 of an example of a stop region function for the dipper motion, and FIG. 7C illustrates a motion limit plot of a motion limit function resulting from a combination of the slow and stop region functions. The particular motion limit functions, thresholds, motion command limits, and distance values are merely examples. In other embodiments, one or more different functions, thresholds, limits, and values are employed in the method 500.

In some embodiments, the slow region function (see plot 700 in FIG. 7A) includes a function that receives a distance value as input and outputs a motion command limit, where the function defines an s-shaped curve. For example, in some embodiments, the slow region function includes an inverse tangent function, offset by a positive integer to align the bottom portion of the s-shaped curve with motion command limit of zero. In some embodiments of the slow region function (not shown in FIG. 7A), the slow region is further divided into an s-shaped curve portion for lower values of the distance 615 and a linear portion for larger values of the distance 615. In some embodiments, rather than an s-shaped curve, the slow region function is linear or is a curve of another shape (e.g., a parabolic function).

In the illustrated embodiment of FIG. 7B, the stop region function (see plot 705) provides a set value of about 10% regardless of the distance 615. In some embodiments, the particular set value is a different value than illustrated, such as 0%, 2%, 5%, or 15%. In some embodiments, the stop region function of FIG. 7B provides a set value that is negative (e.g., −5% or −10%) to provide reverse torque to the dipper 34 (i.e., in a direction that pushes the dipper 34 away from the tracks 80).

FIG. 7C illustrates the motion limit function (see plot 710) resulting from a combination of the slow region function and the stop region function. As illustrated, the stop region function applies for "x" values (values of the distance 615) that are less than a stop region threshold 720 and the slow region function applies for "x" values (values of the distance 615) that are between the stop region threshold 720 and a slow region threshold 725. When the distance value 615 is greater than the slow region threshold 725, the motion command limit is a default value, such as 100%. As will become more apparent below, when at 100%, the motion command limit does not limit the dipper motion associated with the motion command limit.

In some embodiments, the limit functions of FIGS. 7A-C are applicable for one or more of the hoist motion, the crowd motion, and the swing motion. In some embodiments, the particular thresholds, slopes of the limit curve in the slow region, and limit in the stop region may vary depending on the particular motion. For example, in some embodiments, the limit value for the stop region for the hoist motion, crowd motion, or both hoist and crowd motion is a non-zero value (e.g., 10%), whereas the limit value in the stop region for the swing motion may be set to zero (i.e., 0%). In some embodiments, the curve of the limit value for the slow region for one or more of the dipper motions has a different shape or is linear. In some embodiments, the swing motion has a stop region function, but does not have a slow region function. The swing motion may use a different limit function because, in some embodiments, the swing motor is not powerful enough in most cases to stop momentum of the dipper 34 swinging towards the tracks 80. However, when the operator of the rope shovel 10 is maneuvering the dipper 34 near the tracks 80 (e.g., to clear a boulder near the tracks), the limit value (e.g., of zero) for the swing motion in the stop region will block a swing motion requested by the operator that may otherwise cause the dipper 34 to collide with the tracks 80. Additionally, when an operator inadvertently is swinging the dipper 34 at an increased speed when the dipper enters the stop region, the limit value for the swing motion in the stop region (e.g., zero), may remove the torque from the swing motion so as to stop the swing torque moments before impact and avoid driving the swing motion even after the collision of the dipper 34 with the tracks 80. Thus, although the collision may not be avoided, the resulting damage may be mitigated by blocking further swing torque when in the stop region.

In some embodiments, the limit functions 330 include one or more equations (e.g., defining the function illustrated in FIG. 7C) that are computed during operation by the electronic processor 250 to generate a limit value as an output. In some embodiments, the limit functions 330 include one or more lookup tables that map potential inputs (e.g., shown on the x-axis of the function in FIG. 7C) to pre-calculated outputs (e.g., shown on the y-axis of the function in FIG. 7C). In some embodiments, the limit functions 330 include a combination of one or more equations and one or more lookup tables.

In block 520, the electronic processor 250 controls the dipper motion according to a dipper motion command limited by the motion command limit. For example, in response to operator operation of one of the motion command input devices 305 (see FIG. 3B), the electronic processor 250 receives a dipper motion command input (e.g., a hoist, crowd, or swing command input). The electronic processor 250 then determines the lower of (a) the motion command limit and (b) the dipper motion command input. The electronic processor 250 then provides a dipper motion command to the dipper drives 310 associated with the motion command limit (e.g., a hoist drive 220), where the dipper motion command is the lower of (a) the motion command limit and (b) the dipper motion command input. The dipper drive 310 that receives the motion command then controls the dipper motion of the dipper 34 according to the command. For example, when the electronic processor 250 provides a crowd motion command to the crowd drive 215 to crowd in at 20% speed, the crowd drive 215 controls the dipper 34 to crowd in at 20% speed.

In some embodiments of the method 500, in block 515, rather than setting a motion command limit for one dipper motion, the electronic processor 250 sets a motion command limit for two or three dipper motions based on the distance between the dipper 34 and the tracks 80, where the dipper motions are selected from the group of the swing motion, the crowd motion, and the hoist motion. In these embodiments, a similar process used to set the motion command limit for one dipper motion is used to set the dipper motion for the other dipper motions. For example, to set the motion command limits for the dipper motions, the electronic processor 250 may determine a limit value for each dipper motion using the distance between the dipper 34 and the tracks 80 (directly or indirectly) with one or more of the limit functions 330 stored in the memory 255 (see FIG. 3B). The limit functions 330 may include a custom function (or functions) for each motion (e.g., a crowd limit function for the crowd motion, a hoist limit function for the hoist motion, and a swing limit function for the swing motion). Then, with continued reference to FIG. 3B, the electronic processor 250 may store the respective limit values in the memory 255 as the crowd limit 335, hoist limit 340, and swing limit 345. Accordingly, in these embodiments, in block 520, the electronic processor 250 is configured to control the dipper motion of the dipper 34 according to dipper motion commands (e.g., crowd, hoist, and swing commands) limited by each of the crowd limit, hoist limit, and swing limit.

Stated another way, in some embodiments of the method 500, the dipper motion is the crowd motion and motion command limit is a crowd motion command limit, and, in block 515, the electronic processor 250 further sets one or both of: (a) a hoist motion command limit for the hoist motion based on the distance and (b) a swing motion command limit for the swing motion based on the distance. Then, in block 520, the electronic processor 250 is configured to control the dipper motion of the dipper 34 according to dipper motion commands (e.g., crowd, hoist, and swing commands) limited by each of the crowd motion command limit, hoist motion command limit, and swing motion command limit.

In some embodiments, after block 520, the electronic processor 250 loops back to block 505 such that the electronic processor 250 repeatedly executes the method 500. By repeatedly executing the method 500, the electronic processor 250 may account for changes over time in the position of the dipper 34 and in the dipper motion command received via the dipper motion command input device 305. Thus, in some embodiments, the electronic processor 250 repeatedly determines the distance between the dipper 34 and the tracks 80 over time as the dipper 34 moves and updates the motion command limit based on the distance 615 as the distance 615 is repeatedly determined.

Accordingly, in some embodiments, in a first pass through method 500, to set the motion command limit for the dipper motion based on the distance (in block 515), the electronic processor 250 reduces the motion command limit from an initial value to a reduced value according to a function that defines the motion command limit to be lower as the distance 615 is reduced (e.g., according to the function for plot 710 in FIG. 7C). Further, in a second pass through method 500 after the dipper 34 has moved further from the tracks 80, the electronic processor 250 receives updated dipper position data indicative of an updated position of the dipper (block 505); sets the motion command limit to an updated value based on an updated distance between the dipper 34 and the tracks 80 based on the updated dipper position data, where the updated distance is greater than the distance (from the first pass) and where the updated value is greater than the reduced value (block 515); and controls the dipper motion according to a further dipper motion command limited by the updated motion command limit (block 520).

To assist in illustrating the method 500, several example scenarios in accordance with the plot 710 of FIG. 7C are provided in Table I, below. Table I is described with respect to a dipper motion generally, but applies to one or more of the hoist motion, crowd motion, and swing motion of a mining machine, such as the rope shovel 10.

TABLE I

| Scenario | Distance | Motion Command Limit | Dipper Motion Command Input | Dipper Motion Command |
|---|---|---|---|---|
| (1) | 0.5 (m) | 10% | 75% | 10% |
| (2) | 0.5 (m) | 10% | 5% | 5% |

TABLE I-continued

| Scenario | Distance | Motion Command Limit | Dipper Motion Command Input | Dipper Motion Command |
|---|---|---|---|---|
| (3) | 1.5 (m) | 60% | 75% | 60% |
| (4) | 1.5 (m) | 60% | 40% | 40% |
| (5) | 4.0 (m) | 100% | 75% | 75% |

In scenario 1, the distance 615 between the tracks 80 and the dipper 34 is 0.5 meters (m), and a dipper motion command input of 75% is received by the electronic processor 250. Accordingly, with reference to FIG. 7C, the dipper 34 is determined to be in the stop region, and the motion command limit is set to 10% (e.g., in block 515). The electronic processor 250 then determines that the motion command limit (10%) is less than the dipper motion command input (75%), and, accordingly, sets the dipper motion command to the motion command limit 10%. The electronic processor 250 then provides the dipper motion command of 10% to the dipper drive 305 associated with the dipper motion command. As explained with reference to FIG. 3B above, the dipper motion command may be a speed command (e.g., for the crowd or hoist motion) or a torque command (e.g., for the swing motion).

In scenario 2, the distance 615 between the tracks 80 and the dipper 34 is 0.5 meters (m), and a dipper motion command input of 5% is received by the electronic processor 250. Accordingly, with reference to FIG. 7C, the dipper 34 is determined to be in the stop region, and the motion command limit is set to 10% (e.g., in block 515). The electronic processor 250 then determines that the dipper motion command input (5%) is less than the motion command limit of 10%, and, accordingly, sets the dipper motion command to the dipper motion command input. The electronic processor 250 then provides the dipper motion command of 5% to the dipper drive 305 associated with the dipper motion command.

In scenarios 3, 4, and 5 of Table I, the dipper motion command limit and dipper motion command are generated following a similar technique as explained with respect to scenarios 1 and 2 and, accordingly, are not explained in further detail.

As previously noted with respect to FIG. 3B, in some embodiments, the crowd drive 215 and hoist drive 220 receive speed commands from the electronic processor 250, whereas the swing drive 225 receives a torque command from the electronic processor 250. Accordingly, considering scenario 1 for the crowd drive 215 as an example, when the electronic processor 250 provides the dipper motion command of 10% to the crowd drive 215, the crowd drive 215 uses a closed loop feedback speed control to control the speed of the crowd drive 215 to be at 10%. Now, considering scenario 1 for the swing drive 225 as an example, when the electronic processor 250 provides the dipper motion command of 10% to the swing drive 225, the swing drive 225 uses a closed loop feedback torque control to control the torque being applied to the swing drive 225 to be at 10%. In some embodiments, to control the speed or torque of a drive, a controller of the dipper drive 310 may adjust a duty cycle of a pulse width modulated (PWM) signal used to control switching elements of the dipper drive 310 that provide power to a rotor or stator of a motor of the dipper drive 310. For example, to increase torque or speed, the duty cycle, which may be a value between 0 and 100%, is increased, whereas to decrease the torque or speed, the duty cycle may be reduced. Additionally, as previously noted, to reduce the speed of a dipper drive 310, the controller of the dipper drive 310 may implement regenerative braking (e.g., by selectively controlling switching elements of the dipper drive 310 to generated regenerative current) or may drive the dipper drive 310 in reverse (e.g., by selectively controlling switching elements of the dipper drive 310 to provide reverse torque).

In light of the above discussion, it should be apparent that, as the dipper 34 is controlled to be closer to the tracks 80, as a general rule, the motion commands are further limited. As a result, in some embodiments, when the dipper 34 is very close to the tracks 80, one or more of the dipper motions are restricted such that the dipper 34 moves slowly or not at all in response to motion command inputs from an operator. Additionally, in some embodiments, when the dipper 34 is controlled to crowd in (or hoist down) quickly by the operator towards the tracks 80, the electronic processor 250 will limit the crowd (or hoist) motion command more and more such that the dipper 34 is gradually slowed to prevent a collision with the tracks 80 or at least mitigate the impact of a collision with the tracks 80.

In some embodiments, the motion limits described with respect to the method 500 of FIG. 5 apply regardless of the direction of the particular dipper motion. For example, when the electronic processor 250 determines that the command motion limit for the crowd drive 215 is 10%, that 10% limit on the crowd motion is applied regardless of whether the dipper 34 is being commanded to crowd in or to crowd out. In some embodiments, particularly for the hoist and crowd motions, the motion limits apply in only one direction. For example, when the electronic processor 250 determines that the command motion limit for the crowd drive 215 is 10%, that 10% limit on the crowd motion is applied when the dipper 34 is being commanded to crowd in (towards the tracks 80), but the limit is not applied when the dipper 34 is being commanded to crowd out.

In effect, at least in some embodiments, the limit functions 330 of the rope shovel 10 define virtual three-dimensional fields around the dipper 34 for each of the swing, crowd, and hoist dipper motions. When one or more of these virtual fields of the dipper 34, which may be mapped onto the coordinate system 400 around the virtual dipper 605, overlaps the virtual tracks model 610, the one or more dipper motions associated with the one or more overlapping virtual fields is limited. These dipper motions are increasingly limited the closer that the dipper 34 is to the tracks 80. Accordingly, the increasing limitations imposed by the electronic processor 250 as the overlapping virtual fields of the dipper 34 get closer to the tracks 80 are perceived like the repelling forces of the ends of two magnets having the same pole. That is, as the same pole of two magnets approach one another, the repelling force of the magnetic fields increases. From the perspective of an operator of the shovel 10, the limit functions are smoothly applied in a natural and intuitive manner that does not inhibit productivity. Further, because, at least in some embodiments, the limit functions are applied independently to each of the dipper motions (hoist, crowd, and swing), limits are not placed on dipper motions unnecessarily. For example, if the dipper 34 is close enough to the tracks such that the virtual field for the crowd and hoist motions overlap the tracks 80, but the virtual field for the swing motion does not overlap the tracks 80, the operator is able to continue to control the dipper 34 to swing without limitation.

Modeling Tracks of a Mining Machine

As described above with respect to method 500, a virtual model of the tracks 80 used in the collision prevention and mitigation system may be obtained during a calibration process for modeling tracks of a mining machine. FIG. 8 illustrates a method 800 for modeling tracks of a mining machine and includes blocks 805, 810, 815, 820, and 825. The method 800 is described with respect to the rope shovel 10, dipper 34, tracks 80, and electronic processor 250; however, in some embodiments, the method 800 is implemented with respect to other rope shovels or other mining machines having tracks. Additionally, although actions within the method 800 are described as being carried out by the electronic processor 250, the actions may also be described, for example, as being carried out by the electronic controller 200 having the electronic processor 250. Furthermore, in some embodiments, the controller 200 and electronic processor 250 implementing the method 800 are included in the rope shovel 10 as original equipment (e.g., installed at the time of manufacture of the rope shovel 10) and, in some embodiments, one or more of the controller 200, the electronic processor 250, and the software included thereon are included in an aftermarket control system installed in the rope shovel 10 to implement the method 800.

In block 805, the electronic processor 250 moves the dipper 34 to a first position associated with the tracks 80 of the rope shovel 10. For example, using the dipper motion command input devices 305, a rope shovel operator may input a command for moving the dipper 34 to the first position associated with the tracks 80. The electronic processor 250 receives the operator input signals from the dipper motion command input devices 305 and translates the signals to corresponding motion commands for the dipper drives 310. In response to receiving the motion commands from the electronic processor 250, the dipper drives 310 control movement of the dipper 34 to the first position associated with the tracks 80.

Figure 9:
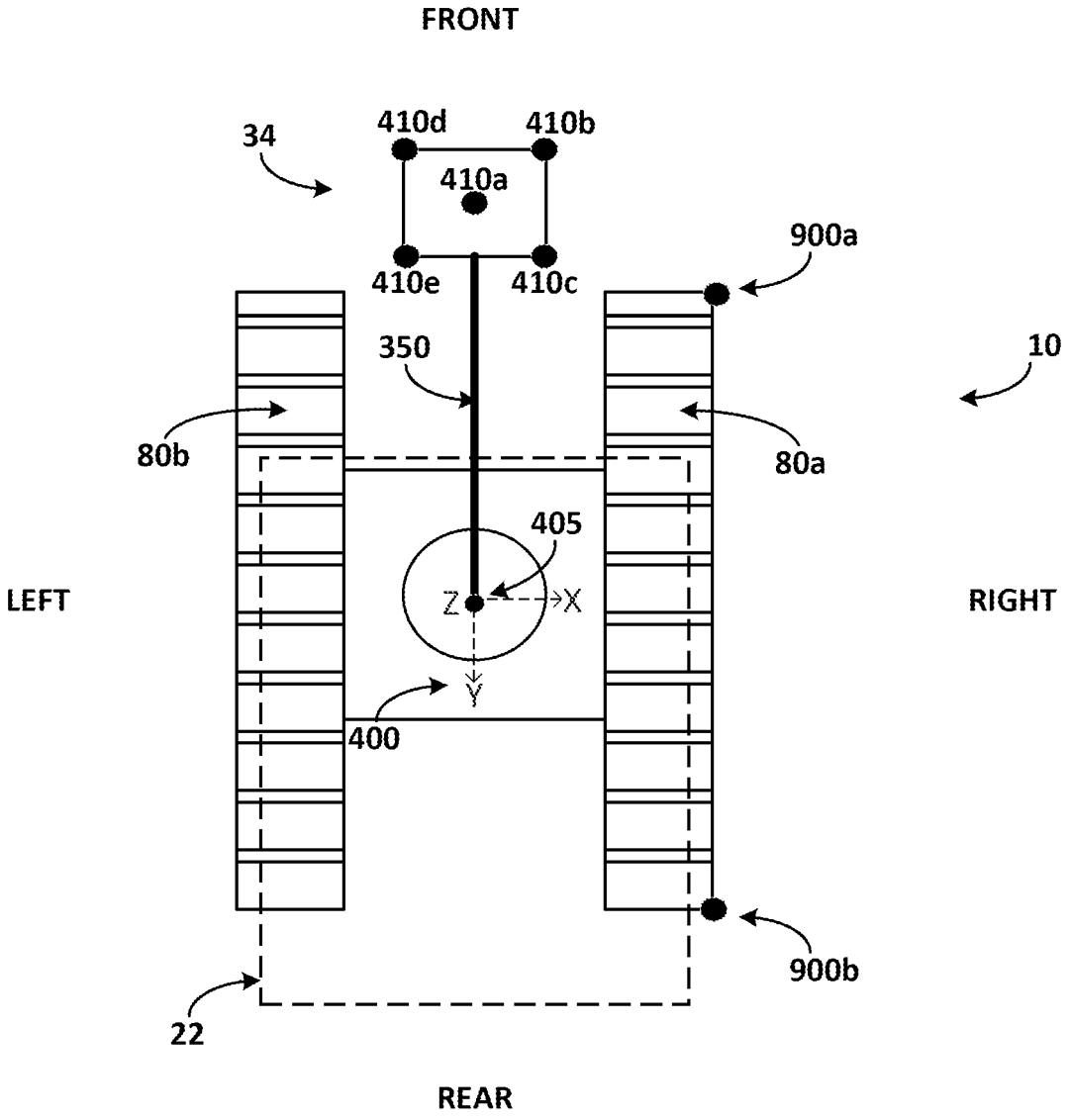
FIG. 9 illustrates a first position and a second position of tracks in a top-down schematic view for the mining machine of FIG. 1, according to some embodiments.
Figure 10B:
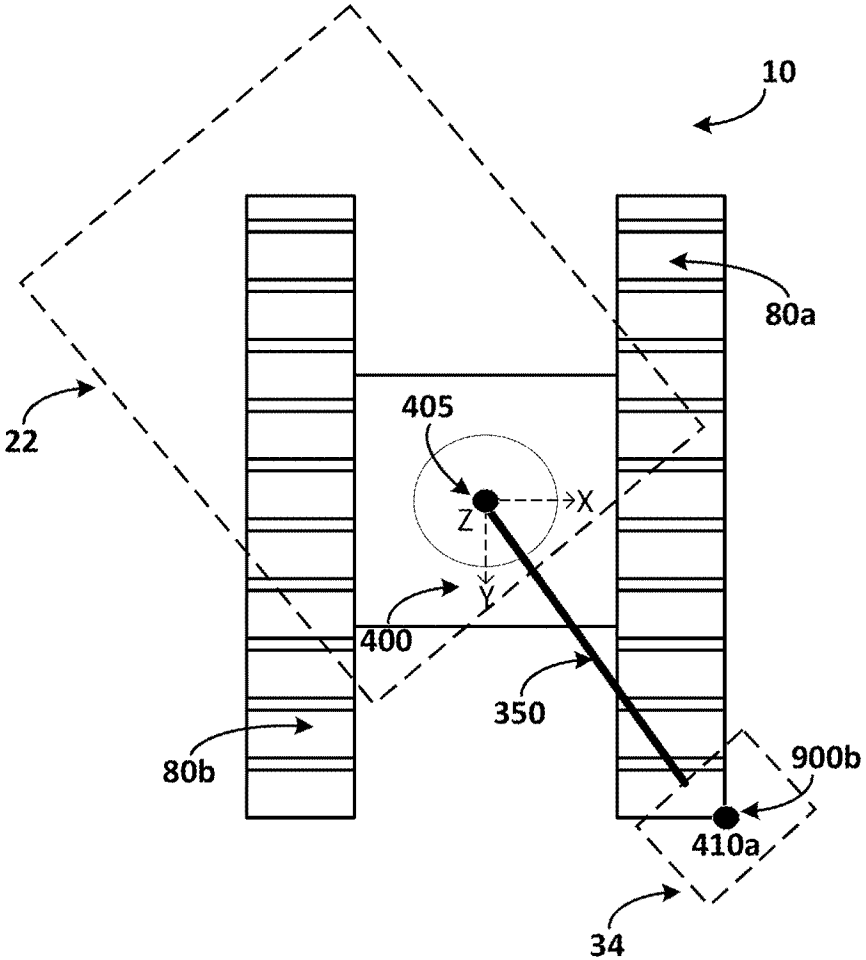
FIGS. 10A-10B illustrate, respectively, the first position and the second position of tracks in a top-down schematic view for the mining machine of FIG. 1, according to some embodiments.
Figure 10A:
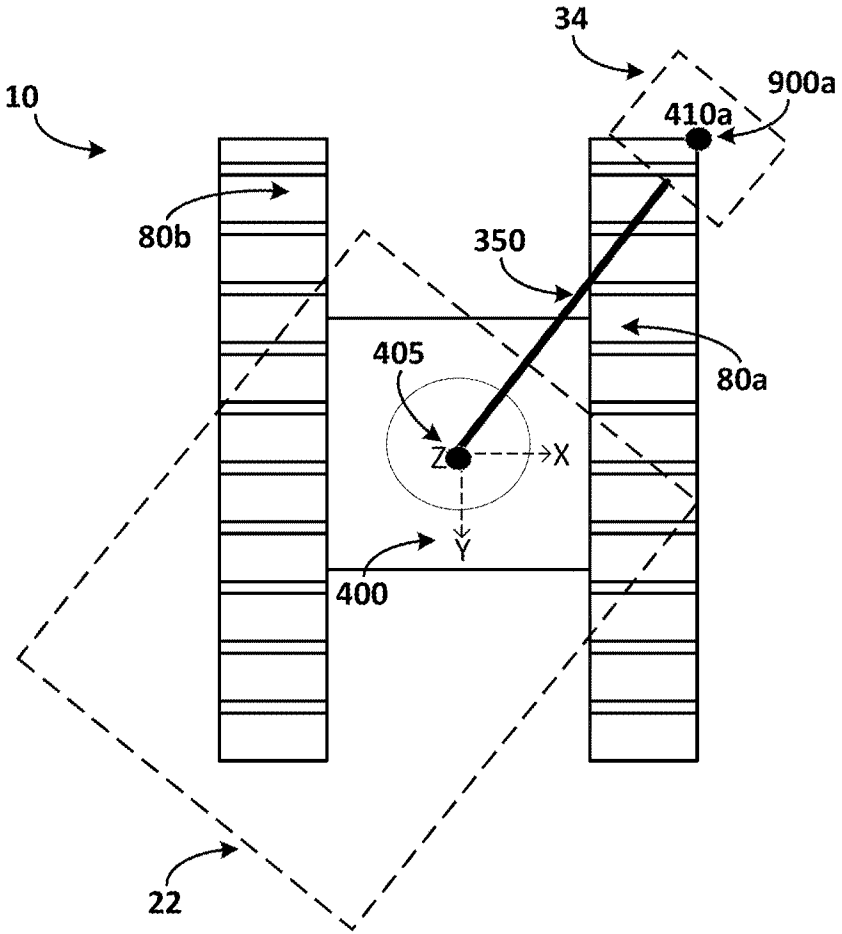

In some embodiments, the first position associated with the tracks 80, or first track position, is located near a front end of the tracks 80. For example, as shown in FIGS. 9 and 10A, the first track position may be a first track position 900*a* located at the vertex that joins the front, top, and right (outer) surfaces of the right track 80*a*, hereinafter referred to as "front-top-right vertex of right track 80*a*." It should be understood that the first track position 900*a* is provided as an exemplary first track position, and the first track position may be located at any other point on or near the right track 80*a*. For example, the first track position may be located at a middle portion or rear end of the right track 80*a*. Furthermore, the first track position need not necessarily be located at a point on or near the right track 80*a*. For example, the first track position may be located a point on or near the left track 80*b*. In some embodiments, the first track position may be located in between, in front of, behind, or outside of the tracks 80.

Moving the dipper 34 to the first track position 900*a* may include aligning and/or contacting the first track position 900*a* with a specific point on the surface of the dipper 34. For example, the electronic processor 250 may be configured to move the dipper 34 such that one of the dipper reference points 410 is aligned with and/or contacting the first track position. As shown in FIG. 10A, the dipper 34 is moved to the first track position 900*a* such that the dipper center 410*a* is aligned with and contacting the front-top-right vertex of right track 80*a* while the dipper 34 is located at the first track position 900*a*. Although illustrated and described with respect to the dipper center 410*a*, it should be understood that any of the dipper reference points 410 may be used to align and/or contact the first track position 900*a* with the dipper 34. For example, the electronic processor 250 may alternatively be configured to align and/or contact front-top-right vertex of right track 80*a* with the front right dipper vertex 410*b*, the rear right dipper vertex 410*c*, the front left dipper vertex 410*d*, the rear left dipper vertex 410*e*, or any other reference point defined on a surface of the dipper 34.

In block 810, the electronic processor 250 determines a first data point associated with, or indicative of, the first track position 900*a*. The first data point may include, but is not limited to, one or more measurements taken by the dipper position sensors 315 while the dipper 34 is located at the first track position 900*a*. For example, the electronic processor 250 may determine, based on measurements taken by the dipper position sensors 315, the extent to which the dipper 34 is crowded, the extent to which the dipper 34 is hoisted, and/or the rotational position of the dipper 34 while the dipper 34 is located at the first track position 900*a*. The crowd, hoist, and rotation measurements taken by the dipper position sensors 315 may be included in and/or stored in association with the first data point.

In addition, the electronic processor 250 may be configured to determine a set of (x, y, z) coordinates representing the first track position 900*a*, which may be included and/or stored in association with the first data point. As described above with respect to the rope shovel's local coordinate system 400, the electronic processor 250 may be configured to determine, or derive, the (x, y, z) coordinates of a point on or near the tracks 80 based on the (x, y, z) coordinates of a particular dipper reference point 410. Therefore, the (x, y, z) coordinates of the first track position 900*a* may be derived from the (x, y, z) coordinates of a particular dipper reference point 410 while the dipper 34 is located at the first track position 900*a*.

With respect to the FIGS. 9 and 10A, the electronic processor 250 may be configured to determine the (x, y, z) coordinates of the first track position 900*a*, which is the point located on top of the front-top-right vertex of right track 80*a*, by determining the (x, y, z) coordinates of a dipper reference point 410 that is aligned with and/or contacting the front-top-right vertex of right track 80*a*. For example, as shown in FIG. 10A, the dipper center 410*a* is aligned with and contacting the front-top-right vertex of right track 80*a* while the dipper 34 is located at the first track position 900*a*. Therefore, the electronic processor 250 may be configured to determine that the (x, y, z) coordinates of the first track position 900*a* are equal to the (x, y, z) coordinates of the dipper center 410*a* while the dipper center 410*a* contacts the front-top-right vertex of right track 80*a*. Accordingly, after the electronic processor 250 determines the (x, y, z) coordinates of the first track position 900*a*, the (x, y, z) coordinates of the first track position 900*a* may be included in and/or stored in association with the first data point.

Although the (x, y, z) coordinates of the first track position 900*a* are illustrated and described as being equivalent to the (x, y, z) coordinates of the dipper center 410*a*, it should be understood that (x, y, z) coordinates of the first track position 900*a* may be derived from any of the respective (x, y, z) coordinates of the dipper reference points 410. For example, if the front right vertex 410*b* of the dipper is aligned with and/or contracting the front-top-right of right track 80*a*, the electronic processor may be configured to determine that the (x, y, z) coordinates of the first track position 900*a* are equivalent to the (x, y, z) coordinates of the front right dipper vertex 410*b*. In other instances, the electronic processor 250 may derive the (x, y, z) coordinates of the first track position 900*a* from the respective (x, y, z) coordinates of the rear right dipper vertex 410*c*, the front left dipper vertex 410*d*, the rear left dipper vertex 410*e*, or any other reference point defined on a surface of the dipper 34.

In block 815, the electronic processor 250 moves the dipper 34 to a second position associated with the tracks 80 of the rope shovel 10. For example, using the dipper motion command input devices 305, a rope shovel operator may input a command for moving the dipper 34 to the second position associated with the tracks 80. The electronic processor 250 receives the operator input signal the dipper motion command input devices 305 and translates the signals to corresponding motion commands for the dipper drives 310. In response to receiving the motion commands from the electronic processor 250, the dipper drives 310 control movement of the dipper 34 to the second position associated with the tracks 80.

In some embodiments, the second position associated with the tracks 80, or second track position, is located near a rear end of the tracks 80. For example, as shown in FIGS. 9 and 10B, the second track position may be a second track position 900*b* located at the vertex that joins the rear, top, and right (outer) surfaces of the right track 80*a*, hereinafter referred to as "rear-top-right vertex of right track 80*a*." It should be understood that the second track position 900*b* is provided as an exemplary second track position, and the second track position may be located at any other point on or near the right track 80*a*. For example, in some instances, the second track position may be located at a middle portion or front end of the right track 80*a*. Furthermore, the second track position need not necessarily be located at point on or near the right track 80*a*. For example, the second track position may be located at a point on or near the left track 80*b*. In some embodiments, the second track position is chosen based on the location of the first track position. For example, if the first track position is located at or near a front end of the tracks 80, the second track position may be chosen to be located at or near a middle portion or rear end of the tracks 80. In some embodiments, the second track position may be located in between, in front of, behind, or outside of the tracks 80.

Moving the dipper 34 to the second track position 900*b* may include aligning and/or contacting the second track position 900*b* with a specific point on the surface of the dipper 34. For example, the electronic processor 250 may be configured to move the dipper 34 such that one of the dipper reference points 410 is aligned with and/or contacting the second track position 900*b*. As shown in FIG. 10B, the dipper 34 is moved to the second track position 900*b* such that the dipper center 410*a* is aligned with and contacting the rear-top-right vertex of right track 80*a* while the dipper 34 is located at the second track position 900*b*. Although illustrated and described with respect to the dipper center 410*a*, it should be understood that any of the dipper reference points 410 may be used to align and/or contact the second track position 900*b* with the dipper 34. For example, the electronic processor 250 may alternatively be configured to align and/or contact the rear-top-right vertex of right track 80*a* with the front right dipper vertex 410*b*, the rear right dipper vertex 410*c*, the front left dipper vertex 410*d*, the rear left dipper vertex 410*e*, or any other reference point defined on a surface of the dipper 34.

In block 820, the electronic processor 250 determines a second data point associated with, or indicative of, the second track position 900*b*. The second data point may include, but is not limited to, one or more measurements taken by the dipper position sensors 315 while the dipper 34 is located at the second track position 900*b*. For example, the electronic processor 250 may determine, based on measurements taken by the dipper position sensors 315, the extent to which the dipper 34 is crowded, the extent to which the dipper 34 is hoisted, and/or the rotational position of the dipper 34 while the dipper 34 is located at the second track position 900*b*. The crowd, hoist, and rotation measurements taken by the dipper position sensors 315 may be included in and/or stored in association with the second data point.

In addition, the electronic processor 250 may be configured to determine a set of (x, y, z) coordinates representing the second track position 900*b*, which may be included and/or stored in association with the second data point. As described above with respect to the rope shovel's local coordinate system 400, the electronic processor 250 may be configured to determine, or derive, the (x, y, z) coordinates of point on or near the tracks 80 based on the (x, y, z) coordinates of a particular dipper reference point 410. Therefore, the (x, y, z) coordinates of the second track position 900*b* may be derived from the (x, y, z) coordinates of a particular dipper reference point 410 while the dipper 34 is located at the second track position 900*b*.

With respect to FIGS. 9 and 10B, the electronic processor 250 may be configured to determine the (x, y, z) coordinates of the second track position 900*b* by determining the (x, y, z) coordinates of a dipper reference point 410 that is aligned with and/or contacting the rear-top-right vertex of right track 80*a*. For example, as shown in FIG. 10B, the dipper center 410*a* is aligned with and contacting the top of the rear-top-right vertex of right track 80*a* while the dipper 34 is located at the second track position 900*b*. Therefore, the electronic processor 250 may be configured to determine that the (x, y, z) coordinates of the second track position 900*b* are equal to the (x, y, z) coordinates of the dipper center 410*a* while the dipper center 410*a* contacts the rear-top-right vertex of right track 80*a*. Accordingly, after the electronic processor 250 determines the (x, y, z) coordinates of the second track position 900*b*, the (x, y, z) coordinates of the second track position 900*b* may be included in and/or stored in association with the second data point.

Although the (x, y, z) coordinates representing the second track position 900*b* are illustrated and described as being equivalent to the (x, y, z) coordinates of the dipper center 410*a*, it should be understood that (x, y, z) coordinates of the second track position 900*b* may be derived from any of respective set of (x, y, z) coordinates representing the dipper reference points 410. For example, if the front right vertex 410*b* of the dipper is aligned with and/or contracting the rear-top-right vertex of right track 80*a*, the electronic processor 250 may be configured to determine that the (x, y, z) coordinates of the second track position 900*b* are equivalent to the (x, y, z) coordinates of the front right dipper vertex 410*b*. In other instances, the electronic processor 250 may derive the (x, y, z) coordinates of the second track position 900*b* from the respective (x, y, z) coordinates of the rear right dipper vertex 410*c*, the front left dipper vertex 410*d*, the rear left dipper vertex 410*e*, or any other reference point defined on a surface of the dipper 34.

In block 825, the electronic processor 250 generates a virtual model of the tracks 80 based on the first and second data points. For example, the electronic processor 250 may be configured to extrapolate virtual boundaries of the tracks 80 from the data included in the first and second data points. The virtual boundaries of the tracks 80 collectively form the virtual model of the tracks 80 and define a three-dimensional volume representing the tracks 80 in the rope shovel's local coordinate system 400. In some embodiments, the electronic processor 250 may be further configured to combine the first and second data points with dimensional data stored in memory 255 when extrapolating virtual boundaries of the tracks 80.

In some embodiments, the electronic processor 250 may be configured to define a virtual track boundary as one or more points within the local coordinate system 400 that represent and/or are otherwise extrapolated from the coordinates representing the first and second track positions. In such embodiments, the electronic processor 250 may be configured to generate a virtual model of the tracks 80 that is defined by the one or more boundary points extrapolated from the coordinates representing the first and second track positions. In some embodiments, the electronic processor 250 may be configured to define a virtual track boundary as a one or more line segments within the local coordinate system 400 that intersect, or are otherwise extrapolated from, the coordinates of the first and/or second track positions. In such embodiments, the electronic processor 250 may be configured to generate a virtual model of the tracks 80 that is defined by the intersection or joining of the line segments representing virtual track boundaries. In some embodiments, the electronic processor 250 may be configured to define a virtual track boundary as one or more arcs within the local coordinate system 400 that intersect, or are otherwise extrapolated from, the coordinates representing the first and/or second track positions. In such embodiments, the electronic processor 250 may be configured to generate a virtual model of the tracks 80 that is defined by the intersection or joining of the arcs representing virtual track boundaries. In some embodiments, the electronic processor 250 is configured to define a virtual track boundary as one or more curves (e.g., a line, a parabola, an ellipse, a circle, etc.) within the local coordinate system 400 that intersect, or are otherwise extrapolated from, the coordinates representing the first and/or second track positions. In such embodiments, the electronic processor 250 may be configured to generate a virtual model of the tracks 80 that is defined by the intersection of curves representing virtual track boundaries. In some embodiments, the electronic processor 250 may be configured to define a virtual track boundary as being a plane within local coordinates system 400 that intersects, or is otherwise extrapolated from, the coordinates representing the first and/or second track positions within the local coordinate system 400. In such embodiments, the electronic processor 250 may be configured to generate a virtual model of the tracks 80 that is defined by the intersection of planes representing virtual track boundaries. In some embodiments, the electronic processor 250 may be configured to define a virtual track boundary as a combination of one or more points, line segments, arcs, curves, and/or planes within the local coordinate system 400 that intersect, or are otherwise extrapolated from, the coordinates representing the first and/or second track positions within the local coordinate system 400. In such embodiments, the electronic processor 250 may be configured to generate a virtual model of the tracks 80 that is defined by the intersection of points, line segments, arcs, curves, and/or planes representing virtual track boundaries. It should be understood that the above described examples of defining track boundaries are not limiting, as the electronic processor 250 may be configured to define virtual track boundaries using alternative means. Furthermore, it should be understood that the electronic processor 250 may be further configured to use the dimensional data stored in memory 255 in combination with the first and second data points when generating the virtual track boundaries.

Figure 11:
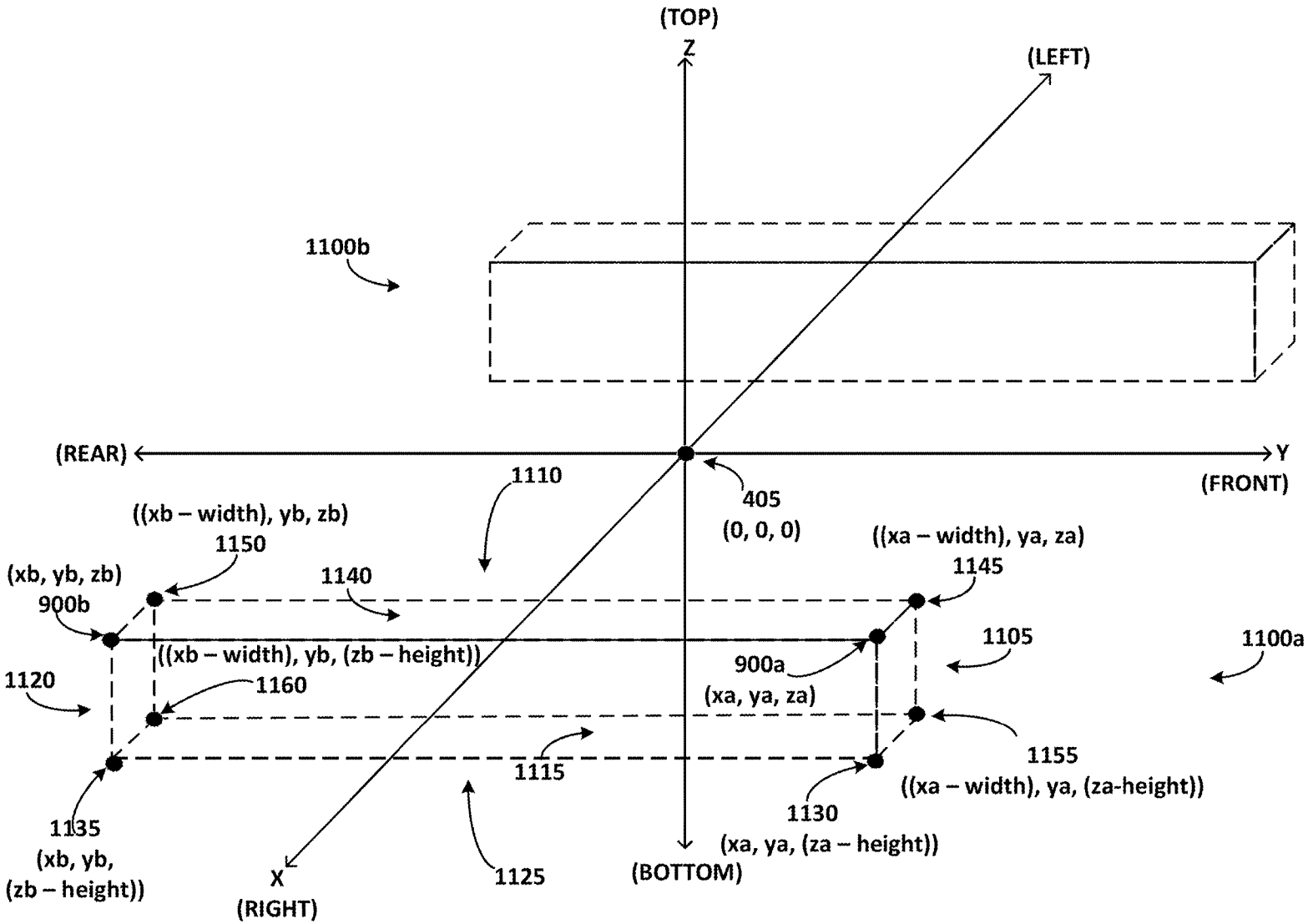
FIG. 11 illustrates a perspective view of a virtual model of the tracks for the mining machine of FIG. 1, according to some embodiments.

FIG. 11 illustrates a perspective view of a virtual model of the tracks 80, or track model 1100, generated by electronic processor 250 according to some embodiments. In particular, FIG. 11 illustrates a virtual model of the right track 80*a*, or right track model 1100*a*, and a virtual model of the left track 80*b*, or left track model 1100*b*. As will be described in more detail below, the electronic processor 250 may be configured to extrapolate virtual boundaries from the data points associated with the first and second track positions 900*a*, 900*b* when generating the track model 1100. It should be understood that the track model 1100 illustrated in FIG. 11 and described herein is just one example of a virtual model of the tracks 80 that may be generated by electronic processor 250, and various other embodiments of virtual track models may be generated by the electronic processor 250. Furthermore, it should be understood that the below described process for extrapolating virtual boundaries from the first and second data points is just one example as to how the electronic processor 250 may be configured to extrapolate virtual boundaries from the data points associated with the first and second track positions 900*a*, 900*b*. Accordingly, in other embodiments, the electronic processor 250 may be configured to employ additional or alternative processes for extrapolating virtual track boundaries when generating a virtual model of the tracks 80.

With reference to FIG. 11, the first track position 900*a* and the second track position 900*b* are represented as points in the rope shovel's local coordinate system 400. In particular, the first track position 900*a* is represented as a point having a first set of cartesian coordinates, ($x_a$, $y_a$, $z_a$), which were determined by the electronic processor 250 at step 810 of the track modeling method 800. Similarly, the second track position 900*b* is represented as a point having a second set of cartesian coordinates, ($x_b$, $y_b$, $z_b$), which were determined by the electronic processor 250 at step 820 of the track modeling method 800.

As shown in FIG. 11, the electronic processor 250 may be configured to generate right and left track models 1100*a*, 1100*b* that are generally box-shaped. In particular, the electronic processor 250 may be configured to generate a box-shaped right track model 1100*a* that is defined by eight boundary vertices. As described above with respect to steps 805 and 810, the first track position 900*a* is located at a vertex that joins the front, top, and right (outer) surfaces of the right track 80*a*. Thus, when generating the virtual track model, the electronic processor 250 may be configured to define the first track position 900*a* as the boundary vertex that joins the front, top, and right surface of the right track model 1100*a*. As shown in FIG. 11, the first track position 900*a* is the vertex that joins the front surface 1105, the top surface 1110, and the right surface 1115 of the right track model 1100*a*. Similarly, as described above with respect to steps 815 and 820, the second track position 900*b* is located at a vertex that joins the rear, top, and right (outer) surfaces of the right track 80*a*. Thus, as shown in FIG. 11, the electronic processor 250 may be configured to define the second track position 900*b* as the boundary vertex that joins the rear surface 1120, top surface 1110, and right surface 1115 of the right track model 1100*a*.

The electronic processor 250 may be further configured to extrapolate the six remaining boundary vertices of the box-shaped right track model 1100*a* from the first set of cartesian coordinates representative of the first track position 900*a*, the second set of cartesian coordinates from the second track position 900*b*, and dimensional data associated with the tracks 80 that is stored in memory 255.

For example, the electronic processor 250 may be configured to determine the cartesian coordinates of the boundary vertex that joins the front surface 1105, bottom surface 1125, and right surface 1115 of the right track model 1100*a* (hereinafter referred to as "front-bottom-right vertex 1130") based on the first set of cartesian coordinates and a known height of the right track 80*a* that is stored in memory 255. In particular, the electronic processor 250 may determine that the front-bottom-right vertex 1130 has the following set of cartesian coordinates: ($x_a$, $y_a$, ($z_a$-height)), where the z-component of the front-bottom-right vertex 1130 equals the difference between the z-component of the first track position 900*a* and the known height of right track 80*a*. Similarly, the electronic processor 250 may be configured to extrapolate the cartesian coordinates of the boundary vertex that joins the rear surface 1120, bottom surface 1125, and right surface 1115 of the right track model 1100*a* (hereinafter referred to as "rear-bottom-right vertex 1135") based on the second set of cartesian coordinates and the known height of the right track 80*a*. In particular, the electronic processor 250 may determine that the rear-bottom-right vertex 1135 has the following set of cartesian coordinates: ($x_b$, $y_b$, ($z_b$-height)), where the z-component of the rear-bottom-right vertex 1135 equals the difference between the z-component of the second track position 900*b* and the known height of right track 80*a*.

The electronic processor 250 may be further configured to determine the cartesian coordinates of the boundary vertex that joins the front surface 1105, top surface 1125, and left surface 1140 of the right track model 1100*a* (hereinafter referred to as "front-top-left vertex 1145") based on the first set of cartesian coordinates and a known width of the right track 80*a* that is stored in memory 255. In particular, the electronic processor 250 may determine that the front-top-left vertex 1145 has the following set of cartesian coordinates: (($x_a$-width), $y_a$, $z_a$), where the x-component of the front-top-left vertex 1145 equals the difference between the x-component of the first track position 900*a* and the known width of right track 80*a*. Similarly, the electronic processor 250 may be further configured to determine the cartesian coordinates of the boundary vertex that joins the rear surface 1120, top surface 1125, and left surface 1140 of the right track model 1100*a* (hereinafter referred to as "rear-top-left vertex 1150") based on the second set of cartesian coordinates and the known width of the right track 80*a*. In particular, the electronic processor 250 may determine that the rear-top-left vertex 1150 has the following set of cartesian coordinates: (($x_b$-width), $y_b$, $z_b$), where the x-component of the rear-top-left vertex 1150 equals the difference between the x-component of the first track position 900*a* and the known width of right track 80*a*.

In addition, the electronic processor 250 may be configured to determine the cartesian coordinates of the boundary vertex that joins the front surface 1105, bottom surface 1125, and left surface 1140 of the right track model 1100*a* (hereinafter referred to as "front-bottom-left vertex 1155") based on the first set of cartesian coordinates, the known height of the right track 80*a*, and the known width of the right track 80*a*. In particular, the electronic processor 250 may determine that the front-bottom-left vertex 1155 has the following set of cartesian coordinates: (($x_a$-width), $y_a$, ($z_a$-height)). The x-component of the front-bottom-left vertex 1155 equals the difference between the x-component of the first track position 900*a* and the known width of right track 80*a*, and the z-component of the front-bottom-left vertex 1155 equals the difference between the z-component of the first track position 900*a* and the known height of right track 80*a*.

Similarly, the electronic processor 250 may be further configured to determine the cartesian coordinates of the boundary vertex that joins the rear surface 1120, bottom surface 1125, and left surface 1140 of the right track model 1100*a* (hereinafter referred to as "rear-bottom-left vertex 1160") based on the second set of cartesian coordinates, the known height of the right track 80*a*, and the known width of the right track 80*a*. In particular, the electronic processor 250 may determine that the rear-bottom-left vertex 1160 has the following set of cartesian coordinates: (($x_b$-width), $y_b$, ($z_b$-height)). The x-component of the rear-bottom-left vertex 1160 equals the difference between the x-component of the second track position 900*b* and the known width of right track 80*a* and the z-component of the rear-bottom-left vertex 1160 equals the difference between the z-component of the second track position 900*b* and the known height of right track 80*a*.

In view of the above, the right track model 1100*a* generated by the electronic processor 250 includes six boundary surfaces and eight boundary vertices, wherein each boundary surface is defined by a respective set, or group, of four boundary vertices. The front surface 1105 of the right track model 1100*a* is bound by the first track position 900*a*, the front-bottom-right vertex 1130, the front-top-left vertex 1145, and the front-bottom-left vertex 1155. The top surface 1110 of the right track model 1100*a* is bound by the first track position 900*a*, the second track position 900*b*, the front-top-left vertex 1145, and the rear-top-left vertex 1150. The right surface 1120 of the right track model 1100*a* is bound by the first track position 900*a*, the second track position 900*b*, the front-bottom-right vertex 1130, and the rear-bottom-right vertex 1135. The rear surface 1120 of the right track model 1100*a* is bound by the second track position 900*b*, the rear-bottom-right vertex 1135, the rear-top-left vertex 1150, and the rear-bottom-left vertex 1160. The bottom surface 1125 of the right track model 1125 is bound by the front-bottom-right vertex 1130, the rear-bottom-right vertex 1135, the front-bottom-left vertex 1155, and the rear-bottom-left vertex 1160. The left surface 1140 of the right rack model 1100*a* is bound by the front-top-left vertex 1145, the rear-top-left vertex 1150, the front-bottom-left vertex 1155, and the rear-bottom-left vertex 1160.

Figure 18:
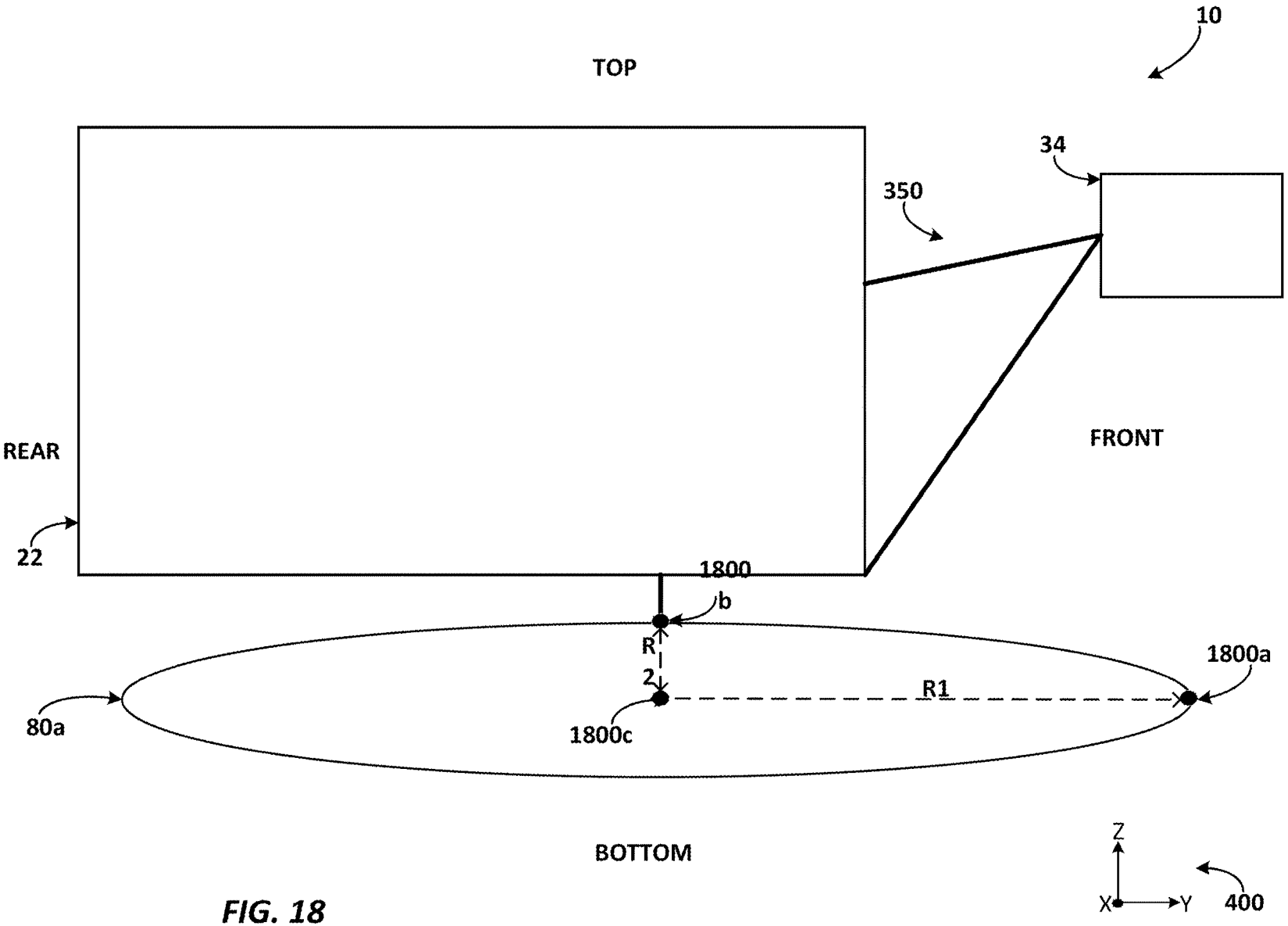
FIG. 18 illustrates a schematic profile view of the mining machine of FIG. 1, according to some embodiments.

In some instances, the tracks 80 may have a curved shape (e.g., see side view of FIG. 2 and FIG. 18). If a track 80 has a curved shape, the height of the front and/or rear ends of the track 80 may be less than the height of the middle portion of the track 80. With respect to the example provided above, if the right track 80*a* is curved, the height of the front end of right track 80*a* may be less than the height at the middle portion of the right track 80*a*. Therefore, the electronic processor 250 may be configured to modify the right track model 1100*a* to accommodate for the differences in height between the middle and ends of right track 80*a*. For example, rather than the track model 1100*a* being defined by boundaries that are straight lines, one or more of the boundaries may have defined as a curved line. For example, the vertex connecting the first track position 900*a* and the second track position 900*b* may be a curved line having end points at positions 900*a* and 900*b*, and a midpoint with a height that is higher than the z coordinate of the position 900*a* or 900*b* by the known difference in height between the middle portion and end portions of the right track 80*a*. A similar curved line may serve as a vertex joining the points 1145 and 1150. Alternatively, the electronic processor 250 may maintain the generally cuboid shape of the track model 1100*a* shown in FIG. 11, but shift the boundary vertices of the right track model 1100*a* along the z-axis as a function of the difference in heights between the middle and ends of right track 80*a*. For example, if it is known that the height of the first track position 900*a* is half of the height of the middle portion of the track 80*a*, the electronic processor 250 may shift the right track model 1100*a* up the z-axis by a value equal to half of the height of the middle portion of right track 80*a*. Accordingly, the electronic processor 250 is operable to modify the virtual track model 1100 to accurately represent the right and left tracks 80*a*, 80*b*, even if the tracks 80 are curved.

If it can be assumed that the right track 80*a* is approximately equal in size to the left track 80*b*, the electronic processor 250 may be configured to generate the left track model 1100*b* by mirroring, or reflecting, the boundary vertices included in the right track model 1100*a* across the y-z plane of the local coordinate system 400. In other words, if the right and left tracks 80*a*, 80*b* are approximately equal in size, the electronic processor 250 may be configured to define a set of boundary vertices for the left track model 1100*b* by flipping the signs of (e.g., changing from positive to negative) the x-components of the boundary vertices included in the right track model 1100*a*. For example, the cartesian coordinates of the front-top-left vertex of the left track model 1100*b*, ($-x_a$, $y_a$, $z_a$), are determined by flipping the sign of the x-component included in the cartesian coordinates representing the first track position 900*a*.

Although the virtual track model 1100 is described in several embodiments herein as being generally box-shaped, in some embodiments, the virtual track model may be generated as a variety of different shapes. For example, as described above, the electronic processor 250 may be configured to generate a virtual track model that is any combination of one or more boundary points, line segments, arcs, curves, and/or planes that define a three dimensional volume representing the tracks 80.

The virtual track model 1100 generated by electronic processor 250 may be used in the collision prevention and mitigation system described above with respect to method 500. For example, the virtual track model 1100 may be generated and stored in the memory 255 as part of the model data 325. Accordingly, the distance between the dipper 34 and the tracks 80 determined and used as part of the step 515 may include receiving the virtual track model 1100 from the memory 255. In some embodiments, step 515 of the method 500 includes generating and using, by the electronic processor 250, the virtual track model 1100 without storing the virtual track model 1100 in the memory 255.

Referring back to generation of a virtual track model, in some instances, the right track 80*a* is not assumed to be approximately equal in size to the left track 80*b*. For example, the respective front ends of the right and left tracks 80*a*, 80*b* may be configured to be individually extended and/or retracted. Thus, at times, the right track 80*a* may be shorter than, the same length as, or longer than the left track 80*b*. Therefore, while performing the track modeling method 800, the electronic processor 250 may be further configured to move the dipper 34 to a third track position and to determine a third data point associated with the third track position to accommodate for differences in track length.

Figure 12:
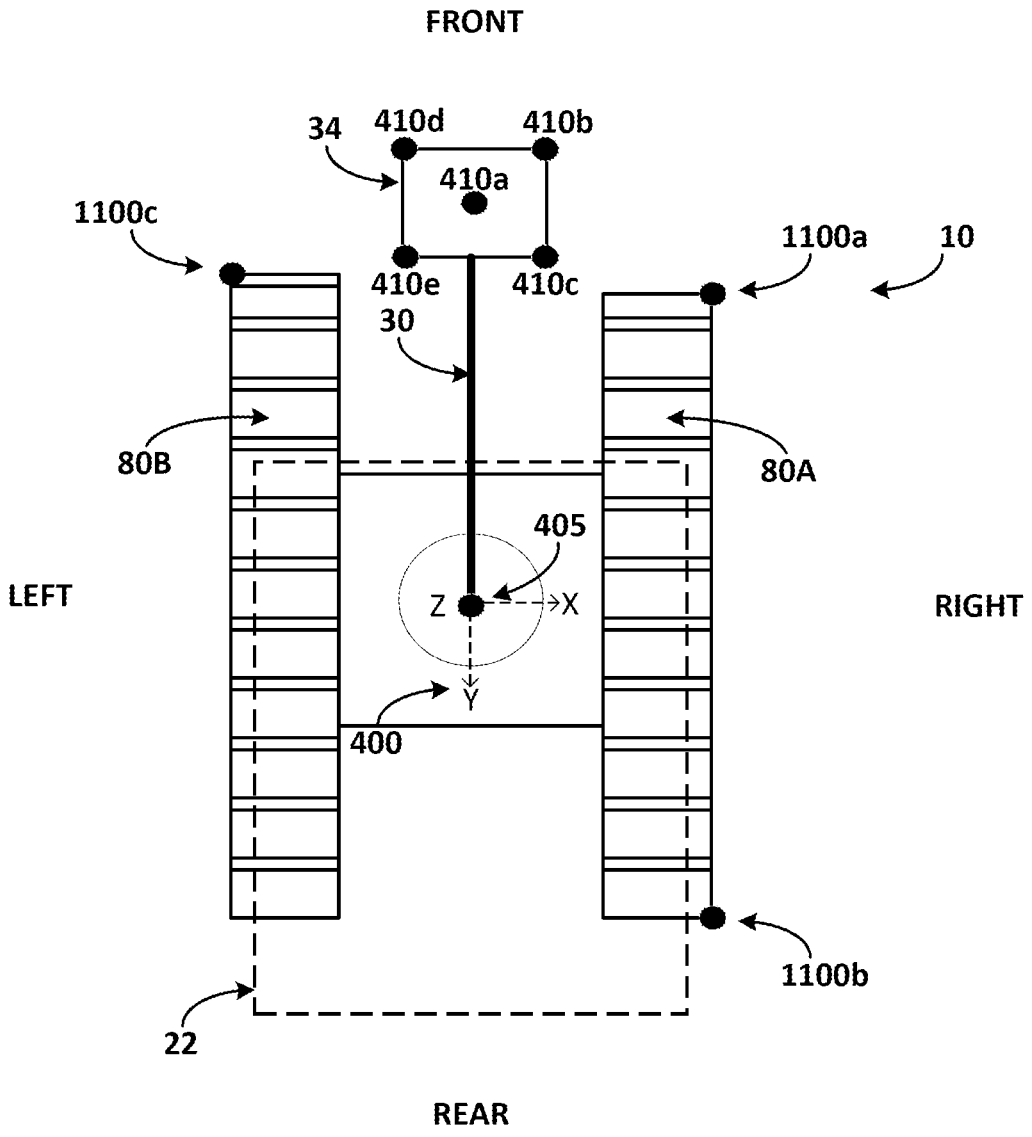
FIG. 12 illustrates an embodiment of the mining machine of FIG. 1 in which the front end of left track extends further than the right track.

FIG. 12 illustrates an embodiment of the rope shovel 10 in which the front end of left track 80*b* has been extended, making left track 80*b* longer than the right track 80*a*. Since the right and left tracks 80*a*, 80*b* have different lengths, the electronic processor 250 a virtual model of the left track 80*b* generated by mirroring a virtual model of the right track 80*a* across the y-z plane would be inaccurate. Thus, in some embodiments of the track modeling method 800, the electronic processor 250 may be configured to move the dipper 34 to and determine respective data points indicative of three positions, 1200*a*, 1200*b*, and 1200*c*, associated with the tracks 80. The first and second track positions 1200*a*, 1200*b* shown in FIG. 12 are similar to the first and second track positions 900*a*, 900*b* described herein. That is, the first track position 1200*a* is located at the front-top-right vertex of right track 80*a*, and the second track position 1200*b* is located at the rear-top-right vertex of right track 80*a*. As described above, the electronic processor 250 may determine a first data point that includes measurements taken by the dipper position sensors 315 while the dipper 34 is located at the first track position 1200*a* and a set of cartesian coordinates representing the first track position 1200*a*. Similarly, the electronic processor 250 may determine a second data point that includes measurements taken by the dipper position sensors 315 while the dipper 34 is located at the second track position 1200*b* and a set of cartesian coordinates representing the second track position 1200*b*.

Figure 8:
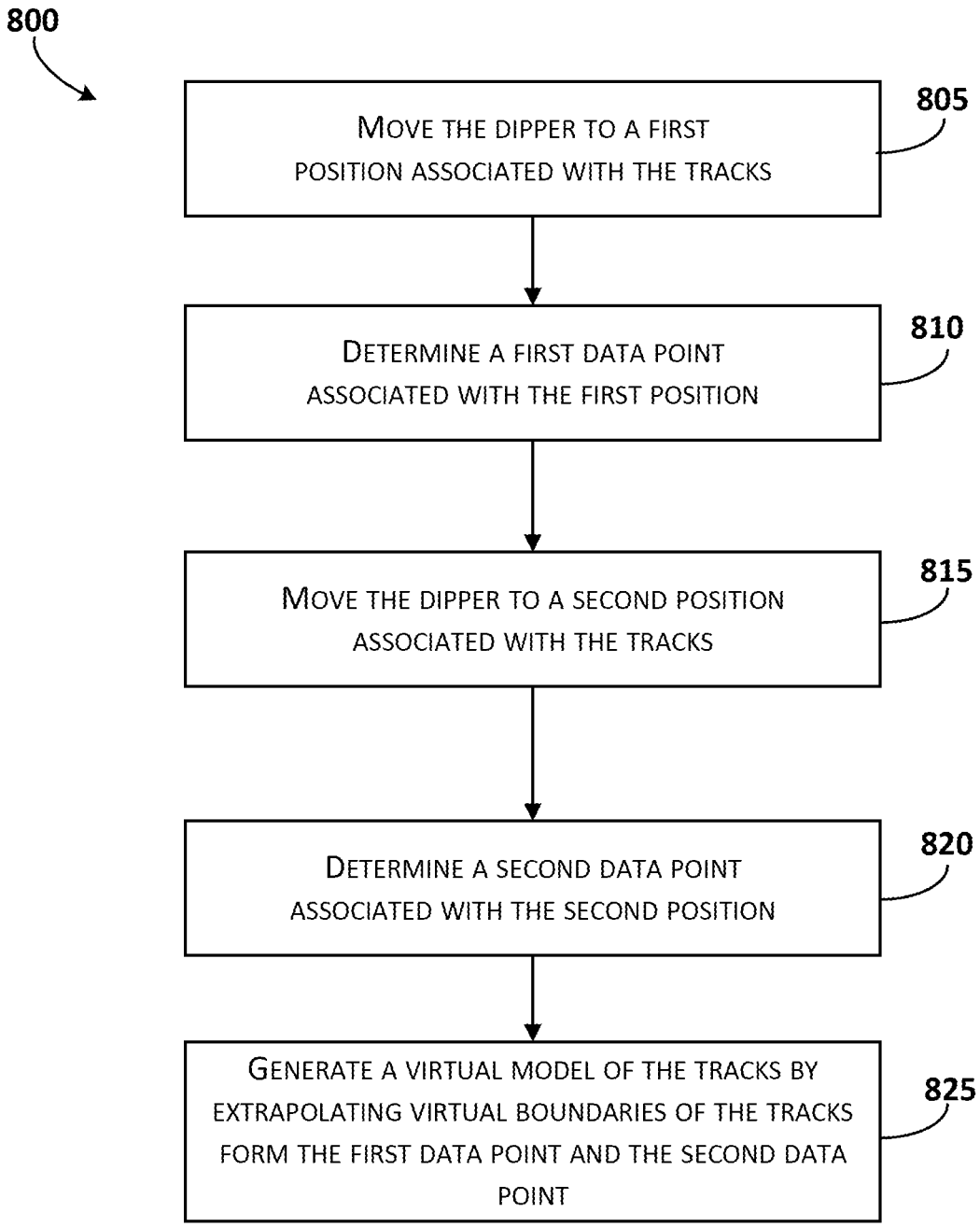
FIG. 8 illustrates a flow chart for modeling tracks of a mining machine, according to some embodiments.

Furthermore, the electronic processor 250 may be configured to move the dipper 34 to the third track position 1200*c* (e.g., after block 820 in the method 800 of FIG. 8). As shown in FIG. 12, the third track position 1200*c* is located at the front-top-left vertex of the left track 80*b*. While the dipper 34 is located at the third track position 1200*c*, the electronic processor 250 determines a third data point that includes measurements taken by the dipper position sensors 315 and a set of cartesian coordinates representing the third track position 1200*c*.

In these embodiments of the method 800, in block 825, the electronic processor 250 is operable to generate a virtual model of the tracks 80 using the first, second, and third data points associated with track positions 1200*a*-1200*c*. In particular, by using the first data point associated with the first track position 1200*a* and the second data point associated with the second track position 1200*b*, the electronic processor 250 is operable to generate a right track model 1300*a* (FIG. 13) in a manner that is similar to the above-described process used for generating the right track model 1100*a*. However, rather than mirroring the right track model 1300*a* across the y-z plane to generate a left track model, the electronic processor 250 is configured to generate the left track model 1300*b* based on the second data point associated with the second track position 1200*b* and the third data point associated with the third track position 1200*c*.

Figure 13:
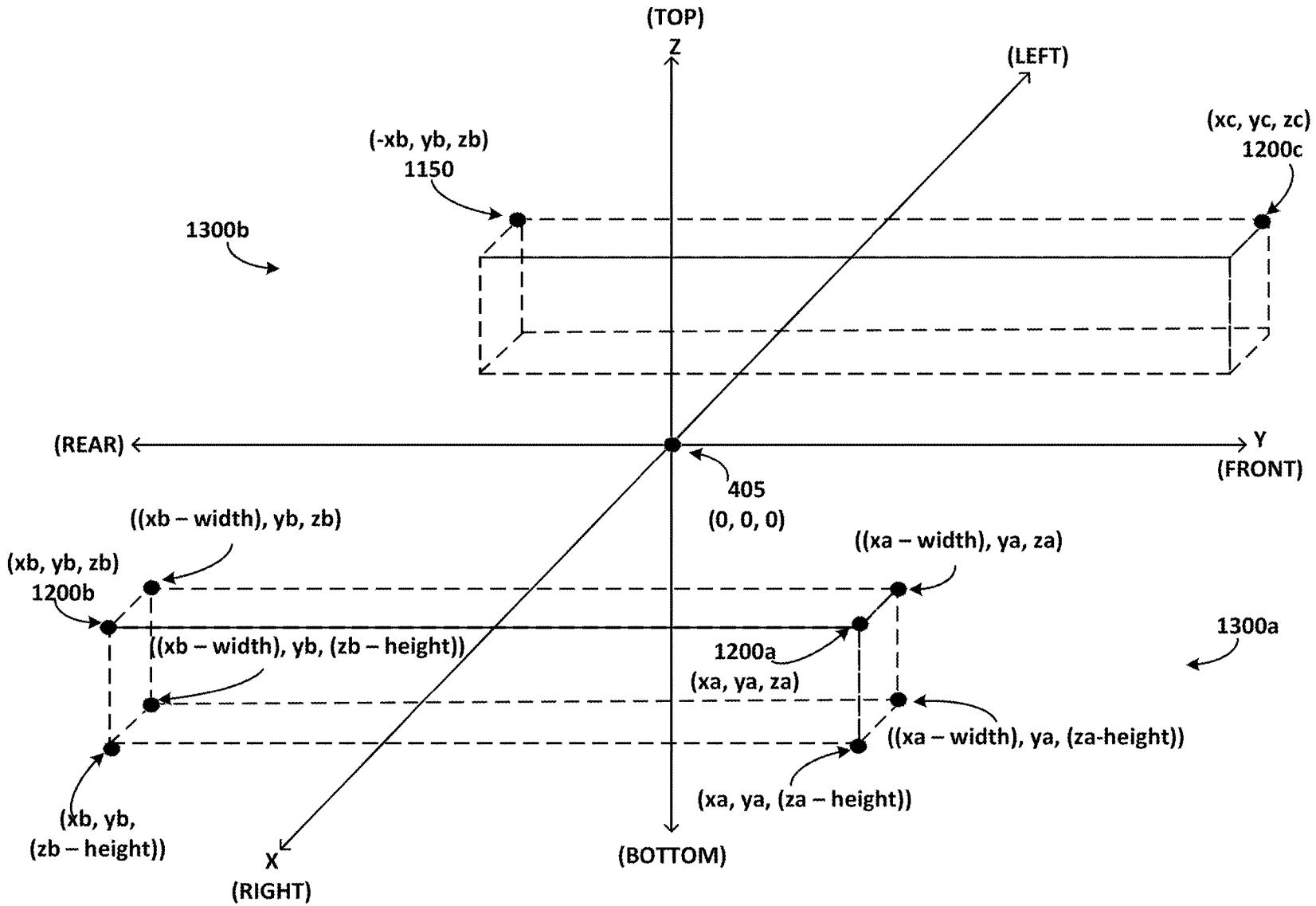
FIG. 13 illustrates a perspective view of a virtual model of the tracks for the mining machine of FIG. 12, according to some embodiments.

As shown in FIG. 13, the third track position 1200*c* is represented as a coordinate point in the rope shovel's local coordinate system 400. In particular, the third track position 1200*c* is represented as a point having the third set of coordinates, $(x_c, y_c, z_c)$, which are included in the third data point determined by the electronic processor 250. The third track position 1200*c* is located at the vertex joining the front, top, and left surfaces of the left track model 1300*b*, or the front-top-left boundary vertex of left track model 1300*b*. In a manner that is similar to the above-described process used for generating the virtual track model 1100, the electronic processor 250 may be configured to extrapolate coordinates of the three remaining front boundary vertices (e.g., the front-top-right vertex, the front-bottom-left vertex, and the front-bottom-right vertex) of the left track model 1300*b* from the coordinates representing the third track position 1200*c*, $(x_c, y_c, z_c)$.

In addition, in some embodiments (e.g., where the rear end of the tracks 80 cannot be individually extended or retracted), it may be assumed that the distance from the track center 405 to the rear-top-right vertex of right track 80*a* (e.g., the second track position 1200*b*) is equal to the distance from the track center 405 to the rear-top-left vertex of left track 80*b*. Accordingly, the electronic processor 250 may be configured to extrapolate the coordinates of the rear-top-left boundary vertex 1305 from the coordinates representing the second track position 1200*b*. In particular, the electronic processor 250 may derive the coordinates of the rear-top-left boundary vertex 1305, $(-x_b, y_b, z_b)$, by flipping the sign of the x-component included in the second set of coordinates $(x_b, y_b, z_b)$. In a manner that is similar to the process described above, the electronic processor 250 may be configured to extrapolate coordinates of the three remaining rear boundary vertices (e.g., the rear-top-right vertex, the rear-bottom-left vertex, and the rear-bottom-right vertex) of the left track model 1300*b* from the coordinates of the rear-top-left boundary vertex 1305, $(-x_b, y_b, z_b)$. Therefore, the track modelling method 800 may be modified to generate a virtual model of tracks 80 that have varying lengths. Although described with respect to rope shovel tracks 80 having front ends that can be individually extended or retracted, it should be understood that the above described track modelling method may also be useful for generating tracks having rear ends that can be individually extended or retracted. Furthermore, it should be understood that the above described track modelling method may be used to generate a virtual model of tracks that cannot be individually extended or retracted. In such embodiments, the third data point associated with the third track position is redundant and provides for additional accuracy when generating the virtual track model.

In some embodiments, both the front end and the rear end of an individual track 80 may be configured to extend and retract. In such embodiments, the electronic processor 250 may not assume that the distance from the track center 405 to a point located on the rear surface of right track 80*a* is equal to the distance from the track center 405 to a corresponding point located on the rear surface of left track 80*b*. Rather, while performing the track modeling method 800, the electronic processor 250 may be configured to generate a virtual track model based on four track positions to accommodate for differences in track length.

Figure 14:
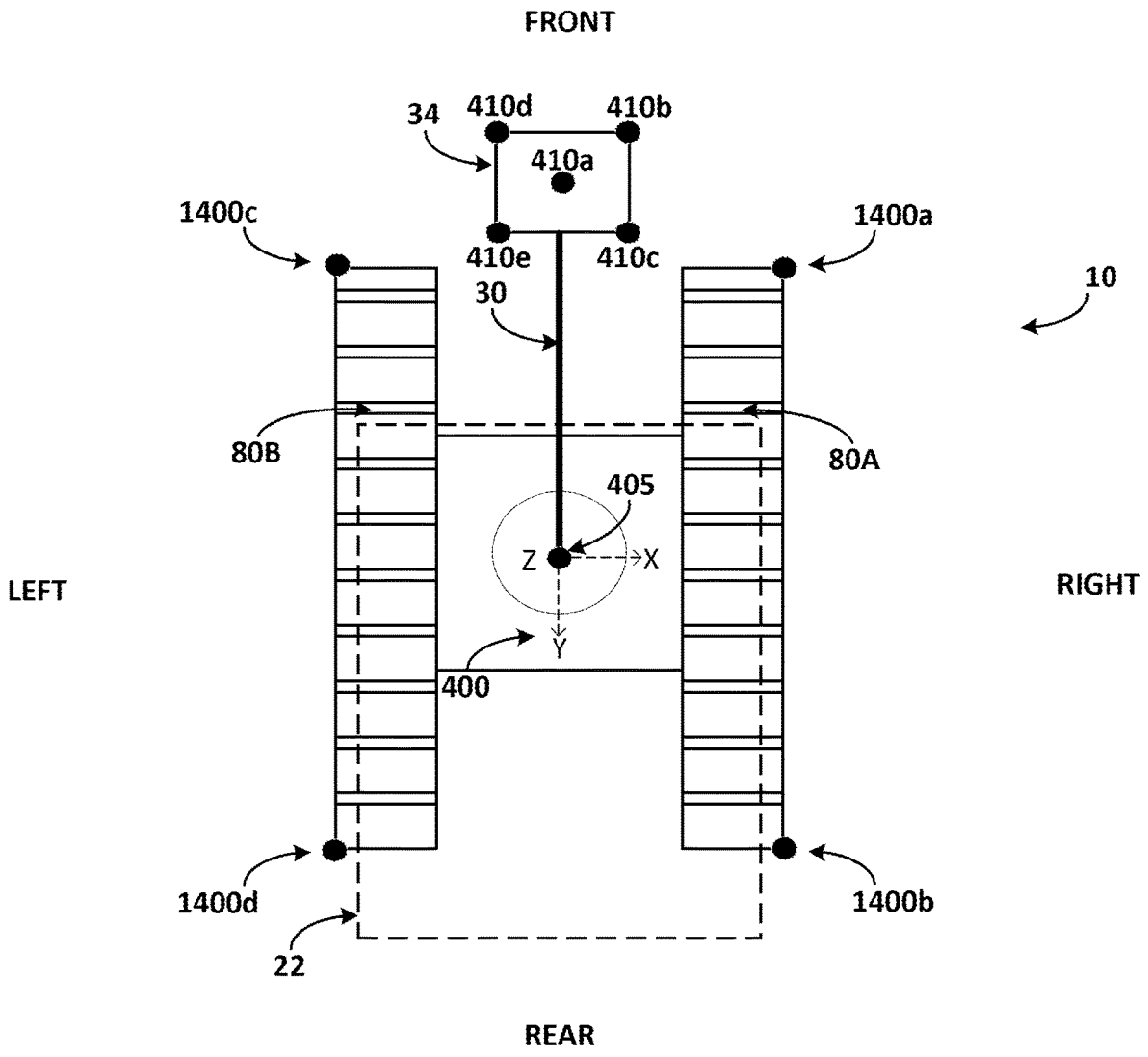
FIG. 14 illustrates four track positions in a top-down schematic view for the mining machine of FIG. 1, according to some embodiments.

For example, four track positions 1400*a*-1400*d* that may be used by the electronic processor 250 when generating a virtual track model are illustrated in FIG. 14. As shown, the first track position 1400*a* is located at a front-top-right vertex of the right track 80*a* and the second track position 1400*b* is located at a rear-top-right vertex of the right track 80*a*. Similarly, the third track position 1400*c* is located at a front-top-left vertex of the left track 80*b* and the fourth track position 1400*d* is located at a rear-top-left vertex of the left track 80*b*. In a manner that is similar to the processes described above with respect to FIGS. 9-13, the electronic processor 250 may be configured to determine respective data points indicative of each of the four track positions 1400*a*-1400*d*. Furthermore, the electronic processor 250 may be configured to extrapolate virtual boundaries from the data points indicative of the track positions and 1400*a*-1400*d* when generating a virtual model of the tracks 80 in a manner similar to the processes described above with respect to FIGS. 9-14. Accordingly, the track modelling method 800 may be modified to generate a virtual model of rope shovel tracks 80 having front and rear ends that can be individually extended or retracted.

Figure 15:
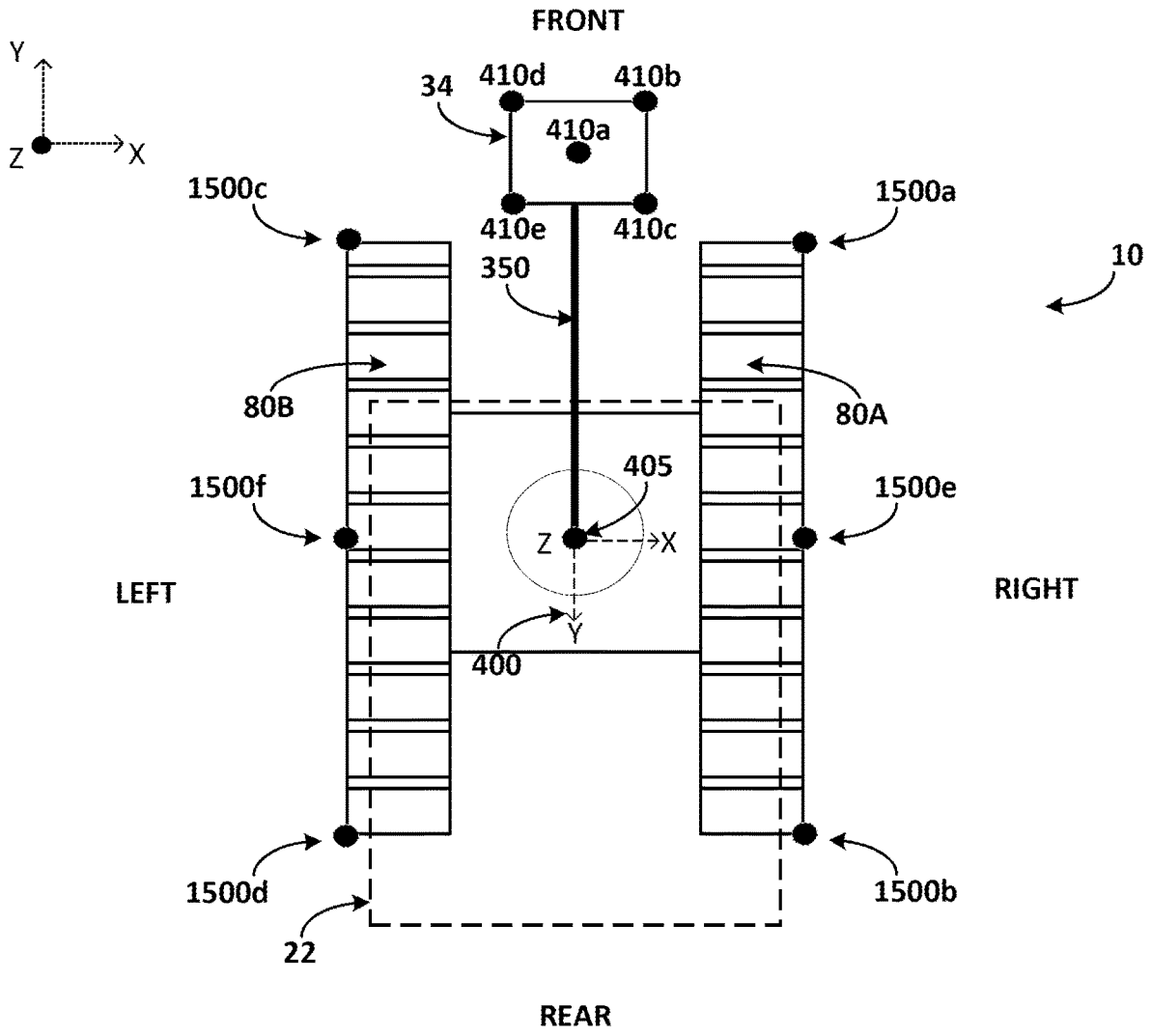
FIG. 15 illustrates six track positions in a top-down schematic view for the mining machine of FIG. 1, according to some embodiments.

In some embodiments, the electronic processor 250 may be configured to generate a virtual track model based on data points associated with more than four track positions. In such embodiments, extrapolating virtual track boundaries from more than four track positions may provide for a more accurate track model than when compared to virtual track boundaries that are extrapolated from four or fewer track positions. For example, the track modeling method 800 may be modified such that the electronic processor 250 is configured to extrapolate virtual track boundaries from as many as five, six, eight, ten, twelve, or more track positions when generating a virtual track model. However, in some instances, the method 800 may require an excessive amount of time to complete if virtual track boundaries are extrapolated from too many positions associated with the tracks 80. That is, moving the dipper 34 to and deriving data points from a large number of track positions before generating the virtual track model may be inefficient and not provide improved accuracy that is worth the additional time. Accordingly, to prevent the track modeling method 800 from requiring too much time to complete, it may be desirable to generate a virtual model of the tracks 80 that is derived from fewer than 12 positions associated with the tracks 80. In some embodiments, it may be desirable to generate a virtual model of the tracks 80 that is derived from fewer than 10, 8, or 6 positions associated with the tracks 80, or in a range between 3 to 6, 3 to 8, 3 to 10, 3 to 12, 4 to 6, 4 to 10, or 4 to 12 positions associated with the tracks 80. These example ranges are inclusive of endpoints such that, for example, a range between 3 to 6 includes 3, 4, 5, and 6. As another example, six track positions 1500*a*-1500*f* that may be used by the electronic processor 250 when generating a virtual track model are illustrated in FIG. 15. The first four positions 1500*a*-1500*d* are similar to the track positions 1400*a*-1400*d* shown in FIG. 14. That is, the first track position 1500*a* is located at a front-top-right vertex of the right track 80*a* and the second track position 1500*b* is located at a rear-top-right vertex of the right track 80*a*. Likewise, the third track position 1500*c* is located at a front-top-left vertex of the left track 80*b* and the fourth track position 1500*d* is located at a rear-top-left vertex of the left track 80*b*. However, an additional fifth track position 1500*e* is located at point on the right track 80*a* that is between the first position 1500*a* and the second position 1500*b*. In particular, the fifth track position 1500*e* is located at a midpoint along the right, or outer edge, of the right track 80*a*'s top surface. Similarly, an additional sixth track position 1500*f* is located at a midpoint along the left, or outer edge, of the left track 80*b*'s top surface.

Similar to the embodiments described above with respect to FIGS. 9-14, the electronic processor 250 may be configured to determine respective data points associate with of each of the six track positions 1500*a*-1500*e*. Furthermore, the electronic processor 250 may be configured to extrapolate virtual boundaries from the data points associated with the track positions 1500*a*-1500*f* when generating a virtual model of the tracks 80. It should be understood that the respective locations of the six track positions 1500*a*-1500*f* are not limited to the locations illustrated shown in FIG. 15. For example, the first four track positions 1500*a*-1500*d* need not necessarily be located on the outer corners of the tracks 80. Rather, the track positions 1500*a*-1500*d* may be moved to any other desired locations associated with the tracks 80. Similarly, fifth and sixth track positions 1500*e*, 1500*f* are not limited to being located at midpoints along the outer edges of the right and left tracks 80*a*, 80*b*, respectively. Rather, the fifth and sixth track positions 1500*a*-1500*d* may be move to any other desired locations associated with the tracks 80.

In some embodiments, the respective locations of track positions are determined according to which information associated with the tracks 80 is known in advance of the process. For example, in the embodiments described above, virtual track boundaries are derived in part from known dimensional data associated with the tracks 80, such as track height and/or track width. However, in some embodiments, predetermined values of the track height and/or the track width are not stored in memory 255 in advance. Accordingly, in such embodiments, the respective locations of track positions may be chosen such that the electronic processor 250 is operable to extrapolate track dimensions from data points indicative of the track positions.

Figure 16:
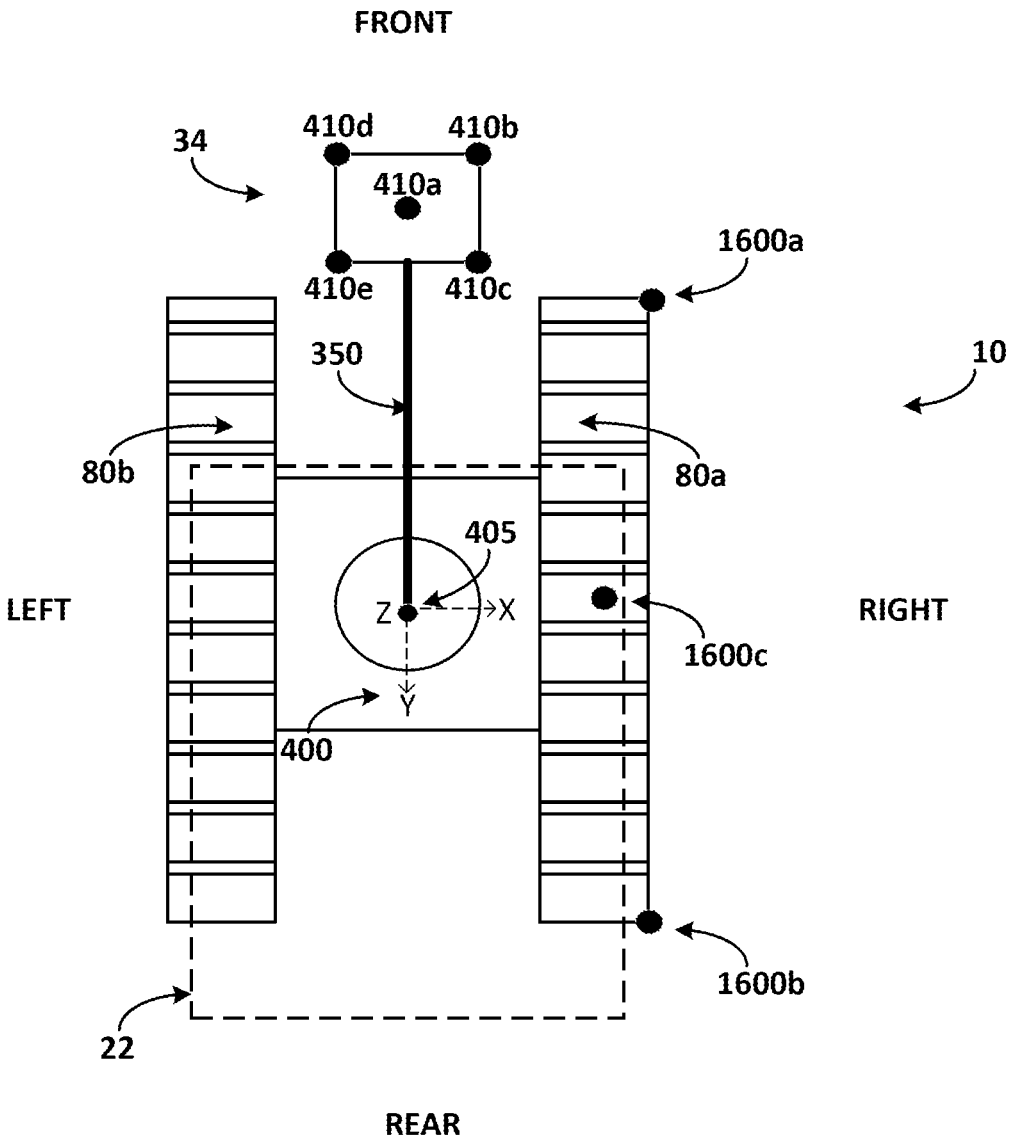
FIGS. 16 and 17 illustrate track positions for generating a track model of tracks with an unknown height and unknown width, respectively, in a top-down schematic view for the mining machine of FIG. 1, according to some embodiments.

FIG. 16 illustrates an embodiment in which the positions associated with the tracks 80 are chosen for generating a virtual track model when a height of the tracks 80 is unknown. The track modeling method 800 may be modified such that while generating the virtual track model, the electronic processor 250 is configured to move the dipper 34 to and determine respective sets of cartesian coordinates representing the track positions 1600*a*-1600*c*. As shown, the respective locations of the first and second track positions 1600*a*, 1600*b* are similar to the locations of the first and second track positions 900*a*, 900*b* described above. In particular, the first track position 1600*a* is located at the front-top-right vertex of right track 80*a*, and the second track position 1600*b* is located at the rear-top-right vertex of right track 80*a*.

The location of the third track position 1600*c* is chosen to be located on a top surface of the right track 80*a*. In particular, the third track position 1600*c* is chosen to be located at a position on the top surface of right track 80*a* that has the tallest height, or largest displacement along the z-axis relative to the track center 405. For example, when the right track 80*a* is curved, a middle portion of the right track 80*a* is taller than the front and/or rear ends of the right track 80*a*. Thus, the third track position 1600*c* may be located on top of a middle portion of the right track 80*a* to enable the electronic processor to determine a height of the right track 80*a*.

The electronic processor 250 may be configured to derive the height of right track 80*a* from a relationship between the z-component of the third track position 1600*c* and the z-component of the first track position 1600*a*. In some embodiments, it may be assumed that the height, or z-component, of the first track position 1600*a* is a fraction of the height of the third track position 1600*c*. Accordingly, the electronic processor 250 may be configured to determine that the height of right track 80*a* is equal to a multiple of the difference between the z-component of the third track position 1600*c* and the z-component of the first track position 1600*a*. For example, if it is assumed that the height of the first track position 1600*a* is half the height of the third track position 1600*c*, the height of right track 80*a* is calculated by doubling the difference between the z-components of the first and third track positions 1600*a*, 1600*c*.

Although deriving track height is described with respect to the illustrated embodiment of FIG. 16, it should be understood that alternative and/or additional track positions may be used by the electronic processor 250 to determine a height of the tracks 80. For example, the electronic processor 250 may be configured to move the dipper 34 to a location at which the bottom surface of the dipper 34 is contacting the surface on which the tracks 80 are resting. Accordingly, the electronic processor 250 may determine that the height of the tracks 80 is equal to the difference between the respective z-components of the top surface of the right track 80*a* and the surface on which the tracks 80 are resting. As another example, the electronic processor 250 may be configured to derive the track height from the coordinates of track positions 1500*a*-1500*f* illustrated in FIG. 15. As another example, the electronic processor 250 may be configured to determine track height based on corresponding positions associated with the left track 80*b*.

In some instances, it can be assumed that the height of right track 80*a* is approximately equal to the height of left track 80*b*. Accordingly, in such instances, the electronic processor 250 may be configured to determine that the calculated height of the right track 80*a* is equal to the height of the left track 80*b* when generating a virtual model of the tracks 80. As a first example, if it can be assumed that the right and left tracks 80*a*, 80*b* are equal in height and other boundary dimensions (e.g., length and width), the electronic processor 250 may be configured to generate a virtual model of the left track 80*b* by mirroring, or reflecting, the virtual model of right track 80*a* across the y-z plane of the local coordinate system 400. As another example, if it can be assumed the right and left tracks 80*a*, 80*b* are approximately equal in height but not equal in length, the electronic processor 250 may be configured to generate a virtual model of the left track 80*b* using the calculated height of right track 80*a* and the modelling processes described above with respect to FIGS. 12 and 13. In some instances, it may not be assumed that the right and left tracks 80*a*, 80*b* are approximately equal in height. In such instances, the electronic processor 250 may be further configured to determine a height of the left track 80*b* in a manner that is similar to the process used for determining the height of right track 80*a*. Accordingly, the electronic processor 250 may be configured to move the dipper 34 to and derive data points from additional positions associated with left track 80*b* when generating a virtual model of tracks 80 that are unequal in height.

Figure 17:
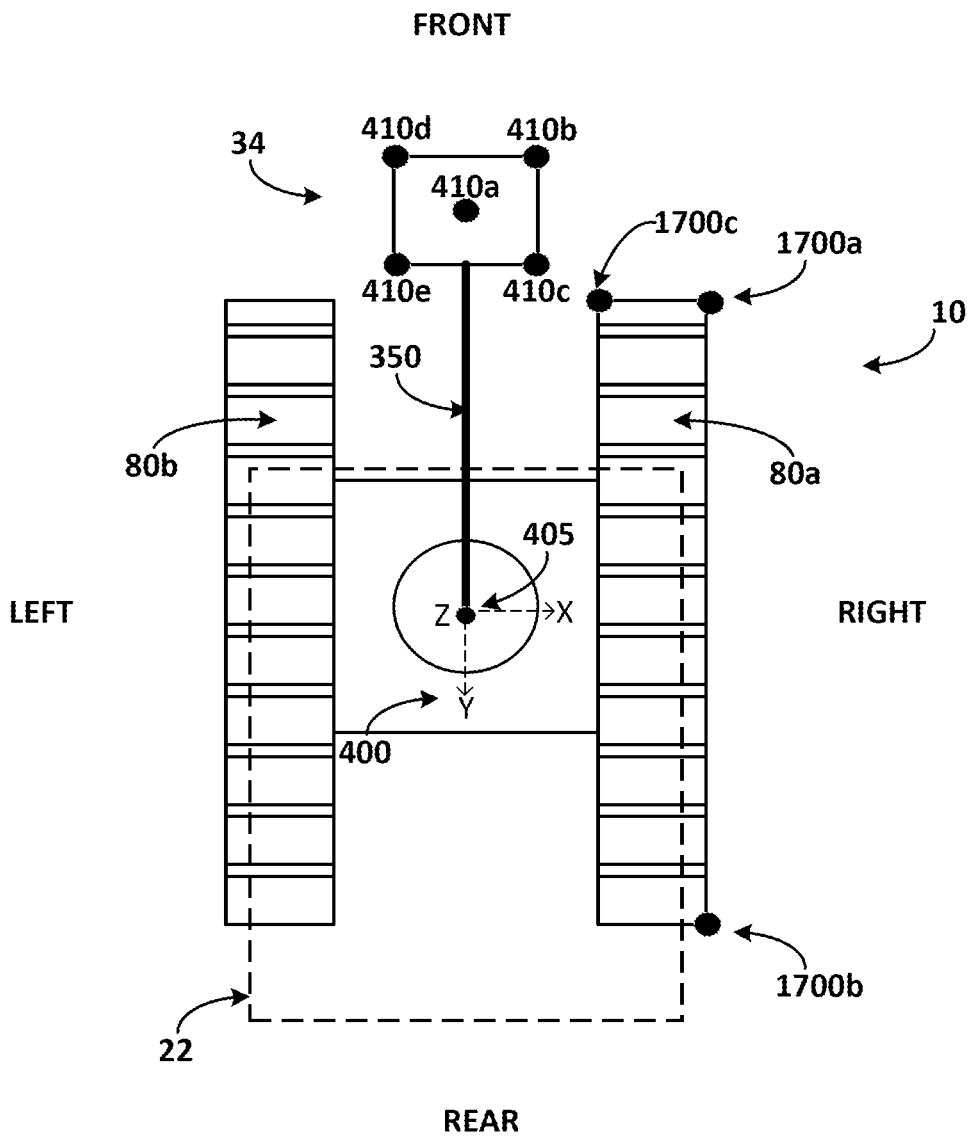

FIG. 17 illustrates an embodiment in which the positions associated with the tracks 80 are chosen for generating a virtual track model when a width of the tracks 80 is unknown. The track modeling method 800 may be modified such that while generating the virtual track model, the electronic processor 250 is configured to move the dipper 34 to and determine respective sets of cartesian coordinates representing the track positions 1700*a*-1700*c* within the local coordinate system 400. As shown, the respective locations of the first and second track positions 1700*a*, 1700*b* are similar to the locations of the first and second track positions 900*a*, 900*b* described above. In particular, the first track position 1700*a* is located at the front-top-right vertex of right track 80*a*, and the second track position 1700*b* is located at the rear-top-right vertex of right track 80*a*. The location of the third track position 1700*c* is chosen to be located at the front-top-left vertex of right track 80*a*. Therefore, the electronic processor 250 may determine the width of right track 80*a* by calculating the difference between the x-component of the first track position 1700*a* and the x-component of the third track position 1700*c*. In some embodiments, alternative and/or additional track positions are used to determine the width of the tracks 80. For example, the electronic processor 250 may be configured to determine track width based on positions associated with the left track 80*b*.

In some instances, it can be assumed that the width of right track 80*a* is approximately equal to the width of left track 80*b*. Accordingly, in such instances, the electronic processor 250 may be configured to determine that the calculated width of the right track 80*a* is equal to the width of the left track 80*b* when generating a virtual model of the tracks 80. As a first example, if it can be assumed that the right and left tracks 80*a*, 80*b* are equal in width and other boundary dimensions (e.g., length and height), the electronic processor 250 may be configured to generate a virtual model of the left track 80*b* by mirroring, or reflecting, the virtual model of right track 80*a* across the y-z plane of the local coordinate system 400. As another example, if it can be assumed the right and left tracks 80*a*, 80*b* are approximately equal in width but not equal in length, the electronic processor 250 may be configured to generate a virtual model of the left track 80*b* using the calculated width of right track 80*a* and the modelling processes described above with respect to FIGS. 12 and 13. In some instances, it may not be assumed that the right and left tracks 80*a*, 80*b* are approximately equal in width. In such instances, the electronic processor 250 may be further configured to determine a width of the left track 80*b* in a manner that is similar to the process used for determining the width of right track 80*a*. Accordingly, the electronic processor 250 may be configured to move the dipper 34 to and derive data points from additional positions associated with left track 80*b* when generating a virtual model of tracks 80 that are unequal in width.

In some embodiments, the track modeling method 800 may be modified to enable the electronic processor 250 to determine a curvature of the tracks 80. For example, FIG. 18 illustrates a right-side view of a rope shovel embodiment in which the rope shovel 10 includes curved tracks 80. As shown, three positions associated with the tracks 80 are chosen such that a curvature of the tracks 80 may be derived from the cartesian coordinates representing track positions 1800*a*-1800*c*.

The first track position 1800*a* is located at the front-right vertex of right track 80*a*. The second track position 1800*b* is located at a midpoint of the top surface of right track 80*a*. That is, the second track position 1800*b* is centered between the front and rear track ends on the top surface of right track 80*a*. The third track position 1800*c* is located at the center of the right-surface of the right track 80*a*. That is, the third track position 1800*c* is located at position on the right surface of right track 80*a* that is centered between the top and bottom surface of the right track 80*a*. Furthermore, the third track position 1800*c* is centered between the front and rear ends of the right track 80*a*.

While determining a curvature of the right track 80*a*, the electronic processor 250 is configured to move the dipper 34 to and determine respective sets of cartesian coordinates representing the track positions 1800*a*-1800*c*. At least in some embodiments, the shape of the right surface of right track 80*a* can be approximately modeled as an ellipse. Accordingly, the electronic processor 250 may be configured to extrapolate virtual boundaries of the right track 80*a* from the respective coordinates of the track positions 1800*a*-1800*c* and the equation for an ellipse.

For example, with respect to Equation 1 below, the electronic processor 250 may be configured to determine that the first radius, R1, of the right track 80*a* is equal to the difference between the respective y-components of the first track position 1800*a* and the third track position 1800*c*. Similarly, the electronic processor 250 may be configured to determine that the second radius, R2, of the right track 80*a* is equal to the difference between the respective z-components of the second track position 1800*b* and the third track position 1800*c*. Accordingly, by using Equation 1, the electronic processor 250 may be configured to extrapolate virtual track boundaries from cartesian coordinates representing points on the surface of a curved track 80.

$$\left(\frac{y^2}{R1^2}\right)+\left(\frac{z^2}{R2^2}\right)=1 \quad \text{[Equation 1]}$$

Swing Encoder Calibration

In some embodiments, the electronic processor 250 may additionally be configured to calibrate the swing sensor 315*c* (e.g., a swing encoder) of the rope shovel 10 based on cartesian coordinates of the positions associated with the tracks 80. As noted above, the swing sensor 315*c* (see FIG. 3B) is configured to indicate a rotational position of the dipper 34 with respect to the swing axis 84 (see FIG. 2). For example, with reference to FIG. 19, where the dipper 34 is centered in front of the rope shovel 10, the swing sensor 315*c* may be positioned and configured to indicate a rotational position of 0 degrees. In this configuration, as a further example, when the dipper 34 is centered facing in the opposite, rear direction, the swing sensor 315*c* indicates a rotational position of 180 degrees. Due to tolerances of components, wear of components overtime, and other factors, the swing sensor 315*c* may not indicate precisely 0 degrees when the dipper 34 is centered in front of the rope shovel 10. Rather, the swing sensor 315*c* may output a rotational position that is offset from 0 degrees (e.g., 0.5 degrees, 2 degrees, 5 degrees, 355 degrees, 358 degrees, etc.).

To ensure that accurate rotational position information is being provided by the swing sensor 315*c*, it may be desirable to calibrate the swing sensor 315*c* during an initial setup stage, periodically after a certain amount of time or use of the rope shovel 10, or both to account for this offset. For example, the electronic processor 250 may determine the offset angle for the swing sensor 315*c* and may calibrate the swing sensor 315*c* by, for example, by reprogramming the swing sensor 315*c* based on the offset angle such that it provides the expected rotational angle for a given swing position of the dipper 34 (e.g., 0 degrees when the dipper is centered in front of the rope shovel 10) or storing the offset angle on the controller 200 such that the controller 200 may transform a received rotational position from the swing sensor 315*c* (e.g., swing angle R) with the offset angle (e.g., +2.5 degrees) to calculate an actual rotational position for the dipper 34 (e.g., R+2.5 degrees).

Figure 19:
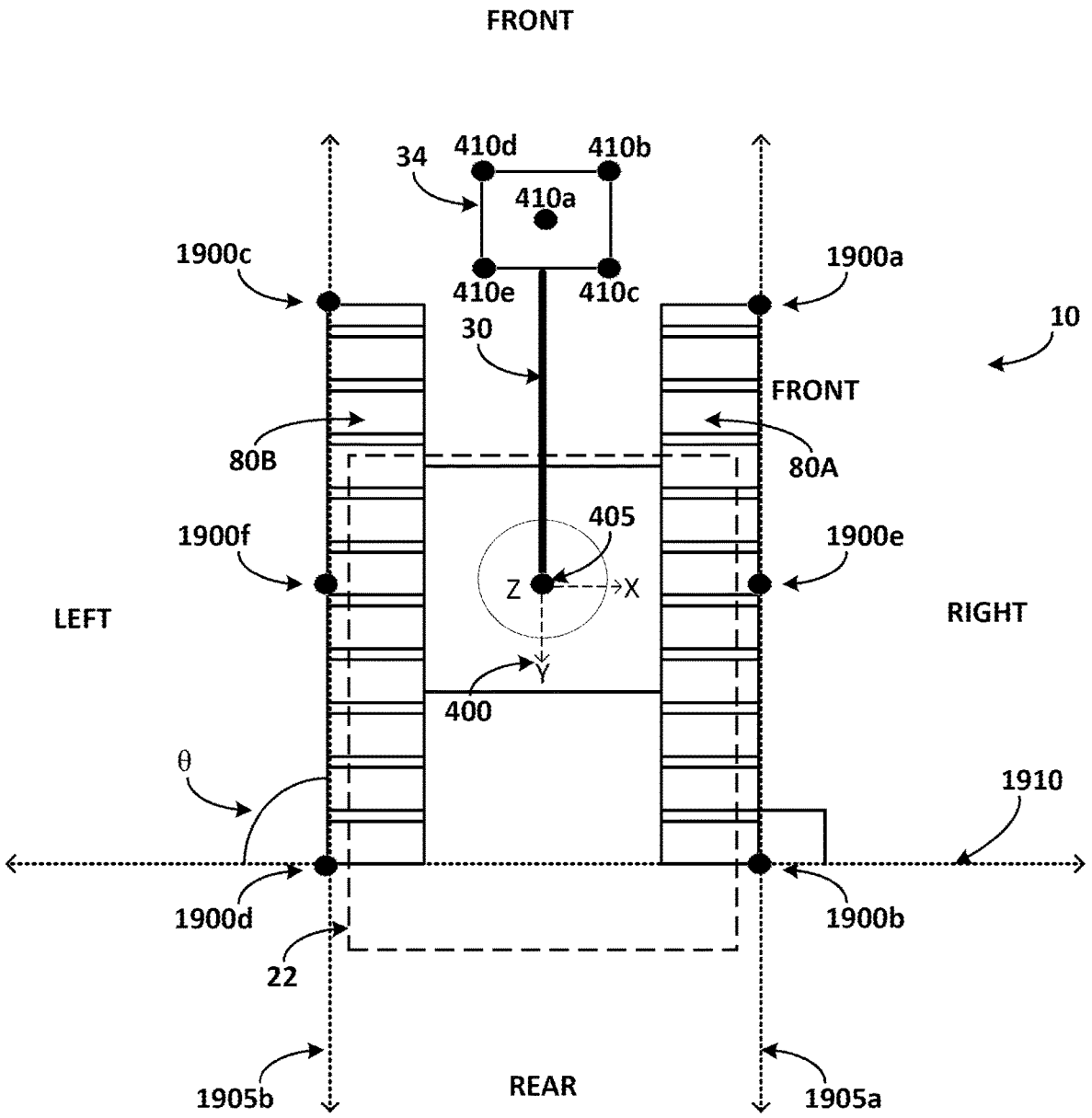
FIG. 19 illustrates a top-down schematic view of the mining machine of FIG. 1 for swing sensor calibration, according to some embodiments.

FIG. 19 illustrates an embodiment in which an offset angle of the swing sensor 315*c* may be derived from the track positions 1900*a*-1900*f* In a manner that is similar to the processes described above, the electronic processor 250 may be configured to move the dipper 34 to and determine respective sets of cartesian coordinates representing the track positions 1900*a*-1900*f* within the local coordinate system 400.

The electronic processor 250 may be further configured to extrapolate a pair of lines that respectively pass through, or nearly pass through, the track positions 1900*a*-1900*f*. In particular, as shown in FIG. 19, the electronic processor 250 may be configured to extrapolate a first line 1905*a* that passes through, or nearly passes through, the positions associated with the outer edge of the right track 80*a* (e.g., the first track position 1900*a*, the second track position 1900*b*, and the fifth track position 1900*e*). Similarly, the electronic processor 250 may be configured to extrapolate a second line 1905*b* that passes through, or nearly passes through, the positions associated with the outer edge of the left track 80*b* (e.g., the third track position 1900*c*, the fourth track position 1900*d*, and the sixth track position 1900*f*).

The electronic processor 250 then extrapolates a third line 1910 that passes through the second track position 1900*b* and is perpendicular to the first line 1905*a*. The electronic processor 250 then determines an angle (θ) between the third line 1910 and the second line 1905*b*. When the swing sensor 315*c* is properly calibrated, the third line 1910 intersects the second line 1905*b* at a right angle (i.e., the angle (θ)=90 degrees). However, when the third line does not intersect the second line 1905*b* at a right angle, the electronic processor 250 determines the offset angle to be equal to the difference between 90 degrees and the angle, θ, at which the third line 1910 intersects the second line 1905*b*. The electronic processor 250 then calibrates the swing sensor 315*c*, as described above, using the determined offset angle.

Thereafter, the rotational position for the dipper 34 is determined using the swing sensor 315*c* as calibrated by the offset angle, improving the accuracy of the determined rotational position. Although the swing sensor calibration was described such that, when the dipper 34 is centered in front of the rope shovel 10, the swing sensor 315*c* indicates a rotational position of 0 degrees, in some embodiments, the reference system for the swing angle is shifted such that 0 degrees indicates another reference point (e.g., where the dipper 34 is centered in the rear direction of the rope shovel 10).

With respect to FIG. 19, the electronic processor 250 may be configured to use alternative methods for deriving an offset angle of the swing sensor 315*c*. For example, in some embodiments, the electronic processor 250 is configured to determine a respective rotational position, or angle of rotation, of the dipper 34 when the dipper 34 is moved to each of the front and rear track positions 1900*a*, 1900*b*, 1900*c*, and 1900*d*. That is, while the dipper 34 is at the track position 1900*a*, the electronic processor 250 determines an amount by which the dipper 34 is rotated (e.g., 30 degrees) relative to the track center 405. Similarly, the electronic processor 250 determines a respective angle of rotation of the dipper 34 while the dipper 34 is located at each of the track positions 1900*b*, 1900*c*, and 1900*d*.

After determining a respective rotation angle of the dipper 34 at each of the front and rear track positions 1900*a*, 1900*b*, 1900*c*, and 1900*d*, the electronic processor 250 is configured to sum the four rotation angles and divide the sum of rotation angles by the total number of rotation angles, four. Accordingly, the electronic processor 250 determines that the offset angle of the swing sensor 315*c* is equal to the result of the sum of rotation angles divided by the total number of rotation angles. As an example, if it is determined that the rotation angle of dipper 34 is equal to 30 degrees at track position 1900*a*, 150 degrees at track position 1900*b*, −29.5 degrees at track position 1900*c*, and −149.5 degrees at track position 1900*d*, the electronic processor 250 will determine that the offset angle of swing sensor 315*c* is equal to 0.25 degrees. Although described with respect to four rotational positions of the dipper 34, it should be understood that the electronic processor 250 may be configured to use more (e.g., six) or less (e.g., two) rotational positions of the dipper 34 when determining an offset angle of the swing sensor 315*c*.

Preventing and Mitigating Collisions Between a Dipper and Exclusionary Zone

Figure 20:
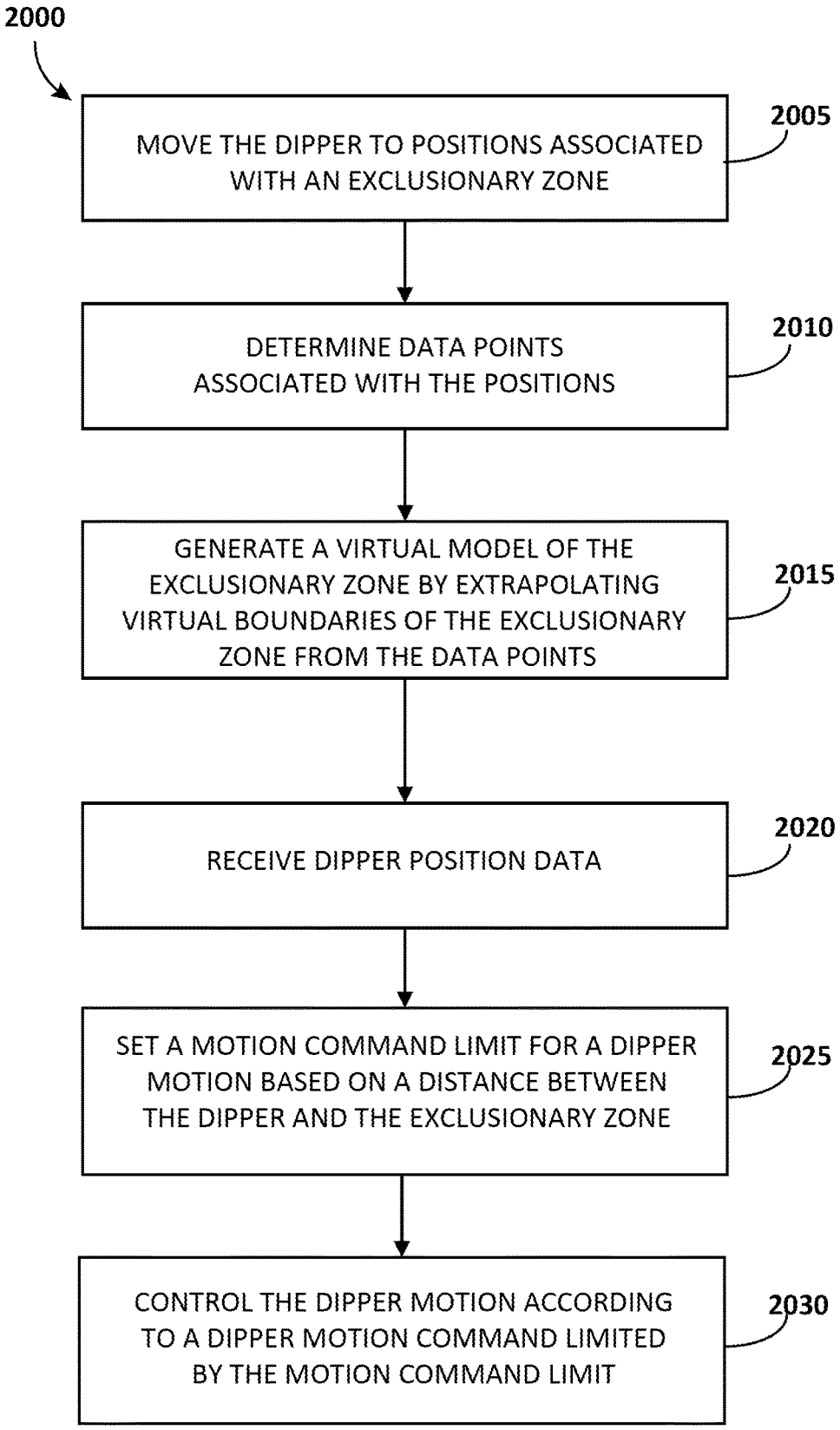
FIG. 20 illustrates a flow chart for preventing or mitigating collisions between a dipper and an exclusionary zone, according to some embodiments.

FIG. 20 illustrates a method 2000 for preventing or mitigating collisions between a dipper and an exclusionary zone, according to some embodiments. Generally, an exclusionary zone is an area or volume that defines the position of an object with which the dipper 34 should avoid colliding.

In the method 2000, the exclusionary zone is taught to the electronic processor 250 by movements of the dipper 34.

Figure 21:
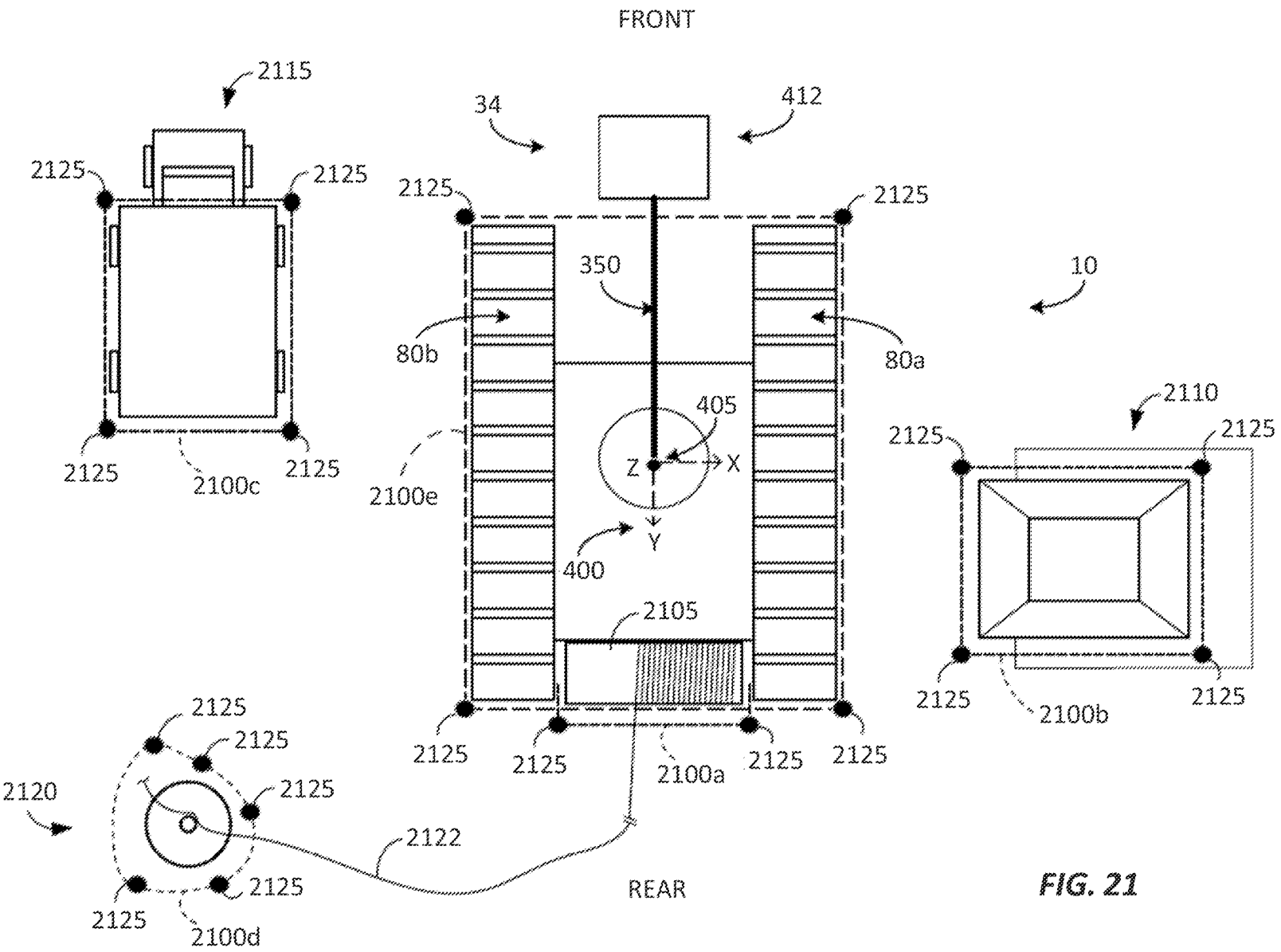
FIG. 21 illustrates a top-down schematic view of the mining machine of FIG. 1 with exclusionary zones, according to some embodiments.

FIG. 21 illustrates a top-down schematic view of the mining machine of FIG. 1 with examples of exclusionary zones 2100*a-e*. As illustrated, an exclusionary zone may define the position of, for example, the tracks 80*a* and 80*b* of the rope shovel, a power cable reel 2105 of the rope shovel, a hopper 2110 that the rope shovel 10 loads with won ore, a truck 2115 that the rope shovel loads with won ore, a power supply station 2120, or another obstacle that the dipper should avoid contacting. The power cable reel 2105 is a reel for a power supply cable 2122 that powers the rope shovel 10. As illustrated, the power supply cable 2122 is coupled to the power supply station 2120. The power supply station 2120 may include a pole extending vertically from a base. The pole may include a mechanical coupling to secure the power supply cable 2122 at an elevated position. Several power supply stations 2120 may be provided to support the power supply cable 2122 in the air across the mine site from a power source (e.g., a transformer).

The exclusionary zone 2100*a* corresponds to the power cable reel 2105, the exclusionary zone 2100*b* corresponds to the hopper 2110, the exclusionary zone 2100*c* corresponds to the truck 2115, the exclusionary zone 2100*d* corresponds to the power supply station 2120, and the exclusionary zone 2100*e* corresponds to the tracks 80*a* and 80*b*. The exclusionary zones 2100*a-e* may be generically referred to as an exclusionary zone 2100 and collectively referred to as the exclusionary zones 2100. Additionally, in some embodiments, the track models described with respect to the method of FIG. 8 may be used as an exclusionary zone (see, e.g., track models 1100*a* and 1100*b* in FIG. 11). Additionally, although the exclusionary zones appear as two-dimensional areas in the top-down view of FIG. 21, the exclusionary zones may be three dimensional volumes, similar to the track models 1100*a* and 1100*b* in FIG. 11.

Returning to FIG. 20, the method 2000 is described with respect to the rope shovel 10, dipper 34, exclusionary zones 2100, and the electronic processor 250; however, in some embodiments, the method 2000 is implemented with respect to other rope shovels or mining machines having dippers with crowd, hoist, and swing motions and with respect to a different arrangement of exclusionary zones 2100. Additionally, although actions within the method 2000 are described as being carried out by the electronic processor 250, the actions may also be described, for example, as being carried out by the electronic controller 200 having the electronic processor 250. Furthermore, in some embodiments, the controller 200 and electronic processor 250 implementing the method 2000 are included in the rope shovel 10 as original equipment (e.g., installed at the time of manufacture of the rope shovel 10) and, in some embodiments, one or more of the controller 200, the electronic processor 250, and the software included thereon are included in an aftermarket control system installed in the rope shovel 10 to implement the method 2000.

In block 2005, the electronic processor 250 moves the dipper to a plurality of positions associated with an exclusionary zone, such as one of the exclusionary zones 2100*a-e* (generically referred to as the exclusionary zone 2100). For example, using the dipper motion command input devices 305, a rope shovel operator may input a command for moving the dipper 34 to positions 2125 associated with the exclusionary zone 2100 (e.g., the four positions 2125 of the exclusionary zone 2100*c* or the five positions 2125 of the exclusionary zone 2100*d*). The electronic processor 250 receives the operator input signals from the dipper motion command input devices 305 and translates the signals to corresponding motion commands for the dipper drives 310. In response to receiving the motion commands from the electronic processor 250, the dipper drives 310 control movement of the dipper 34 to iteratively move the dipper to each of the positions 2125 associated with the exclusionary zone 2100.

In block 2010, the electronic processor 250 determines data points for the exclusionary zone, each data point associated with a position of the plurality of positions. Each data point may include, but is not limited to, one or more measurements taken by the dipper position sensors 315 while the dipper 34 is located at a corresponding position of the plurality of positions. For example, the electronic processor 250 may determine, based on measurements taken by the dipper position sensors 315, the extent to which the dipper 34 is crowded, the extent to which the dipper 34 is hoisted, and/or the rotational position of the dipper 34 while the dipper 34 is located at each of the positions 2125 for a particular exclusionary zone. The crowd, hoist, and rotation measurements taken by the dipper position sensors 315 may be included in and/or stored in association with each data point. In addition, the electronic processor 250 may be configured to determine a set of (x, y, z) coordinates representing each of the positions 2125 for the exclusionary zone 2100, which may be included and/or stored in association with each respective data point. As described above with respect to the rope shovel's local coordinate system 400 in FIG. 4, the electronic processor 250 may be configured to determine, or derive, the (x, y, z) coordinates for each of the positions 2125 based on the (x, y, z) coordinates of a particular dipper reference point 410. Therefore, the (x, y, z) coordinates of the each of the positions 2125 may be derived from the (x, y, z) coordinates of a particular dipper reference point 410 while the dipper 34 is located at each respective position 2125.

In block 2015, the electronic processor 250 generates a virtual model of the exclusionary zone by extrapolating virtual boundaries of the exclusionary zone from the data points. For example, like in block 825 of FIG. 8, the electronic processor 250 may be configured to extrapolate virtual boundaries of the exclusionary zone 2100 from the data included in the data points. The virtual boundaries of the exclusionary zone 2100 collectively form a virtual model of the exclusionary zone 2100 and define a three-dimensional volume representing the exclusionary zone 2100 in the rope shovel's local coordinate system 400. In some embodiments, the electronic processor 250 may be further configured to combine the data points with dimensional data stored in memory 255 when extrapolating virtual boundaries of the exclusionary zone 2100. In other words, in some embodiments, a portion of the data points that form virtual boundaries are presumed based on known or presumed dimensions or symmetries of certain objects (e.g., trucks, hoppers, etc.), rather than taught to the electronic processor 250 using actions like in blocks 2005 and 2010. Further explanation of techniques for extrapolating a virtual model from data points is provided above with respect to generating a virtual track model in block 825 of FIG. 8.

In block 2020, the electronic processor 250 receives dipper position data indicative of a position of the dipper 34. The dipper position data is provided to the electronic processor 250 by one or more of the dipper position sensors 315. For example, the dipper position data may include an output from one or more of the crowd sensor 315*a*, the hoist sensor 315*b*, and the swing sensor 315*c*. The output of the crowd sensor 315*a* indicates the crowd position of the dipper 34, the hoist sensor 315*b* indicates the hoist position of the dipper 34, and the swing sensor 315 indicates the swing position of the dipper 34.

In block 2025, the electronic processor 250 sets a motion command limit for a dipper motion based on a distance between the dipper 34 and the exclusionary zone 2100 of the mining machine inferred from the dipper position data, the dipper motion being selected from a group of a swing motion, a crowd motion, and a hoist motion. In some embodiments, to set the motion command limit based on the distance inferred from the dipper position data, the electronic processor 250 may determine a limit value using one or more of the limit functions 330 stored in the memory 255 (see FIG. 3B). For example, in some embodiments, the limit functions 330 include distance-based functions that define the motion command limit based on the distance between the dipper 34 and the exclusionary zone 2100 such that they use the distance as an input and provide a limit value as an output. As another example, in some embodiments, the limit functions 330 include position-based functions that define the motion command limit based on the dipper position data, where such a position-based function is defined based on relationships between (i) potential dipper positions and (ii) associated distances between the potential dipper positions and the exclusionary zone 2100. In other words, the distance between each potential position of the dipper 34 and the exclusionary zone 2100 may be determined in advance (e.g., in a setup stage); then, at a later stage during operation, when the dipper 34 is determined to be at a particular position, the distance between the dipper 34 and exclusionary zone 2100 is presumed based on the prior determined relationship. The position-based function may be generated based on these underlying relationships between the position of the dipper 34 and the associated distance between the dipper 34 and the exclusionary zone 2100 that results. Accordingly, the position-based functions use the current position of the dipper 34 indicated by the dipper position data as an input (and as a proxy for the distance between the dipper 34 and the exclusionary zone 2100) and provide a limit value as an output. Then, after determining the limit value, the electronic processor 250 may store the limit value in the memory 255 (see FIG. 3B) as the motion command limit for the dipper motion (e.g., as one or more of the crowd limit 335, hoist limit 340, and swing limit 345).

As noted, the distance between the dipper 34 and the exclusionary zone 2100 may be used directly as an input into the limit function(s) or may be used indirectly in advance to generate the limit function(s) such that the current position of the dipper 34 may be used as an input into the limit function(s). In some embodiments, the electronic processor 250 determines a distance between the dipper 34 and the exclusionary zone 2100 using similar techniques as described above with respect to the method 500 of FIG. 5 and determining a distance between the dipper 34 and the tracks 80. For example, in some embodiments, the electronic processor 250 determines the current position of the dipper 34 (based on the dipper position data from block 2020), determines the position of the exclusionary zone (from block 2015), and then determines the shortest distance between the dipper 34 and the exclusionary zone 2100 (e.g., the distance between the two nearest points of the dipper 34 and the exclusionary zone 2100). The electronic processor 250 may determine the shortest distance using a nearest neighbor algorithm, or similar known algorithm. The distance may be a length measurement across three dimensions of space (e.g., x, y, and z dimensions) and, accordingly, may be referred to as a three-dimensional distance.

In some embodiments, the exclusionary zone 2100 is associated with a slow region function and stop region function for the dipper motion. In such embodiments, the electronic processor 250 may select the stop region function for a dipper motion when the distance between the dipper and the exclusionary zone 2100 is below a stop region threshold for that dipper motion, and may select the slow region function for a dipper function in response when the distance between the dipper and the exclusionary zone 2100 is above the stop region threshold, but below the slow region threshold for that dipper motion. When the distance between the dipper and the exclusionary zone 2100 is above the slow region threshold, the electronic processor 250 may return the default limit value for the motion command limit. In some embodiments, the slow region thresholds, stop region thresholds, and default limit values for each of the hoist, crowd, and swing motions are stored in the memory 255 (e.g., as part of the limit function 330). In some embodiments, the slow region function and stop region function associated with the exclusionary zone 2100 are similar to the functions shown in FIGS. 7A and 7B (and combined in FIG. 7C).

In block 2030, the electronic processor 250 controls the dipper motion according to a dipper motion command limited by the motion command limit. Block 2030 may be implemented in a similar manner as described above with respect to block 520 in FIG. 5. For example, in response to operator operation of one of the motion command input devices 305 (see FIG. 3B), the electronic processor 250 receives a dipper motion command input (e.g., a hoist, crowd, or swing command input). The electronic processor 250 then determines the lower of (a) the motion command limit (set in block 2025) and (b) the dipper motion command input. The electronic processor 250 then provides a dipper motion command to the dipper drives 310 associated with the motion command limit (e.g., a hoist drive 220), where the dipper motion command is the lower of (a) the motion command limit and (b) the dipper motion command input. The dipper drive 310 that receives the motion command then controls the dipper motion of the dipper 34 according to the command. For example, when the electronic processor 250 provides a crowd motion command to the crowd drive 215 to crowd in at 20% speed, the crowd drive 215 controls the dipper 34 to crowd in at 20% speed.

In some embodiments of the method 2000, in block 2025, rather than setting a motion command limit for one dipper motion, the electronic processor 250 sets a motion command limit for two or three dipper motions based on the distance between the dipper 34 and the exclusionary zone 2100, where the dipper motions are selected from the group of the swing motion, the crowd motion, and the hoist motion. In these embodiments, a similar process used to set the motion command limit for one dipper motion is used to set the dipper motion for the other dipper motions. Accordingly, in these embodiments, in block 2030, the electronic processor 250 is configured to control the dipper motion of the dipper 34 according to dipper motion commands (e.g., crowd, hoist, and swing commands) limited by each of the crowd limit, hoist limit, and swing limit.

In some embodiments, after block 2030, the electronic processor 250 loops back to block 2005 such that the electronic processor 250 repeatedly executes the method 2000. By repeatedly executing the method 2000, the electronic processor 250 may account for changes over time in the position of the dipper 34 and in the dipper motion command received via the dipper motion command input device 305. Thus, in some embodiments, the electronic processor 250 repeatedly updates the motion command limits based on the distance between the dipper 34 and the exclusionary zone 2100 (or between multiple exclusionary zones 2100) over time as the dipper 34 moves and, in turn, controls the dipper motion based on the updated motion command limit.

In light of the above discussion, it should be apparent that, as the dipper 34 is controlled to be closer to the exclusionary zone 2100, as a general rule, the motion commands are further limited. As a result, in some embodiments, when the dipper 34 is very close to the exclusionary zone 2100, one or more of the dipper motions are restricted such that the dipper 34 moves slowly or not at all in response to motion command inputs from an operator. Additionally, in some embodiments, when the dipper 34 is controlled to crowd in (or hoist down) quickly by the operator towards the exclusionary zone 2100, the electronic processor 250 will limit the crowd (or hoist) motion command more and more such that the dipper 34 is gradually slowed to prevent a collision with the exclusionary zone 2100 or at least mitigate the impact of a collision with the tracks 80.

Each exclusionary zone may be associated with a particular set of limit functions 330. For example, the exclusionary zone 2100*b* for the hopper 2110 may be associated with six limit functions 330, including a separate slow region function and stop region function for each of the hoist, crowd, and swing motions. Similarly, each other exclusionary zone 2100 may be respectively associated with six further limit functions 330, including a separate slow region function and stop region function for each of the hoist, crowd, and swing motions. In some embodiments, the limit functions 330 for one of the exclusionary zones 2100 is more restrictive than the limit functions 330 for another of the exclusionary zones 2100. For example, the exclusionary zones 2100*d* and 2100*a* may be more restrictive than the other exclusionary zones 2100*b*, 2100*c*, and 2100*e* because the exclusionary zones 2100*a* and 2100*d* are for objects having high voltage power (the power supply cable 2122). For example, with reference to FIG. 7C, such limit functions 330 that are more restrictive may have stop region thresholds and slow region thresholds that are higher (i.e., such that motion command limits start when the dipper 34 is further away from the exclusionary zone 2100). Additionally, such limitation functions 330 that are more restrictive may prevent or block motion commands directing the dipper 34 towards the exclusionary zone 2100 (rather than reduce to a non-zero value) when in the stop region.

In some embodiments, blocks 2005, 2010, and 2015 are executed multiple times to teach multiple exclusionary zones 2100 to the electronic processor 250. In such embodiments, after the virtual model of each exclusionary zone 2100 is generated, the electronic processor 250 proceeds to block 2020, 2025, and 2030. As such, in block 2025, the electronic processor 250 may determine the limit value for each exclusionary zone 2100 (based on the associated limit functions 330 for each exclusionary zone 2100), and then set the motion command limit to the lowest (i.e., most restrictive) limit value from the various exclusionary zones 2100. In some embodiments, this limit selection is repeated for each dipper motion (e.g., for the hoist, crowd, and swing motions) such that each dipper motion has a respective motion command limit set that is the lowest limit value by the limit functions 330 for the various exclusionary zones 2100 associated with the particular dipper motion.

In effect, at least in some embodiments, the limit functions 330 of the rope shovel 10 define virtual three-dimensional fields around the exclusionary zones 2100 for each of the swing, crowd, and hoist dipper motions. When one or more of these virtual fields of the dipper 34, which may be mapped onto the coordinate system 400 around the virtual dipper 605, overlaps the exclusionary zone 2100, the one or more dipper motions associated with the one or more overlapping virtual fields is limited.

Accordingly, embodiments described herein provide systems and methods for preventing and mitigating collisions between a dipper and tracks of a mining machine, such as a rope shovel.

What is claimed is:

1. A method for preventing and mitigating collisions between a dipper and tracks of a mining machine, the method comprising:

receiving dipper position data indicative of a position of the dipper;

setting, based on the dipper position data, a motion command limit for a dipper motion, the dipper motion being selected from a group of a swing motion, a crowd motion, and a hoist motion;

comparing a dipper motion command input to the motion command limit;

controlling the dipper motion according to a first dipper motion command when the dipper motion command input is less than the motion command limit; and generating a second dipper motion command and controlling the dipper motion according to the second dipper motion command when the dipper motion command input exceeds the motion command limit.

2. The method of claim 1, wherein, to set the motion command limit for the dipper motion based on the dipper position data, the method further comprises at least one selected from the group of:

(i) calculating a distance between the dipper and the tracks of the mining machine and using the distance as an input to a distance-based function that defines the motion command limit based on the distance, and (ii) using the dipper position data as an input to a position-based function that defines the motion command limit based on the dipper position data, where the position-based function is defined based on relationships between potential dipper positions and associated distances between the potential dipper positions and the tracks of the mining machine.

3. The method of claim 1, further comprising:

determining a position of a three-dimensional virtual dipper model in a three-dimensional coordinate system for the mining machine based on the dipper position data;

determining a position of a three-dimensional virtual tracks model in the three-dimensional coordinate system; and determining, by the electronic processor, a shortest distance between the three- dimensional virtual dipper model and the three-dimensional virtual tracks model, wherein the shortest distance represents the distance between the dipper and the tracks.

4. The method of claim 3, wherein the distance is a three-dimensional distance indicating a length across three dimensions of space.

5. The method of claim 1, wherein setting the motion command limit for the dipper motion based on the dipper position data comprises:

reducing the motion command limit from an initial value to a reduced value according to a function that defines the motion command limit to be lower as a distance between the dipper and the tracks of the mining machine is reduced.

6. The method of claim 5, further comprising:

receiving updated dipper position data indicative of an updated position of the dipper;

determining an updated distance between the dipper and the tracks of the mining machine based on the updated dipper position data, where the updated distance is greater than the distance;

setting the motion command limit to an updated value based on the updated distance, where the updated value is greater than the reduced value; and controlling the dipper motion according to a further dipper motion command limited by the motion command limit having the updated value.

7. The method of claim 5, wherein the function defines a virtual three- dimensional field around the dipper for the dipper motion.

8. The method of claim 1, wherein setting the motion command limit for the dipper motion based on the dipper position data comprises:

when a distance between the dipper and the tracks of the mining machine is below a stop region threshold, setting the motion command limit according to a stop region function, and when the distance is above the stop region threshold and below a slow region threshold, setting the motion command limit according to a slow region function.

9. The method of claim 1, wherein the dipper motion is the crowd motion and motion command limit is a crowd motion command limit, the method further comprising:

setting a hoist motion command limit for the hoist motion based on a distance between the dipper and the tracks of the mining machine.

10. The method of claim 9, further comprising:

setting a swing motion command limit for the swing motion based on a distance between the dipper and the tracks of the mining machine.

11. The method of claim 1, further comprising:

repeatedly receiving the dipper position data indicative of the position of the dipper over time as the dipper moves; and updating the motion command limit based on the dipper position data as the dipper position data is repeatedly received.

12. The method of claim 1, further comprising:

determining a shortest distance between a three-dimensional virtual dipper model and a three-dimensional virtual tracks model, wherein the shortest distance represents the distance between the dipper and the tracks;

and wherein the three-dimensional virtual tracks model is generated by:

moving the dipper to a first position associated with the tracks, determining a first data point associated with the first position, moving the dipper to a second position associated with the tracks, determining a second data point associated with the second position, and generating a virtual model of the tracks by extrapolating virtual boundaries of the tracks from the first data point and the second data point.

13. A mining machine with a collision prevention and mitigation system, the mining machine comprising:

a frame;

tracks supporting the frame and configured to be driven to move the frame over a ground surface;

a dipper supported by the frame;

a dipper drive coupled to the dipper and configured to move the dipper in a dipper motion selected from a group of a swing motion, a crowd motion, and a hoist motion;

a dipper position sensor configured to determine a position of the dipper;

an electronic controller including an electronic processor and a memory, the electronic controller coupled to the dipper drive and the dipper position sensor, the electronic controller configured to:

receive dipper position data from the dipper position sensor indicative of a position of the dipper, set a motion command limit for the dipper motion based on the dipper position data, compare a dipper motion command input to the motion command limit, control, via the dipper drive, the dipper motion according to a first dipper motion command when the dipper motion command input is less than the motion command limit; and generate a second dipper motion command and control the dipper motion according to the second dipper motion command when the dipper motion command input exceeds the motion command limit.

14. The mining machine of claim 13, wherein, to set the motion command limit for the dipper motion based on the dipper position data, the electronic controller is configured to at least one selected from the group of:

(i) calculate a distance between the dipper and the tracks of the mining machine and using the distance as an input to a distance-based function that defines the motion command limit based on the distance, and (ii) use the dipper position data as an input to a position-based function that defines the motion command limit based on the dipper position data, where the position-based function is defined based on relationships between potential dipper positions and associated distances between the potential dipper positions and the tracks of the mining machine.

15. The mining machine of claim 13, wherein the electronic controller is further configured to:

determine a position of a three-dimensional virtual dipper model in a three-dimensional coordinate system for the mining machine based on the dipper position data;

determine a position of a three-dimensional virtual tracks model in the three-dimensional coordinate system; and determine a shortest distance between the three-dimensional virtual dipper model and the three-dimensional virtual tracks model, wherein the shortest distance represents the distance between the dipper and the tracks.

16. The mining machine of claim 15, wherein, to set the motion command limit for the dipper motion based on the dipper position data, the electronic controller is configured to:

reduce the motion command limit from an initial value to a reduced value according to a function that defines the motion command limit to be lower as a distance between the dipper and the tracks of the mining machine is reduced.

17. The mining machine of claim 16, wherein the electronic controller is further configured to:

receive updated dipper position data indicative of an updated position of the dipper;

determine an updated distance between the dipper and the tracks of the mining machine based on the updated dipper position data, where the updated distance is greater than the distance;

set the motion command limit to an updated value based on the updated distance, where the updated value is greater than the reduced value; and control the dipper motion according to a further dipper motion command limited by the motion command limit having the updated value.

18. The mining machine of claim 16, wherein the function defines a virtual three-dimensional field around the dipper for the dipper motion.

19. The mining machine of claim 13, wherein, to set the motion command limit for the dipper motion based on the dipper position data, the electronic controller is configured to:

set the motion command limit according to a stop region function when a distance between the dipper and the tracks of the mining machine is below a stop region threshold, and set the motion command limit according to a slow region function when the distance is above the stop region threshold and below a slow region threshold.

20. The mining machine of claim 13, wherein the dipper motion is the crowd motion and motion command limit is a crowd motion command limit, and wherein the electronic controller is further configured to:

set a hoist motion command limit for the hoist motion based on a distance between the dipper and the tracks of the mining machine.

21. The mining machine of claim 20, wherein the electronic controller is further configured to:

set a swing motion command limit for the swing motion based on a distance between the dipper and the tracks of the mining machine.

22. The mining machine of claim 13, wherein the electronic controller is further configured to:

repeatedly receive the dipper position data indicative of the position of the dipper over time as the dipper moves; and update the motion command limit based on the dipper position data as the dipper position data is repeatedly received.

23. A collision prevention and mitigation control system for a mining machine having a frame, tracks supporting the frame and configured to be driven to move the frame over a ground surface, a dipper supported by the frame, a dipper drive coupled to the dipper and configured to move the dipper in a dipper motion selected from a group of a swing motion, a crowd motion, and a hoist motion, a dipper position sensor configured to determine a position of the dipper, the control system comprising:

an electronic controller including an electronic processor and a memory, the electronic controller coupled to the dipper drive and the dipper position sensor, the electronic controller configured to:

receive dipper position data from the dipper position sensor indicative of a position of the dipper, set a motion command limit for the dipper motion based on the dipper position data, compare a dipper motion command input to the motion command limit, control, via the dipper drive, the dipper motion according to a first dipper motion command when the dipper motion command input is less than the motion command limit, and generating a second dipper motion command and controlling the dipper motion according to the second dipper motion command when the dipper motion command input exceeds the motion command limit.

24. The control system of claim 23, wherein, to set the motion command limit for the dipper motion based on the dipper position data, the electronic controller is configured to at least one selected from the group of:

(i) calculate a distance between the dipper and the tracks of the mining machine and using the distance as an input to a distance-based function that defines the motion command limit based on the distance, and (ii) use the dipper position data as an input to a position-based function that defines the motion command limit based on the dipper position data, where the position-based function is defined based on relationships between potential dipper positions and associated distances between the potential dipper positions and the tracks of the mining machine.

25. The control system of claim 23, wherein the electronic controller is further configured to:

determine a position of a three-dimensional virtual dipper model in a three-dimensional coordinate system for the mining machine based on the dipper position data;

determine a position of a three-dimensional virtual tracks model in the three-dimensional coordinate system; and determine a shortest distance between the three-dimensional virtual dipper model and the three-dimensional virtual tracks model, wherein the shortest distance represents the distance between the dipper and the tracks.

26. The control system of claim 25, wherein, to set the motion command limit for the dipper motion based on the dipper position data, the electronic controller is configured to:

reduce the motion command limit from an initial value to a reduced value according to a function that defines the motion command limit to be lower as a distance between the dipper and the tracks of the mining machine is reduced.

27. The control system of claim 26, wherein the electronic controller is further configured to:

receive updated dipper position data indicative of an updated position of the dipper;

determine an updated distance between the dipper and the tracks of the mining machine based on the updated dipper position data, where the updated distance is greater than the distance;

set the motion command limit to an updated value based on the updated distance, where the updated value is greater than the reduced value; and control the dipper motion according to a further dipper motion command limited by the motion command limit having the updated value.

28. The control system of claim 26, wherein the function defines a virtual three-dimensional field around the dipper for the dipper motion.

29. The control system of claim 23, wherein, to set the motion command limit for the dipper motion based on the dipper position data, the electronic controller is configured to:

set the motion command limit according to a stop region function when a distance between the dipper and the tracks of the mining machine is below a stop region threshold, and set the motion command limit according to a slow region function when the distance is above the stop region threshold and below a slow region threshold.

30. The control system of claim 23, wherein the dipper motion is the crowd motion and motion command limit is a crowd motion command limit, and wherein the electronic controller is further configured to:

set a hoist motion command limit for the hoist motion based on a distance between the dipper and the tracks of the mining machine.

31. The control system of claim 30, wherein the electronic controller is further configured to:

set a swing motion command limit for the swing motion based on a distance between the dipper and the tracks of the mining machine.

32. The control system of claim 23, wherein the electronic controller is further configured to:

repeatedly receive the dipper position data indicative of the position of the dipper over time as the dipper moves; and update the motion command limit based on the dipper position data as the dipper position data is repeatedly received.

* * * * *